US006124543A

United States Patent [19]

Aoki

[11] Patent Number: 6,124,543

[45] Date of Patent: Sep. 26, 2000

[54] APPARATUS AND METHOD FOR AUTOMATICALLY COMPOSING MUSIC ACCORDING TO A USER-INPUTTED THEME MELODY

[75] Inventor: Eiichiro Aoki, Hamamatsu, Japan

[73] Assignee: Yamaha Corporation, Hamamatsu, Japan

[21] Appl. No.: 09/212,192

[22] Filed: Dec. 15, 1998

[30] Foreign Application Priority Data

Dec. 17, 1997 [JP] Japan ..... 9-364072
Nov. 25, 1998 [JP] Japan ..... 10-350742

[51] Int. Cl.[7] ..... G10H 1/26; G10H 7/00

[52] U.S. Cl. ..... 84/609

[58] Field of Search ..... 84/609–614

[56] References Cited

U.S. PATENT DOCUMENTS 4,926,737 5/1990 Minamitaka .
4,982,643 1/1991 Minamitaka .
5,369,216 11/1994 Miyamoto ..... 84/609
5,451,709 9/1995 Minamitaka ..... 84/609
5,696,343 12/1997 Nakata ..... 84/609
5,728,962 3/1998 Goede ..... 84/609
5,736,663 4/1998 Aoki et al. ..... 84/609
5,859,379 1/1999 Ichikawa ..... 84/609

*Primary Examiner*—Stanley J. Witkowski
*Attorney, Agent, or Firm*—Morrison & Foerster

[57] ABSTRACT

A data base includes a plurality of music data set specifying a plurality of sample musical pieces. Each sample musical piece is expressed and specified by either or both of melody characteristics or a melody itself with respect to the respective phrases on a phrase-by-phrase basis in a musical piece. The user inputs a melody fragment or melody characteristics for a particular phrase of a musical piece to be composed. The apparatus selects from the data base a musical piece including a phrase whose melody itself or melody characteristics is equal or similar to the melody fragment or melody characteristics as inputted by the user, and generates a melody fragment for the designated phrase to be included in a composed musical piece by utilizing the inputted melody fragment as it is or by generating a melody fragment based the melody or melody characteristics of the same phrase in the selected musical piece in the data base. Melody sections covering the remaining phrases are generated based on the melody data or the melody characteristics data of the remaining phrases included in the selected musical piece. The generated or utilized melody fragment for the particular phrase plus the generated melody sections for the remaining phrases in combination constitute an automatically composed musical piece product.

38 Claims, 25 Drawing Sheets

Fig.4

PITCH CHARACTERISTICS DATA PC

| | PITCH | TIMING |
|---|---|---|
| P11 INITIAL NOTE | IV | 0 |
| P12 FINAL NOTE | II | 3360 |

P1

| P21 MOTION | P22 PITCH DIFFERENCE | P23 TIME INTERVAL |
|---|---|---|
| DOWNWARD | -1 | 480 |
| HORIZONTAL | 0 | 480 |
| UPWARD | 2 | 240 |
| HORIZONTAL | 0 | 240 |
| UPWARD | 2 | 240 |
| DOWNWARD | -5 | 240 |
| UPWARD | 2 | 240 |
| UPWARD | 1 | 240 |
| DOWNWARD | -2 | 480 |
| UPWARD | 1 | 240 |
| DOWNWARD | -2 | 240 |

P2

RHYTHM CHARACTERISTICS DATA RC

| R1 GENRE | R2 DENSENESS | R3 SYNCOPATION | R4 TOTAL NUMBER OF NOTES |
|---|---|---|---|
| | | WITH / WITHOUT | N |

MARCH
WALZ
JAZZ
·
·
·

| | ONE PHRASE | |
|---|---|---|
| | FIRST HALF | SECOND HALF |
| 1 | SIMILAR DENSENESS | |
| 2 | SPARSER | DENSER |
| 3 | DENSER | SPARSER |

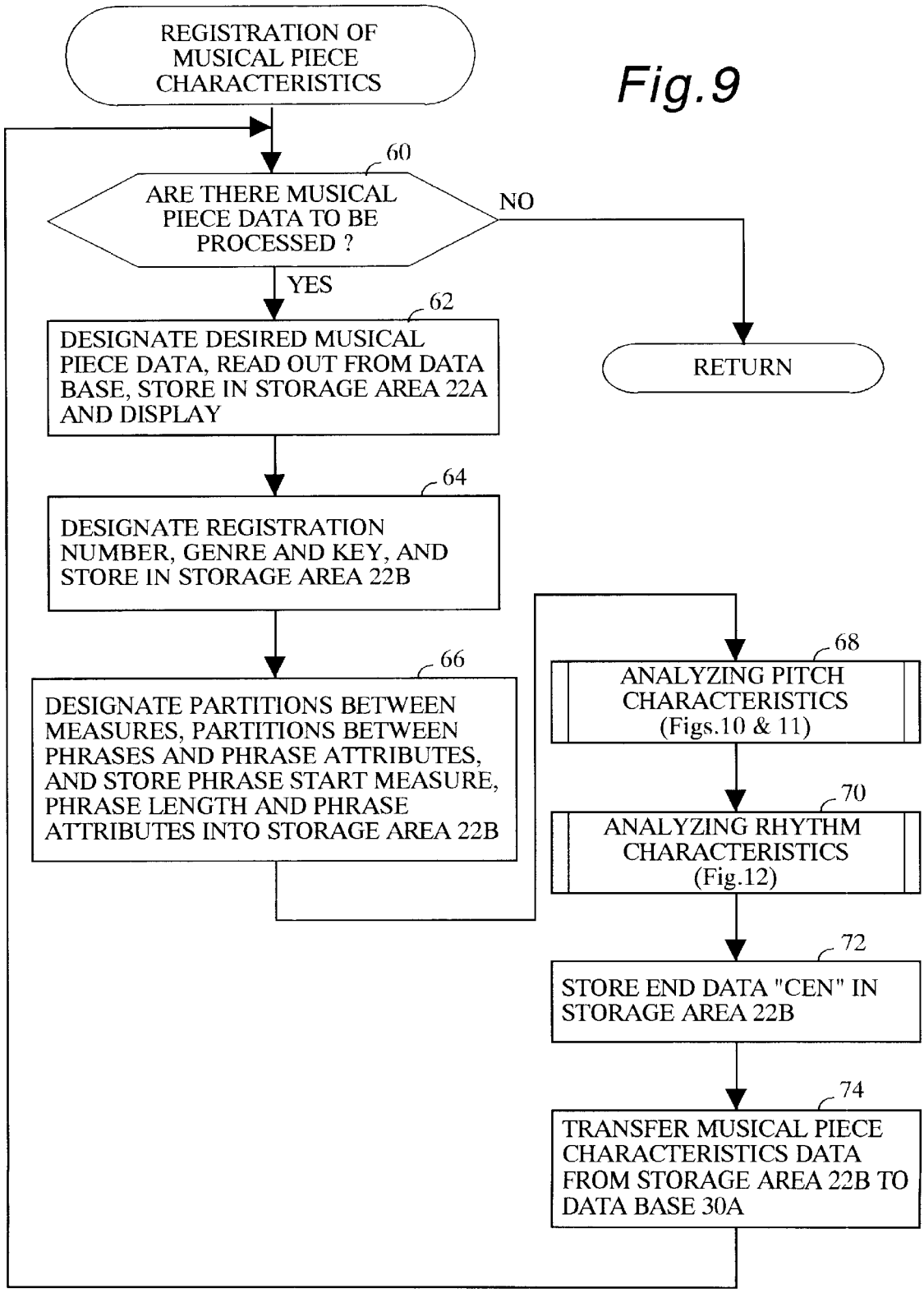
REGISTRATION OF MUSICAL PIECE CHARACTERISTICS
Fig.9
60
ARE THERE MUSICAL PIECE DATA TO BE PROCESSED ?
NO
YES
RETURN
62
DESIGNATE DESIRED MUSICAL PIECE DATA, READ OUT FROM DATA BASE, STORE IN STORAGE AREA 22A AND DISPLAY
64
DESIGNATE REGISTRATION NUMBER, GENRE AND KEY, AND STORE IN STORAGE AREA 22B
66
DESIGNATE PARTITIONS BETWEEN MEASURES, PARTITIONS BETWEEN PHRASES AND PHRASE ATTRIBUTES, AND STORE PHRASE START MEASURE, PHRASE LENGTH AND PHRASE ATTRIBUTES INTO STORAGE AREA 22B
68
ANALYZING PITCH CHARACTERISTICS (Figs.10 & 11)
70
ANALYZING RHYTHM CHARACTERISTICS (Fig.12)
72
STORE END DATA "CEN" IN STORAGE AREA 22B
74
TRANSFER MUSICAL PIECE CHARACTERISTICS DATA FROM STORAGE AREA 22B TO DATA BASE 30A

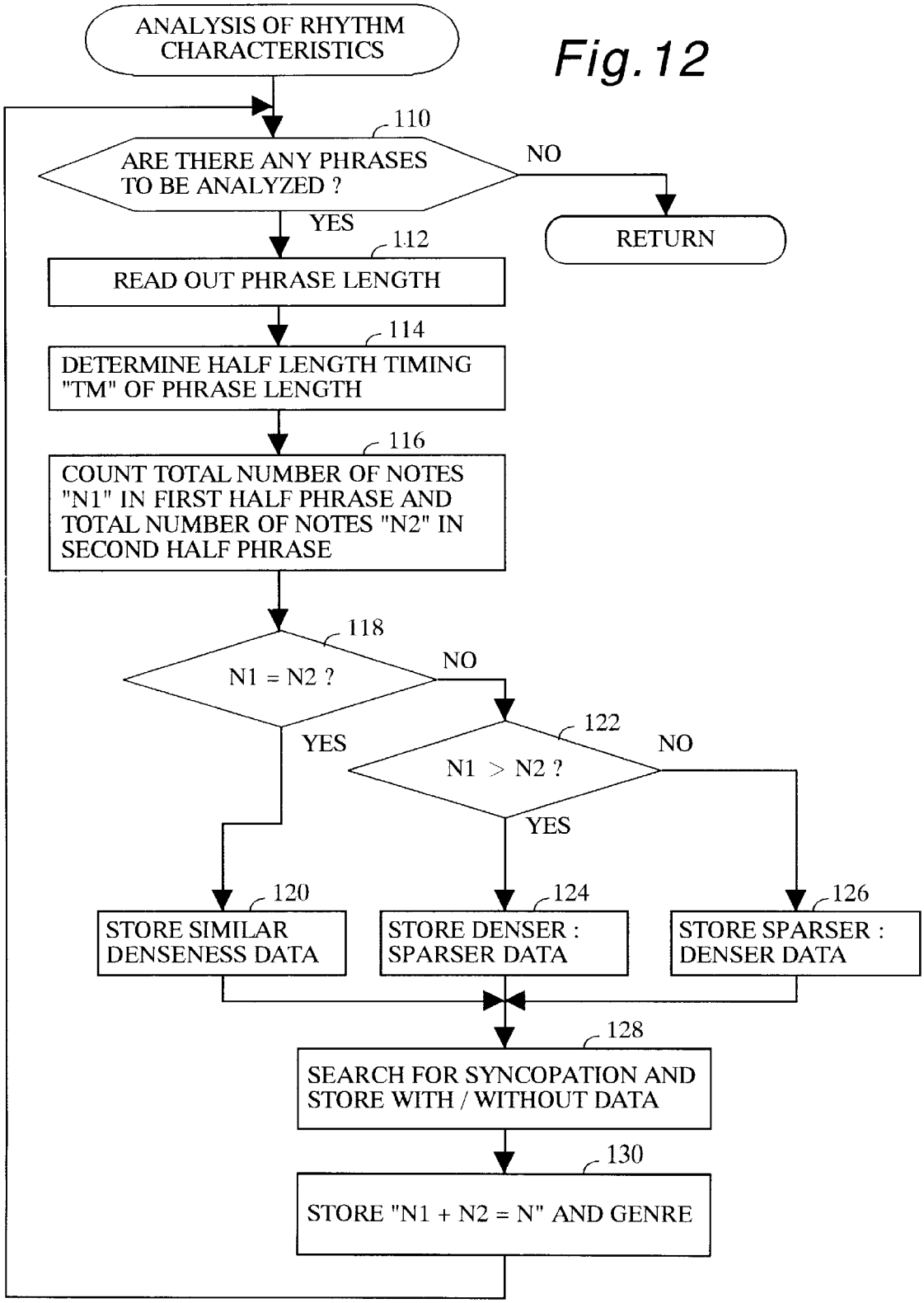
ANALYSIS OF RHYTHM CHARACTERISTICS
Fig. 12
110
ARE THERE ANY PHRASES TO BE ANALYZED ?
NO
RETURN
YES
112
READ OUT PHRASE LENGTH
114
DETERMINE HALF LENGTH TIMING "TM" OF PHRASE LENGTH
116
COUNT TOTAL NUMBER OF NOTES "N1" IN FIRST HALF PHRASE AND TOTAL NUMBER OF NOTES "N2" IN SECOND HALF PHRASE
118
N1 = N2 ?
NO
YES
122
N1 > N2 ?
NO
YES
120
STORE SIMILAR DENSENESS DATA
124
STORE DENSER : SPARSER DATA
126
STORE SPARSER : DENSER DATA
128
SEARCH FOR SYNCOPATION AND STORE WITH / WITHOUT DATA
130
STORE "N1 + N2 = N" AND GENRE

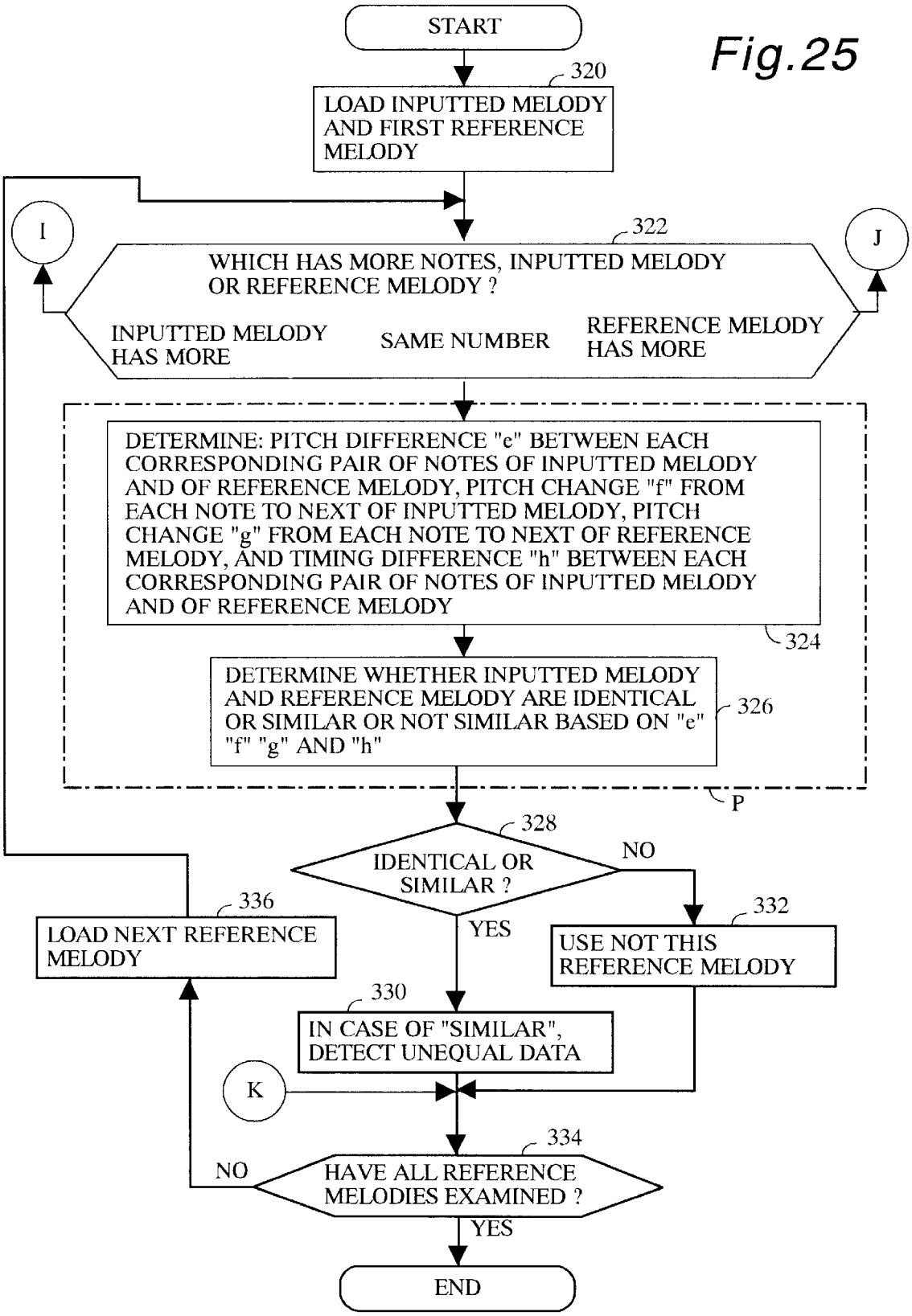
Fig.25
START
320
LOAD INPUTTED MELODY AND FIRST REFERENCE MELODY
I
J
322
WHICH HAS MORE NOTES, INPUTTED MELODY OR REFERENCE MELODY ?
INPUTTED MELODY HAS MORE
SAME NUMBER
REFERENCE MELODY HAS MORE
DETERMINE: PITCH DIFFERENCE "e" BETWEEN EACH CORRESPONDING PAIR OF NOTES OF INPUTTED MELODY AND OF REFERENCE MELODY, PITCH CHANGE "f" FROM EACH NOTE TO NEXT OF INPUTTED MELODY, PITCH CHANGE "g" FROM EACH NOTE TO NEXT OF REFERENCE MELODY, AND TIMING DIFFERENCE "h" BETWEEN EACH CORRESPONDING PAIR OF NOTES OF INPUTTED MELODY AND OF REFERENCE MELODY
324
DETERMINE WHETHER INPUTTED MELODY AND REFERENCE MELODY ARE IDENTICAL OR SIMILAR OR NOT SIMILAR BASED ON "e" "f" "g" AND "h"
326
P
328
IDENTICAL OR SIMILAR ?
NO
YES
336
LOAD NEXT REFERENCE MELODY
332
USE NOT THIS REFERENCE MELODY
330
IN CASE OF "SIMILAR", DETECT UNEQUAL DATA
K
334
NO
HAVE ALL REFERENCE MELODIES EXAMINED ?
YES
END

APPARATUS AND METHOD FOR AUTOMATICALLY COMPOSING MUSIC ACCORDING TO A USER-INPUTTED THEME MELODY

BACKGROUND OF THE INVENTION

1. Field of the Invention

The present invention relates to an automatic music composing apparatus and method, and a computer readable medium containing program therefor, and more particularly to such apparatus, method and medium comprising data base of reference melody pieces for extracting melody generation data which are identical or similar to a theme melody inputted by the user in terms of melody characteristics or melody itself and generating melody data which define a melody which matches the theme melody and includes an abundant variety of musical ups and downs.

2. Description of the Prior Art

A type of automatic music composing apparatus has been conventionally known with which a theme melody piece is inputted by the user, the theme melody piece is analyzed and calculated to develop into a longer melody based on the analysis to compose an amount of melody to constitute a piece of music. See, for example, unexamined Japanese patent publication No. 1989-167782.

Such a type of apparatus, however, develops a melody piece by calculation based on the analyzed melody piece to generate a melody of a piece of music, and accordingly has a drawback that the generated melodies are apt to lack musical ups and downs. The conventional type of automatic music composing apparatus, therefore, can hardly compose, for example, a melody to constitute a piece of music including both melody sections which match the theme melody piece and a release (bridge) melody section which has a different musical mood from the theme melody piece.

SUMMARY OF THE INVENTION

It is, therefore, a primary object of the present invention to provide a novel automatic music composing apparatus capable of generating a melody to cover a piece of music including melody sections which match the theme melody piece and constitute as a whole a melody with an abundant variety of musical ups and downs.

According to one aspect of the present invention, a first type of automatic music composing apparatus comprises: a storage device which stores a plurality of musical piece generation data sets, each set including a reference characteristics data set which represents melody characteristics specifying a reference melody fragment and a melody generation data set which contains melody specifying data of an amount for a piece of music so as to be used for generating a melody to constitute a musical piece, said reference characteristics data set included in each said musical piece generation data set typifying said melody generation data set included in said same musical piece generation data set, a supply device for supplying melody data which defines a desired melody fragment; an analyzer which analyzes the supplied melody data to determine melody characteristics of the desired melody fragment and creates characteristics data representing melody characteristics of the desired melody fragment; a detector which compares the characteristics data created by the analyzer with the reference characteristics data sets stored in the storage device and detects a reference characteristics data set which is equal or similar to the created characteristics data in terms of melody characteristics; a read out device which reads out from the storage device a melody generation data set included in the musical piece generation data set of which the reference characteristics data set is detected by the detector; and a melody generator which generates melody data representing a musical piece based on the melody generation data set as read out from the storage device.

According to this first type of automatic music composing apparatus, as the user of the apparatus supplies melody data which defines a desired melody fragment using the supply device, characteristics data representing melody characteristics of the desired melody fragment are created by the analyzer in connection with the supplied melody data; and a reference characteristics data set which is equal or similar to the created characteristics data in terms of melody characteristics is detected by the detector. The read out device reads out from the storage device a melody generation data set included in the musical piece generation data set of which the reference characteristics data set is detected by the detector, and the melody generator generates melody data representing a musical piece based on the melody generation data set read out from the storage device. In this manner, as the reference characteristics data set which is equal or similar to the supplied melody data in terms of melody characteristics is detected and the melody data for the composed musical piece is generated based on the melody generation data set included in the musical piece generation data set of which the reference characteristics data set is detected, the apparatus is capable of generating a melody of a piece of music which matches the supplied melody fragment. Further more, by storing a melody generation data set capable of generating a melody having musical ups and downs, a musically artistic melody with ups and downs throughout a piece of music can be easily composed.

According to another aspect of the present invention, a second type of automatic music composing apparatus comprises: a storage device which stores a plurality of musical piece generation data sets, each set including a reference melody data set which specifies a reference melody fragment and a melody generation data set which contains a melody specifying data of an amount for a piece of music so as to be used for generating a melody to constitute a musical piece, said reference melody data set included in each said musical piece generation data set typifying said melody generation data set included in said same musical piece generation data set; a supply device for supplying melody data which defines a desired melody fragment; a detector which compares the melody data supplied by the supply device with the reference melody data sets stored in the storage device and detects reference melody data which is equal or similar to the supplied melody data; a read out device which reads out from the storage device a melody generation data set included in the musical piece generation data set of which the reference melody data set is detected by the detector; and a melody generator which generates melody data representing a musical piece based on the melody generation data set as read out from the storage device.

According to this second type of automatic music composing apparatus, as the user of the apparatus supplies melody data which defines a desired melody fragment using the supply device, reference melody data which is equal or similar to the supplied melody data is detected. The read out device reads out from the storage device a melody generation data set included in the musical piece generation data set of which the reference melody data set is detected by the detector, and the melody generator generates melody data representing a musical piece based on the melody generation data set read out from the storage device. In this manner, as the reference melody data set which is equal or similar to the supplied melody data is detected and the melody data for the composed musical piece is generated based on the melody generation data set included in the musical piece generation data set of which the reference melody data set is detected, the apparatus is capable of generating a melody of a piece of music which matches the supplied melody fragment. Further more, by storing a melody generation data set capable of generating a melody having musical ups and downs, a musically artistic melody with ups and downs throughout a piece of music can be easily composed. Still further, as the supplied melody data is directly compared with the reference melody data set, the apparatus is capable of generating a melody which is closer to the supplied melody than otherwise.

In both the first type and the second type of automatic music composing apparatus, the melody generation data set to be stored may be either or both of melody characteristics data for generating a melody or melody data for generating a melody. Where the melody characteristics data are employed as the melody generation data sets, a melody which reflects the musical characteristics of an existing musical piece can be easily generated. On the other hand, where the melody data are employed as the melody generation data sets, a melody can be generated by simply utilizing the melody data of an existing musical piece as it is for the melody generation data set, and thus the processing will be simple and then a melody which reflects the musical feeling owned by the melody data can be generated. Further, where both the melody characteristics data and the melody data are employed as the melody generation data sets, a melody which reflects the musical characteristics owned by the melody characteristics data and the musical feeling owned by the melody data can be generated.

According to a further aspect of the present invention, a third type of automatic music composing apparatus comprises: a storage device which stores reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; a supply device for supplying melody data which defines a desired melody fragment; an analyzer which analyzes the supplied melody data to determine melody characteristics of the desired melody fragment and creates characteristics data representing melody characteristics of the desired melody fragment; a detector which compares the characteristics data created by the analyzer with the reference characteristics data set stored in the storage device and detects unequal conditions between the created characteristics data and the stored reference characteristics data set to deliver unequalness data indicating the unequal conditions, an adjuster which reads out the melody generation data set stored in the storage device, and adjusts the read out melody generation data set in accordance with the unequalness data from the detector; and a melody generator which generates melody data representing a musical piece based on the melody generation data set as adjusted by the adjuster.

According to this third type of automatic music composing apparatus, as the user of the apparatus supplies melody data which defines a desired melody fragment using the supply device, characteristics data representing melody characteristics of the desired melody fragment are created by the analyzer in connection with the supplied melody data, and unequalness data indicating unequal conditions between the created characteristics data and the stored reference characteristics data set is detected by the detector. The adjuster adjusts the melody generation data set in accordance with the unequalness data from the detector, and the melody generator generates a set of melody data representing a musical piece based on the melody generation data set adjusted by the adjuster. In this manner, with respect to the reference characteristics data set which is not equal to the melody characteristics of the supplied melody data, the melody generation data set typified by the corresponding reference characteristics data set is adjusted in accordance with the unequalness data, and then a set of melody data for a composed musical piece is generated based on the adjusted melody generation data set to provide a melody which is closer to the supplied melody segment With this third type of apparatus, however, in place of adjusting the melody generation data set in accordance with the unequalness data, a melody data set may first be generated based on the melody generation data set and thereafter the generated melody data set may be adjusted in accordance with the unequalness data.

According to a still further aspect of the present invention, a fourth type of automatic music composing apparatus comprises: a storage device which stores reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; a supply device for supplying melody data which defines a desired melody fragment; a detector which compares the supplied melody data supplied by the supply device with the reference melody data set stored in the storage device and detects unequal conditions between the supplied melody data and the stored reference characteristics data set to deliver unequalness data indicating unequal conditions; an adjuster which reads out the melody generation data set stored in the storage device, and adjusts the read out melody generation data set in accordance with the unequalness data from the detector; and a melody generator which generates melody data representing a musical piece based on the melody generation data set as adjusted by the adjuster.

According to this fourth type of automatic music composing apparatus, as the user of the apparatus supplies melody data which defines a desired melody fragment using the supply device, unequalness data indicating unequal conditions between the melodies respectively represented by the supplied melody data and the stored reference melody data set is delivered by the detector. The adjuster adjusts the melody generation data set in accordance with the unequalness data from the detector, and the melody generator generates a set of melody data representing a musical piece based on the melody generation data set adjusted by the adjuster. In this manner, with respect to the reference melody data set which is not equal to the supplied melody data, the melody generation data set typified by the corresponding reference melody data set is adjusted in accordance with the unequalness data, and then a set of melody data for a composed musical piece is generated based on the adjusted melody generation data set to provide a melody which is close to the supplied melody segment. With this fourth type of apparatus, however, in place of adjusting the melody generation data set in accordance with the unequalness data, a melody data set may first be generated based on the melody generation data set and thereafter the generated melody data set may be adjusted in accordance with the unequalness data.

In all the first type through the fourth type of automatic music composing apparatus, the supply device may supply melody data for a partial section of a musical piece to be composed and the melody generator may creates melody data for the remaining sections of the musical piece to be composed, wherein the melody data for a partial section and the melody data for the remaining sections may be combined into a melody data set for a complete musical piece. In this manner, the composed melody for a piece of music will include the supplied melody fragment at a partial section thereof.

According to a still further aspect of the present invention, a fifth type of automatic music composing apparatus comprises: a storage device which stores a plurality of musical piece characteristics data sets, each set consisting of a plurality of section characteristics data subsets respectively representing melody characteristics of a plurality of musical sections constituting a piece of music; a section designating device for designating a selected one of the plurality of musical sections; a supply device for supplying melody data for the musical section designated by the section designating device; an analyzer which analyzes the supplied melody data to determine melody characteristics of the designated musical section and creates characteristics data representing melody characteristics of the designated musical section; a read out device which selects from the storage device a musical piece characteristics data set including a section characteristics data subset representing melody characteristics at the designated musical section which melody characteristics are equal or similar to the melody characteristics represented by the created characteristics data, and reads out the selected musical piece characteristics data set; and a melody generator which utilizes at least a part of the melody represented by the supplied melody data as first melody data for the designated musical section, creates second melody data for the remaining section is other than the designated musical section based on the musical piece characteristics data set read out from the storage device, and combines the first melody data and the second melody data to generate a melody data set representing an amount of melody to constitute a musical piece.

According to this fifth type of automatic music composing apparatus, as the user of the apparatus designates a selected one of the plurality of musical sections and supplies melody data for the designated musical section, the supplied melody data is analyzed by the analyzer to create characteristics data representing melody characteristics of the supplied melody data, a musical piece characteristics data set including a section characteristics data subset representing melody characteristics at the designated musical section which melody characteristics are equal or similar to the melody characteristics represented by the created characteristics data is selectively read out from the storage device by the read out device. The melody generator utilizes at least a part of the melody represented by the supplied melody data as first melody data for the designated musical section and creates second melody data for the remaining sections other than the designated musical section based on the musical piece characteristics data set read out from the storage device to thereby generate a melody data set representing an amount of melody to constitute a musical piece. In this manner, with respect to the designated musical section, the melody fragment represented by the supplied melody data is utilized as it is, while with respect to the remaining sections of the intended music composition, a melody is created based on the read out musical piece characteristics data set, and thus a melody data for a piece of music is generated representing both the utilized melody and the created melody. Therefore, a melody for a piece of music which includes a desired melody fragment at the desired musical section and as a whole matches the desired melody can be easily composed.

According to a still further aspect of the present invention, a sixth type of automatic music composing apparatus comprises: a storage device which stores a plurality of musical piece data sets, each set consisting of a plurality of section melody data subsets respectively representing melodies of a plurality of musical sections constituting a piece of music; a section designating device for designating a selected one of the plurality of musical sections; a supply device for supplying melody data for the musical section designated by the section designating device; a read out device which selectively reads out from the storage device a musical piece data set including a section melody data subset representing a melody at the designated musical section which melody is equal or similar to the melody represented by the supplied melody data; and a melody generator which utilizes at least a part of the melody represented by the supplied melody data as first melody data for the designated musical section, creates second melody data for the remaining sections other than the designated musical section based on the musical piece data set read out from the storage device, and combines the first melody data and the second melody data to generate a melody data set representing an amount of melody to constitute a musical piece.

According to this sixth type of automatic music composing apparatus, as the user of the apparatus designates a selected one of the plurality of musical sections and supplies melody data for the designated musical section, a musical piece data set including a section melody data subset representing a melody fragment at the designated musical section which melody fragment is equal or similar to the melody fragment represented by the supplied melody data is selectively read out from the storage device by the read out device. The melody generator utilizes at least a part of the melody represented by the supplied melody data as first melody data for the designated musical section and creates second melody data for the remaining sections other than the designated musical section based on the musical piece data set read out from the storage device to thereby generate a melody data set representing an amount of melody to constitute a musical piece. In this manner, with respect to the designated musical section, the melody fragment represented by the supplied melody data is utilized as it is, while with respect to the remaining sections of the intended music composition, a melody is created based on the read out musical piece data set, and thus a melody data for a piece of music is generated representing both the utilized melody and the created melody. Therefore, a melody for a piece of music which includes a desired melody fragment at the desired musical section and as a whole matches the desired melody can be easily composed. Further, as the melody for the intended musical composition is generated based on the musical piece data set which includes a melody fragment which is equal or similar to the supplied melody fragment represented by the supplied melody data, the composed melody will be close to the supplied melody.

BRIEF DESCRIPTION OF THE DRAWINGS

For a better understanding of the present invention, and to show how the same may be practiced and will work, reference will now be made, by way of example, to the accompanying drawings, in which:

FIG. 4 shows data content charts explaining pitch characteristics data and of rhythm characteristics data;

FIG. 9 is a flowchart showing the subroutine of registering musical piece characteristics;

FIG. 12 is a flowchart showing the subroutine of analyzing rhythm characteristics;

FIGS. 25 and 26 in combination depict a flowchart showing the processing for comparing melody data and detecting unequalness data to be used in the processing shown in FIG. 24.

DESCRIPTION OF THE PREFERRED EMBODIMENTS

Figure 1:
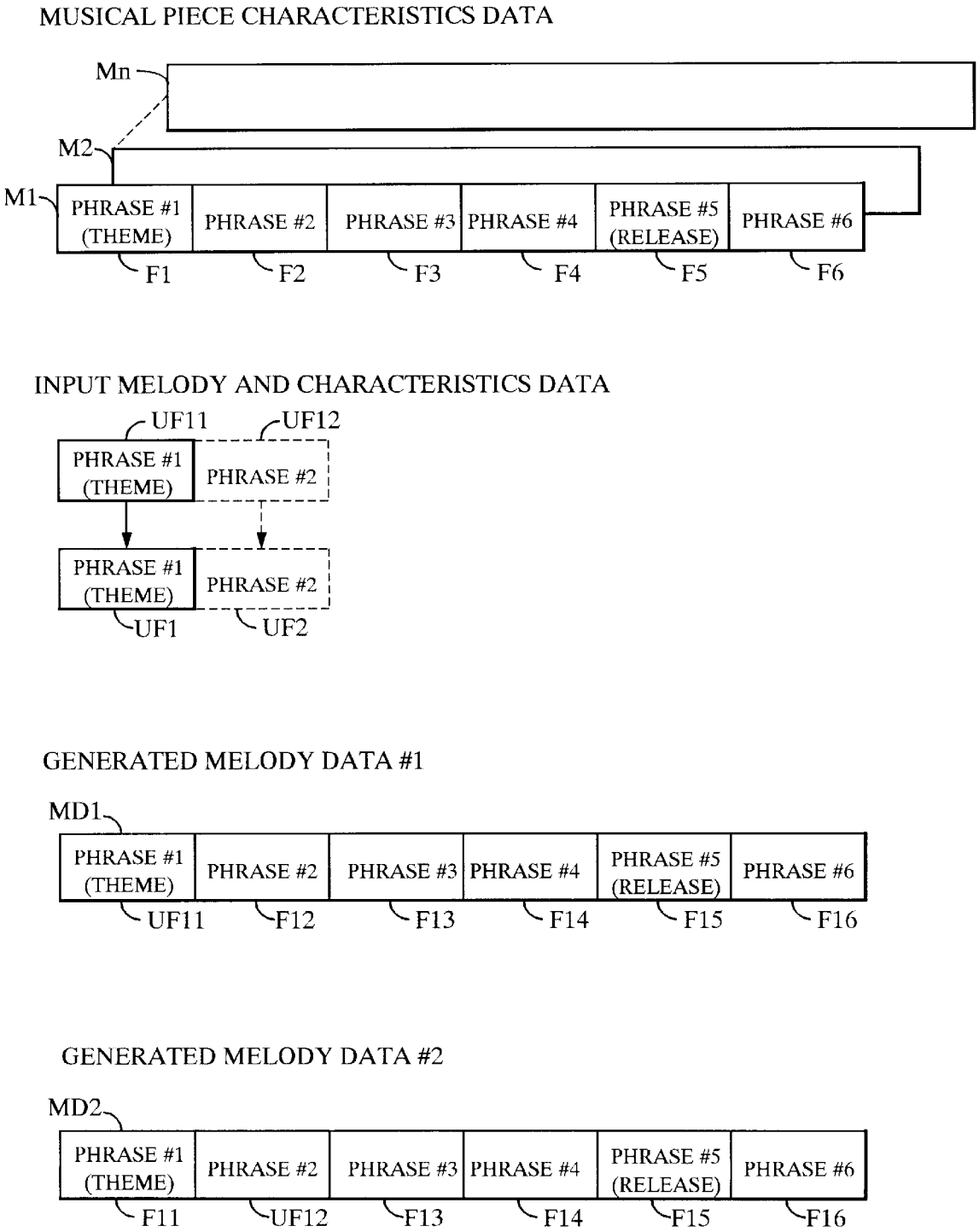
FIG. 1 shows musical phrase data maps illustrating how the music composing processing goes in an embodiment of the present invention.

Illustrated in FIG. 1 of the drawings are data maps covering various data to illustrate how the music composing processing is conducted in an embodiment of the present invention. Referring to FIG. 1, hereinbelow will be explained an example of a method for generating a melody on a phrase-by-phrase basis.

To begin with, a plurality of existing complete musical pieces abundant in a variety of musical ups and downs are analyzed with respect to melody characteristics for each musical piece to prepare musical piece characteristics data which represent the characteristics on the melody of the musical piece. The melody characteristics herein referred to include the rhythm characteristics and the pitch characteristics. Examples of the rhythm characteristics are:

(a) denseness in the distribution of notes: indicating which is sparser (or denser) in notes, the first half or the second half of the phrase, or similar to each other;

(b) syncopation: indicating whether the phrase is with any syncopation or without, and to what degree;

(c) shortest note duration: eighth note or sixteenth note; and (d) phrase start timing: advanced into the preceding measure, just on the top of the measure, or delayed from the top of the measure.

And, examples of the pitch characteristics are:

(e) pitch amplitude in the phrase;

(f) the initial note and the final note in the phrase; and (g) pitch variation shape; a succession of pitches with a local peak or with a local trough in the phrase (with or without time information), a succession of pitches in an upward motion or in a downward motion exhibiting an inclination direction of the pitch variation in the pitch progression (with or without time information).

In FIG. 1, musical piece characteristics data M1, M2, . . . , Mn are sets of data each representing the characteristics of each melody among a plurality of musical pieces, and are stored in a storage device to constitute a data base including the data sets M1 through Mn. A characteristics data set for each musical piece covers the characteristics of the melody on a phrase-by-phrase basis. For example, the musical characteristics data set M1 includes phrase characteristics data F1 representing the characteristics of the melody segment of the first phrase (a theme phrase), phrase characteristics data F2 representing the characteristics of the melody segment of the second phrase, phrase characteristics data F3 representing the characteristics of the melody segment of the third phrase, phrase characteristics data F4 representing the characteristics of the melody segment of the fourth phrase, phrase characteristics data F5 representing the characteristics of the melody segment of the fifth phrase (a release phrase), and phrase characteristics data F6 representing the characteristics of the melody segment of the sixth phrase.

Then, the user designates any of the phrases and inputs desired melody data (of a melody segment) for the phrase. The inputted melody data is analyzed to determine melody characteristics of the phrase, thereby creating phrase characteristics data represent the melody characteristics of the phrase. As shown under the heading "INPUT MELODY AND CHARACTERISTICS DATA", for example, in case melody data UT11 is inputted for phrase #1 (theme phrase) by the user, phrase characteristics data UF1 is created representing the melody characteristics of the fiast (theme) phrase by analyzing the inputted melody data UF11. Likewise, when melody data UF12 is inputted for phrase #2 by the user, phrase characteristics data UF2 is created representing the melody characteristics of the second phrase.

Next, a search is made in the data base to select and read out a musical piece characteristics data whose melody characteristics are equal (identical) or similar to the melody characteristics of the melody data inputted by the user. This select-and-read-out procedure will be conducted, for example, by comparing the phrase characteristics data UF1 with the phrase characteristics data F1 of the first (theme) phrase in the musical piece characteristics data M1, and upon judging the two being equal or similar, reading out the musical piece characteristics data M1. But when the two are Judged as being neither equal nor similar, the comparison will be made between the data UF1 and the phrase characteristics data of the first (theme) phrase in the next musical piece characteristics data M2. The comparison procedure goes forward from one musical piece characteristics data to another in the same manner, and every time the comparison reveals that the phrase characteristics data UF1 is equal or similar to the phrase characteristics data of the first (theme) phrase in the musical piece characteristics data under comparison, the so revealed musical piece characteristics data will be read out.

Next, by utilizing (as is) the melody data inputted by the user and by creating melody data based on the read-out musical piece characteristics data, a set of melody data for a piece of music is generated including the utilized melody data and the created melody data. For example, when the melody data UF11 is inputted with the designation of the first (theme) phrase and the musical piece characteristics data set M1 is read out, the inputted melody data UF11 itself is utilized as melody data for the first (theme) phrase and father melody data F12 through F16 are created for the rest of the phrases other than the first (theme) based on the musical piece characteristics data set M1 to generate (compose) a melody data MD1 constituting a piece of music as illustrated as generated melody data #1 in FIG. 1. On the other hand, when the melody data UF12 is inputted with the designation of the second phrase and the musical piece characteristics data set M1 is read out from the data base, the inputted melody data UF12 itself is utilized as melody data for the second phrase and further melody data F11, F13 through F16 are created for the rest of the phrases other than the second based on the musical piece characteristics data set M1 to generate (compose) a melody data set MD2 for a piece of music as illustrated as generated melody data #2 in FIG. 1. According to the user's desire, the inputted melody data UF12 may be partly modified (i.e. partly utilized) to make a melody for the second phrase, or the inputted melody data UF13 may be partly modified to make a melody for the third phrase, and similarly so forth.

In the case where the data base includes musical piece data as well as the musical piece characteristics data as described with reference to FIG. 2, musical piece data having a melody which is equal or similar to the melody data inputted by the user is read out from the data base after comparison as described above, and any part (e.g. a melody of one phrase) of the read-out musical piece data may be utilized as it is for a part of the melody data of MD1 or MD2 or so forth.

Further, the data base may contain musical piece data of a plurality of musical pieces in place of the musical piece characteristics data M1 through Mn, wherein a melody may be generated based on any of the stored musical piece data and the inputted melody data. Each of the musical piece data represents a melody consisting of a plurality of phrases, for example, of phrases #1 (theme), #2, #3, #4, #5 (release) and #6 as shown in FIG. 1.

With this embodiment, the user first inputs a desired melody data designating any of the phrases. For example, the user inputs melody data UF11 designating the first (theme) phrase as shown at input melody and characteristics data in FIG. 1. Then, a musical piece data having a melody which is equal or similar to the inputted melody data is selected and read out from the data base. For this purpose, for example, the melody data UF11 is compared with the melody data of the first (theme) phrase of each musical piece data in the data base, and the musical piece data having a melody which is equal or similar to the melody data UF11 may be selected and read out Then, a part of the inputted melody data is utilized (appropriated) as is and melody data for the rest of the phrases are created based on the read-out musical piece data to generate a melody data for a piece of music including the utilized melody data and the created melody data. For example, the melody data UF11 is utilized as is for the melody data of the first (theme) phrase and melody data F12 through F16 is created for the phrases other than the first phrase based on the read-out musical piece data to thereby generate a melody data MD1 for a piece of music.

According to the music composing processing as described above with reference to FIG. 1, the user can designate a desired phrase and inputs a desired melody so that a melody for a piece of music can easily be generated including a melody fragment (i.e. fraction or section) of the inputted melody for the designated phrase. The generated length of melody for a piece of music will be one which matches or fits the inputted melody fraction, as the melody is generated based on the musical piece characteristics data which include melody characteristics identical with or similar to the inputted melody. If a melody is generated based on a musical piece data having a melody fraction which is identical with or similar to the inputted melody fraction, the generated melody as a whole will exhibit closer resemblance to the inputted melody. By storing in the data base the musical piece characteristics data and the musical piece data of musical pieces (such as existing completed music) with an abundant variety of musical ups and downs, a musically artistic melody having an abundant variety of musical ups and downs can be generated or composed for a piece of music.

Figure 2:
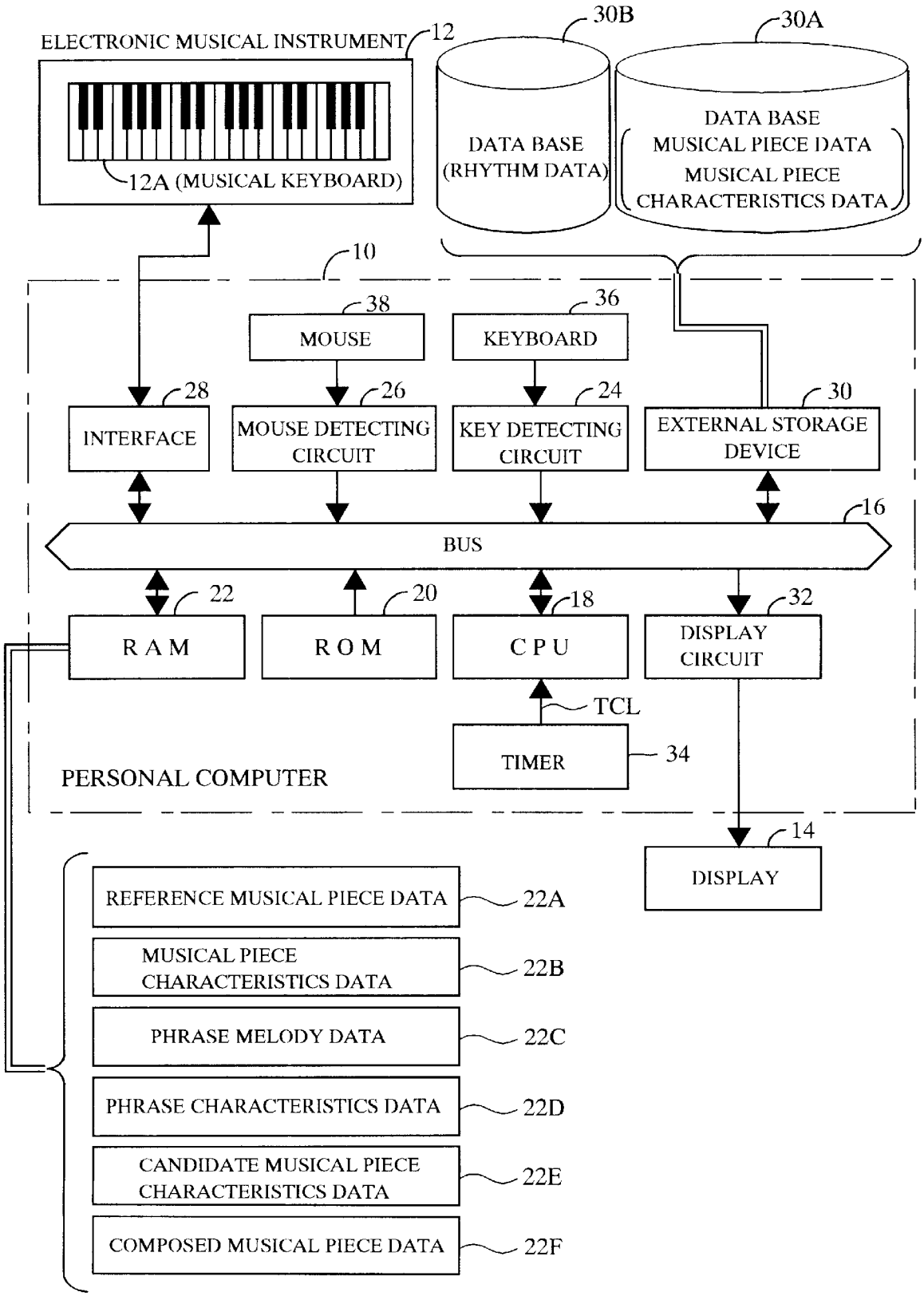
FIG. 2 is a block diagram showing an embodiment of an automatic music composing apparatus according to the present invention.

FIG. 2 shows ah automatic music composing apparatus according to the present invention. The automatic music composing apparatus of FIG. 2 is capable of generating a melody in accordance with the melody generating processing as explained above with reference to FIG. 1, and comprises a personal computer 10, an electronic musical instrument 12 and a display 14. Within the personal computer 10, to a bus 16 are connected a CPU (central processing unit) 18, ROM (read only memory) 20, RAM (random access memory) 22, a key detecting circuit 24, a mouse detecting circuit 26, an interface 28, an external storage device 30, a display circuit 32, a timer 34 and so forth.

The CPU 18 is to conduct various processings for generating melodies according to the program stored in the ROM 20, of which the details will be described hereinafter with reference to FIGS. 8–18. The RAM 22 includes various storage areas such as a reference musical piece data storing area 22A, a musical piece data storing area 22B, a phrase melody data storing area 22C, a phrase characteristics data storing area 22D, a candidate musical piece characteristics data storing area 22E and a composed musical piece data storing area 22F.

The key detecting circuit 24 is to detect the manipulation of the keys in the keyboard 36 for entering alphanumeric characters. Using the keyboard 36, the user can enter various instructions and make various selections, and conduct input operations for melody data. The mouse detecting circuit 26 is to detect the manipulation of the mouse 38 for instructing various operations and selections conducted by the apparatus. The mode selection of such as a registration mode, a melody generation mode, and all automatic performance mode may be controlled by means of the mouse 38 or the keyboard 36.

The interface 28 is of a type which meets the MIDI (Musical Instrument Digital Interface) standard, and is provided to transmit and receive the performance data and so forth between the electronic musical instrument 12 and the computer 10. The electronic musical instrument 12 comprises a musical keyboard 12A, tone generators (not shown), an automatic performance device (not shown) and so forth, and capable of generating tone signals from the tone generators in response to note pitch data derived by the key manipulation on the keyboard 12A and/or note pitch data outputted from the automatic performance device. Also using the musical keyboard 12A, melody data can be inputted to the personal computer 10 via the interface 28 based on the user's key manipulation.

The external storage device 30 detachably includes one or more types of storage media like an HD (hard disk), an FD (floppy disk), a CD (compact disk), DVD (digital versatile disk) and an MO (magneto-optical disk). Under the condition that the external storage device is equipped with a desired storage medium, data can be transferred from the storage medium to the RAM 22. And, where the equipped storage medium is of a writable type like an HD and an FD, data in the RAM 22 can be transferred to the storage medium. In the storage medium equipped in the external storage device 30 are stored musical piece data (melody data) of a number of musical pieces for reference musical pieces to constitute a data base 30A, and also stored are rhythm data of such reference musical pieces to constitute a data base 30B. The data base 30A may also contain prerecorded musical piece characteristics data for some plural numbers of musical pieces among a number of reference musical pieces. In the processing of registering musical piece characteristics as described hereinafter, the musical piece characteristics data are created with respect to several desired musical pieces among a number of reference musical pieces, and may be stored in the data base 30A. The musical piece data and the musical piece characteristics data will be described later with reference to FIGS. 3 and 4, and the rhythm data will be described later with reference to FIG. 5.

The display circuit 32 is to control various operations of the display 14 to realize various kinds of visual images on the display 14. The timer 34 generates a tempo clock signal TCL at a period (rate) corresponding to a tempo data supplied thereto. The tempo clock signal TCL is given to the CPU 18 in the form of an interruption request. The CPU 18 starts an interrupt process at each clock pulse of the tempo clock signal TCL. Such an interrupt processing can realize an automatic music performance based on the composed musical piece data in the storage area 22F.

Figure 3:
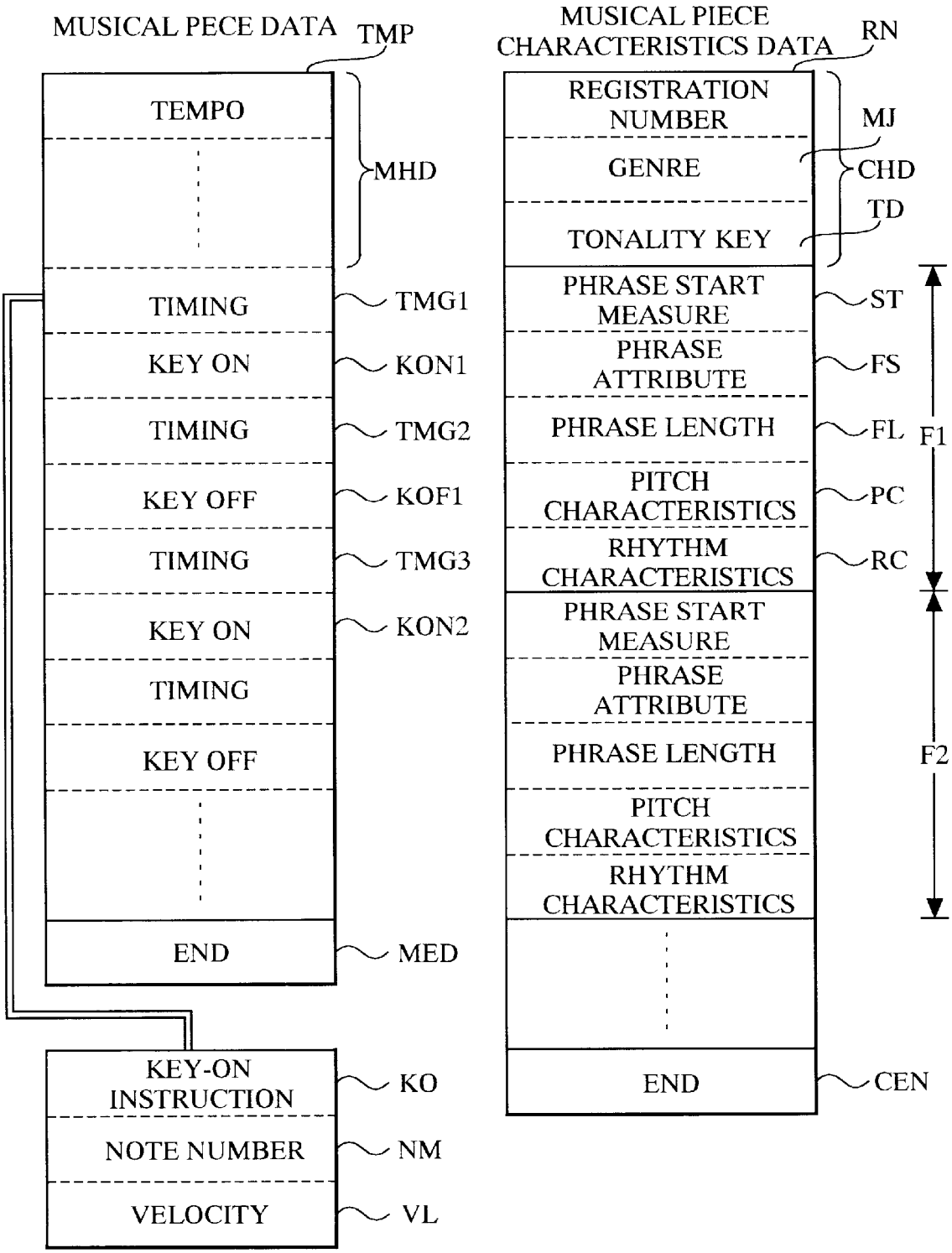
FIG. 3 shows data format charts illustrating data structures of a musical piece and of a musical piece characteristics set.

FIG. 3 shows data format charts illustrating data structures of a musical piece data set defining a note progression (i.e. a melody) of a musical piece and of a musical piece characteristics data set defining various characteristics of the musical piece as stored respectively in the storage areas 22A and 223. As shown in the left column of FIG. 3, the musical piece data is a data train comprising a head data group MHD including tempo data TMP, successively arranged pairs of timing data and key event (key-on or key-off) data thereby defining generation of notes to constitute a melody, and end data MED placed at the end of the data train. Shown as examples of the pairs of timing data and key event data are a pair of timing data TMG1 and key-on data KON1, a pair of timing data TMG2 and key-off data KOF1, a pair of timing data TMG3 and key-on data KON2, and so forth. Each of the timing data represents a relative time of a note event from the preceding note event in terms of clock counts of the tempo clock signal TCL, wherein the time length corresponding to the duration of a quarter note is expressed as 480 clock counts in this embodiment. As broken down at bottom of the left column in FIG. 3, each of the key-on data consists of key-on instruction data KO which instructs generation of a musical note, note number data NM which instructs the pitch of a note to be generated, and velocity data VL which instructs the tone volume (intensity) of a note to be generated. The term "velocity" is used here for simplicity's sake in relation to the volume of generated tones, as the volume of the tones produced on the piano is determined (controlled) by the velocity at which the key is depressed by the player. Although not shown as a breakdown, each key-off data consists of key-off instruction data and note number data.

As shown in the right column of FIG. 3, the musical piece characteristics data is a data train comprising a head data group CHD, successively arranged sets of phrase characteristics data for phrases F1, F2, . . . , and end data CEN placed at the end of the data train. The head data includes registration number data RN representing the registration number of each reference musical piece as given at the time of its registration, genre data MJ representing the genre (e.g. jazz) of the reference musical piece, and tonality key data TD representing the tonality key (e.g. C major) of the reference musical piece. Each of the phrase characteristics data includes, as exemplarily shown with respect to phrase F1, phrase start measure data ST representing the measure (e.g. first measure) at which the phrase starts, phrase attribute data FS representing the attributes of the phrase such as the phrase number (including further indication that it is a theme phrase or a release phrase, according to necessity) and the phrase symbol representing the similarity among the phrases, for example "phrase #1 (theme)" and "A", phrase length data FL representing the length of the phrase, for example, in terms of the number of phrases (e.g "2"), pitch characteristics data PC representing the characteristic feature in pitch, and rhythm characteristics data representing the characteristic feature in rhythm. Typical examples of the phrase symbol are A, A', B and C, wherein the identical symbols such as A and A, or B and B indicate that the phrases are identical (equal) in terms of melody, the similar symbols such as A and A' indicate that the phrases are similar in terms of melody, and the different symbols such as A and B, or A and C indicate that the phrases are neither identical nor similar. FIG. 4 illustrates data content chart showing an example of pitch characteristics data PC and of rhythm characteristics data RC for one phrase. It should be understood that the same format of data pair is provided for a plurality of phrases to cover a whole musical piece. The pitch characteristics data PC includes an initial and final note data pack P1 and a pitch variation data pack P2. The initial ad final note data pack P1 contains an initial note data P11 which defines the initial (starting) note in the phrase by its generation timing in clock counts (e.g. "0") and its pitch in degree value (e.g. IV) with reference to the root note of the tonality key, and a final note data P12 which defines the final (ending) note in the phrase by its,generation timing in clock counts (e.g. "3360") and its pitch in degree value (e.g. II) with respect to the root note of the key.

The pitch variation data pack P2 contains motion data P21, pitch difference data P22 and time interval data P23 with respect to each adjacent (contiguous in time) pair of notes in the phrase. The motion data P21 represents the pitch movement in note pitch by the term "downward", "horizontal" and "upward", wherein "downward" means that the pitch of the succeeding note is lower than that of the preceding note, "horizontal" means that the pitch of the succeeding note is the same as that of the preceding note, and "upward" means that the pitch of the succeeding note is higher than that of the preceding note. The pitch difference data P22 represents the cifference between the pitches of the adjacent two notes in degree counts in the musical scale, wherein "−1" means that the latter note is lower than the former note by one degree, "0" means that the former note and the latter note are of the same pitch, and "1" means that the latter note is lower than the former note by one degree. The time interval data P23 represents the time interval between the adjacent two notes in clock counts (e.g. "480" for a quarter note duration).

The rhythm characteristics data RC includes genre data R1, denseness data R2, syncopation data R3 and total-number-of-notes data R4. The genre data R1 represents the genre of the music from among, for example, march, waltz, jazz, etc. The denseness data R2 represents the relative condition of the note existence between the first half and the second half in the phrase by one of "similar denseness", "sparser:denser" and "denser:sparser", wherein "similar denseness" means that there are (almost) same number of notes in both the first and the second half of the phrase, "sparser:denser" means that there are more notes in the second half of the phrase than in the first half, and "denser:sparser" means that there are fewer notes in the second half of the phrase than in the first half. The syncopation data R3 represents whether there is any syncopation in the phrase. The-total-number-of-notes data R4 represents total number of notes existing in the phrase, i.e. the number of notes in the first half of the phrase plus the number of notes in the second half of the phrase.

Figure 5:
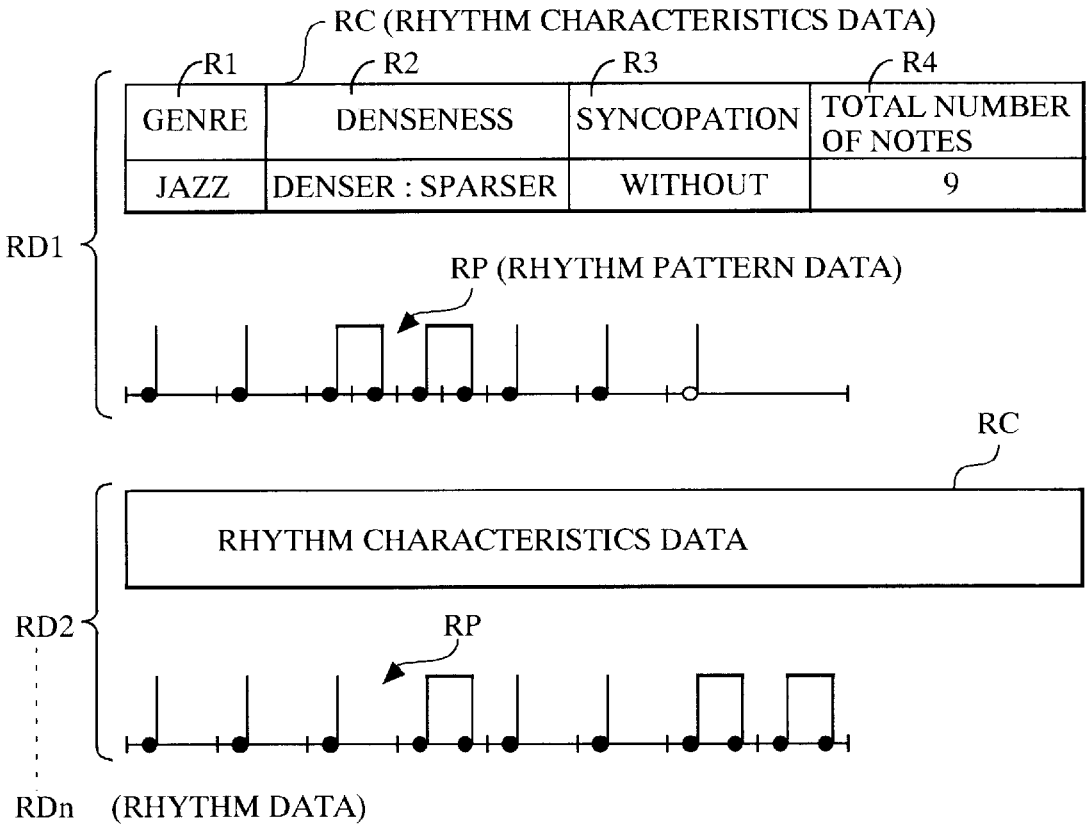
FIG. 5 shows data content charts explaining rhythm data.

FIG. 5 illustrates a number of rhythm data packs RD1, RD2, . . . , RDn stored in the data base 30B. Each rhythm data pack includes, as exemplarily shown at RD1, rhythm characteristics data RC and rhythm pattern data RP. The rhythm characteristics data RC includes, like that described above in reference to FIG. 4, genre data R1, denseness data R2, syncopation data R3 and total-number-of-note data R4. The rhythm pattern RP is the one that indicates the note generation timing and the note extinction timing of each note in the phrase. The rhythm characteristics data RC represents the characteristics of the rhythm defined by the rhythm pattern data RP and indicates, for example, "jazz" at R1, "denser:sparser" at R2, "without syncopation" at R3, and "nine" at R4 in the Figure. In order to read out from the data base 30B a desired rhythm pattern data, each rhythm characteristics data RC among the rhythm data RD1 through RDn is compared with the desired rhythm characteristics data (given by the user) to find equal rhythm data, and the rhythm pattern data paired with the so found equal rhythm data is read out.

Figure 6:
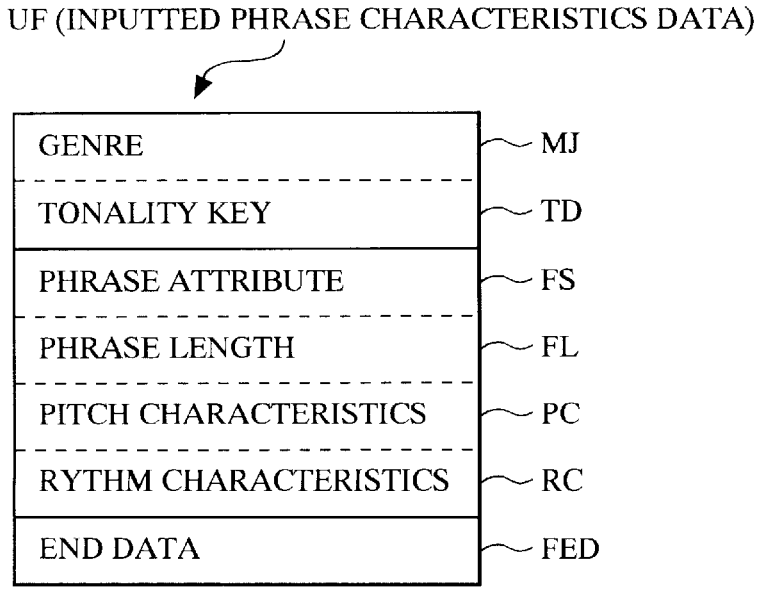
FIG. 6 shows a data format chart illustrating data structure of inputted phrase characteristics.

FIG. 6 is a chart showing a data format of the phrase characteristics data UF directly or indirectly inputted by the user. As an example, when the user inputs melody data, the apparatus analyzes the melody data and creates the phrase characteristics data UF based on the user-inputted melody data. The phrase characteristics data UF is stored in the storage area 22D. The phrase characteristics data UF includes genre data MJ, tonality key data TD, phrase attribute data FS, phrase length data FL, pitch characteristics data PC, rhythm characteristics data RC and end data FED. The respective data MJ, TD, FS, FL, PC and RC are respectively the same as those described with reference to FIG. 3 above, and the repetition of the explanation is omitted here. But, in this case of FIG. 6, the phrase attribute data FS contains only the phrase number and not the phrase symbol (like A, A', . . . ).

Figure 7:
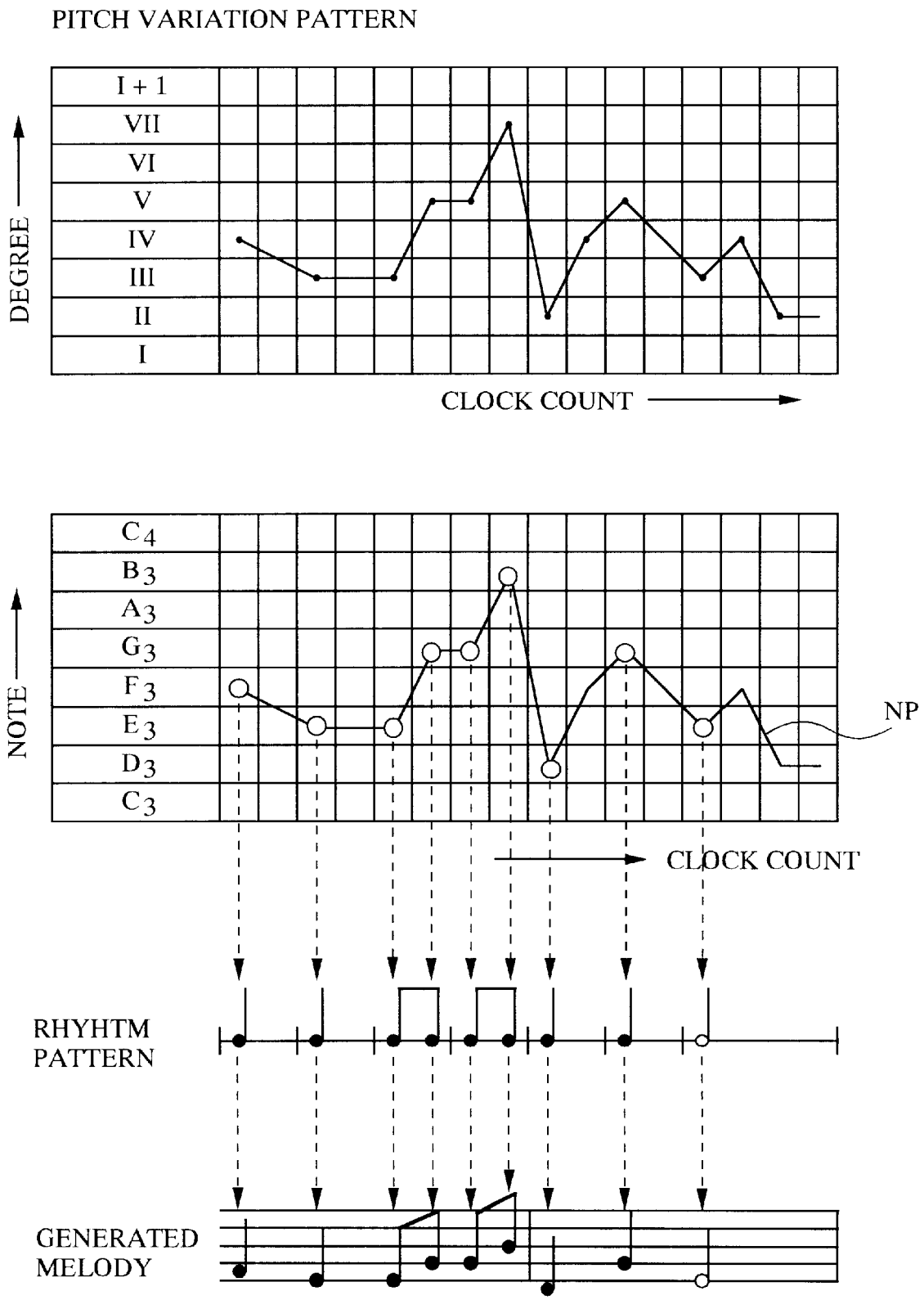
FIG. 7 shows charts illustrating the process of generating a melody piece for one phrase.

Now referring to FIG. 7. description will be made about the process of generating a melody piece (fragment) for one phrase. The top chart shows a graph of pitch variation pattern depicted according to the pitch characteristics data PC of FIG. 4 above. For composing a musical piece, the user designates a desired tonality key for the musical piece. In accordance with the key designation, a pitch characteristics data set in terms of note names is created using the notes in the musical scale of the designated key and the pitch characteristics data PC of FIG. 4. The pitch characteristics data in note names represent, note by note in each phrase, respective pitches to constitute a melody by means of note names of the scale tones in the designated key. When a key of C major is designated as an example, pitch characteristics data in note names are created using the scale tones of C major and the pitch characteristics data of FIG. 4. A note name variation pattern thus created in accordance with the pitch characteristics data in note names will be the one as shown by a line graph NP in the middle chart of FIG. 7.

On the other hand, let it be assumed that the rhythm pattern data RP in the rhythm data set RD1 of FIG. 5 is read out as a desired rhythm pattern for the composition. The rhythm pattern represented by the read out rhythm pattern data is shown in the penultimate chart in FIG. 7. Corresponding to each of the notes (beats) included in the phrase shown in this rhythm pattern chart, the note name data which corresponds to the beat in terms of generation timing is read out from among the pitch characteristics data in note names. The process is such that a note the generation timing of which corresponds to the timing of the rhythm note in the rhythm pattern is selected from among the note variation pattern of the middle chart of FIG. 7 for each of the rhythm note shown in this rhythm pattern chart in FIG. 7. And then, by determining the pitch of the respective notes in the rhythm pattern based on the read out note name data in the phrase shown in the Figure, a melody data as shown at the bottom of FIG. 7 is generated in the amount for one phrase The format for the generated melody data may be of the type shown in the left column of FIG. 3.

Figure 8:
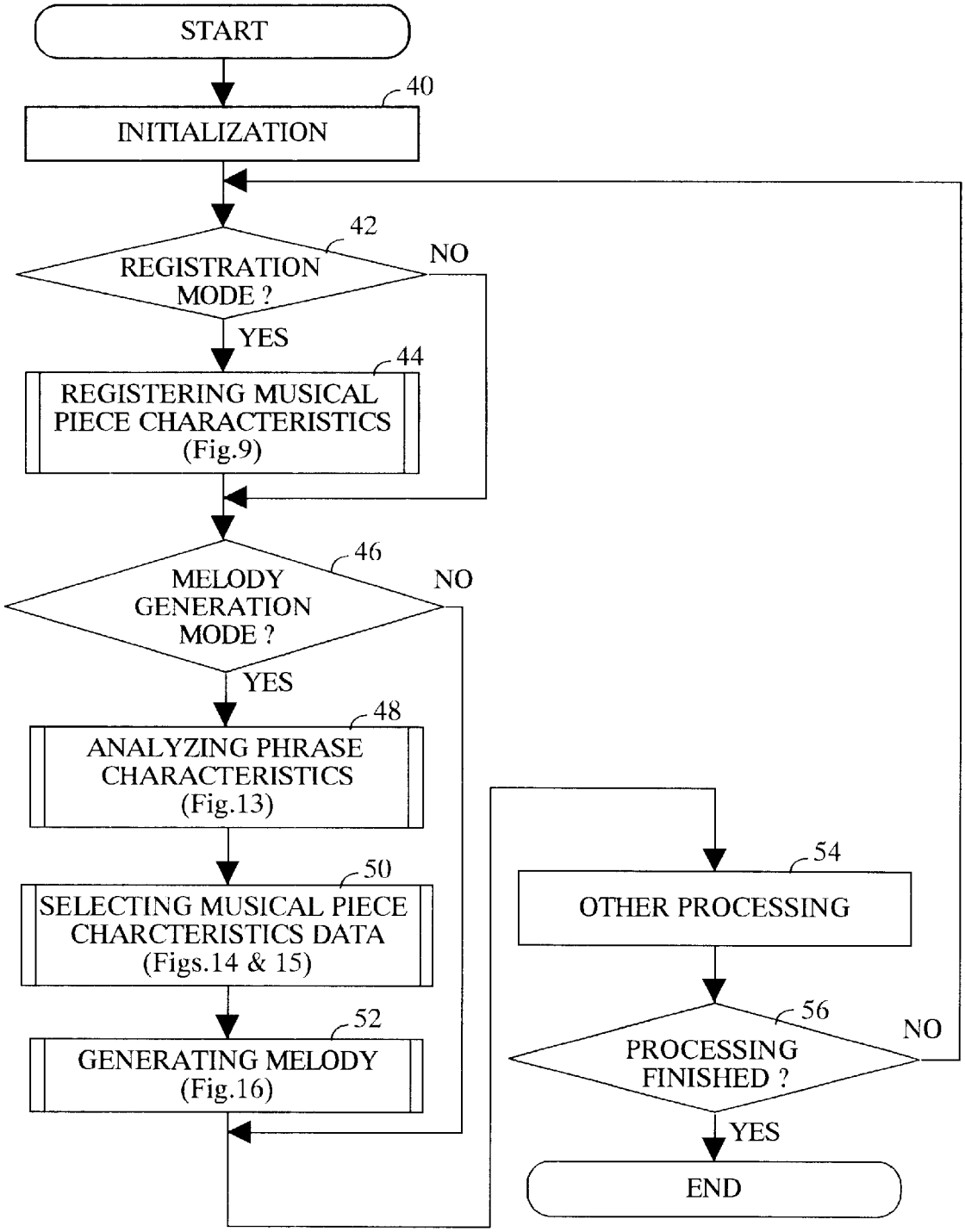
FIG. 8 is a flowchart showing the main routine of the music composing processing in the present invention.

FIG. 8 shows a process flow of the main routine of the present invention. Step 40 is to initialize the various registers, etc. included in the RAM 22 before moving forward to step 42. Step 42 judges whether it is a registration mode commanded. If the result of judgment is affirmative (yes), the process moves to step 44. Step 44 executes a subroutine for registering the musical piece characteristics. The processing in step 44 is to create musical piece characteristics data based on the desired musical piece data included in the data base 30A, and in turn to register the created musical piece characteristics data into the data base 30A, which will be described in detail hereinafter referring to FIG. 9. After the processing of step 44 is finished or when the judgment result at step 42 is negative (no), the process goes to step 46.

Step 46 judges whether it is a melody generation mode commanded. If the judgment answer is affirmative (yes), the process moves to step 48 to conduct a subroutine for analyzing the phrase characteristics. The process of step 48 is to analyze the melody data of an amount for a piece of music as inputted by the user to determine the characteristics of the phrase melody and to created the phrase characteristics data. The created data in turn are stored in the storage area 22D. Such processing will be described in detail later in reference to FIG. 13. After step 48, the process moves to step 50.

Step 50 conducts a subroutine for selecting musical piece characteristics data. The processing in step 50 is to select the musical piece characteristics data to be referenced at the time of musical piece generation (composition) from among the data base 30A based on the phrase characteristics data in the storage area 22D, and to store into the storage area 22E, which will be described in detail later with reference to FIGS. 14 and 15. After step 50, the process moves forward to step 52.

Step 52 conducts a subroutine for generating a melody as a musical composition from the apparatus. The processing of step 52 is to utilize the phrase melody data in the storage area 22C as it is and to create phrase melody data for other phrases based on the desirable musical piece characteristics data in the storage area 22E, thereby generating, in combination of the two, a melody data of an amount for a musical piece as an composed piece of music. The generated melody data are stored in the storage area 22F, which will be described in detail later with reference to FIG. 16. After the processing of step 52 is over or when the judgment result at step 46 is negative (no), the process goes forward to step 54 to conduct other processing. The other processing includes a process of detecting the automatic performance mode, a process of start/stop control of the automatic performance, a process of editing the musical piece data, and so forth. Step 56 judges whether the whole processing has been finished. If the judgment answer is negative (no), the process goes back to step 42 to repeat the process flow as mentioned above. And when the judgment answer at step 56 becomes affirmative (yes), the whole processing of the main routine comes to its end.

FIG. 9 shows the subroutine for registering musical piece characteristics as conducted at step 44 of FIG. 8. Step 60 judges whether there are musical piece data to be processed in the data base 30A. If the judgment result is affirmative (yes), the process moves to step 62. Step 62 is to designate desired musical piece data in accordance with the user's manipulation on the keyboard 36, the mouse 38, etc., and then reads out the designated musical piece from the data base 30A, stores the same into the storage area 22A with the format shown in FIG. 3, and displays the same in the form of musical notation on the display 14.

Step 64 designates the registration number, genre and key with respect to the musical piece data stored in the storage area 22A in accordance with the user's manipulation on the keyboard 36, the mouse 38, etc., and then stores the registration number data RN, the genere data MJ and the tonality key data TD respectively representing the designated registration number, genre and key with the format shown in FIG. 3. At step 66, the user designates partitions between the measures, partitions between the phrases and phrase attributes for the musical piece displayed on the display 14 using the keyboard 36, the mouse 38, etc. Then, step 66 determines the phrase start measure and the phrase length for each phrase in accordance with the designation of measure partitions and phrase partitions, and stores the phrase start measure data ST representing the determined phrase start measure, the phrase length data FL representing the determined phrase length and the phrase attribute data FS representing the designated phrase attribute for each measure into the storage area 22B, phrase by phrase, with the format shown in FIG. 3. The phrase symbol included in the phrase attribute is designated by the user taking the similarity among the phrases as partitioned into consideration.

Step 68 is to execute a subroutine for analyzing the pitch characteristics. The process of step 68 is to analyze the musical piece data stored in the storage area 22A about the melody characteristics for each phrase to obtain the pitch characteristics data like the one shown in FIG. 4, and to store the obtained pitch characteristics data into the storage area 22B, which will be described in detail with reference to FIGS. 10 and 11 hereinafter.

Step 70 is to execute a subroutine for analyzing the rhythm characteristics. The process of step 70 is to analyze the musical piece data stored in the storage area 22A about the rhythm characteristics for each phrase to obtain the rhythm characteristics data like the one shown in FIG. 4, and to store the obtained rhythm characteristics data into the storage area 22B, which will be described in detail with reference to FIG. 12 hereinafter.

Step 72 stores the end data CEN into the storage area 22B as shown in FIG. 3. Step 74 then transfers the musical piece characteristics data in the amount of one piece of music from the storage area 22B to the data base 30A for registering the same there. Then the process flow comes back to step 60 again to judge whether there are still further musical pieces data to be processed. If the Judgment answer is affirmative (yes), the processing from step 62 onward is executed with respect to the next musical piece data. In this manner, musical piece characteristics data of an amount for a plurality of musical pieces are registered in the storage area 30A. When the registration of the musical piece characteristics data for the last musical piece data is over, step 60 judges negative (no) to return the process flow to the main routine of FIG. 8.

Figure 10:
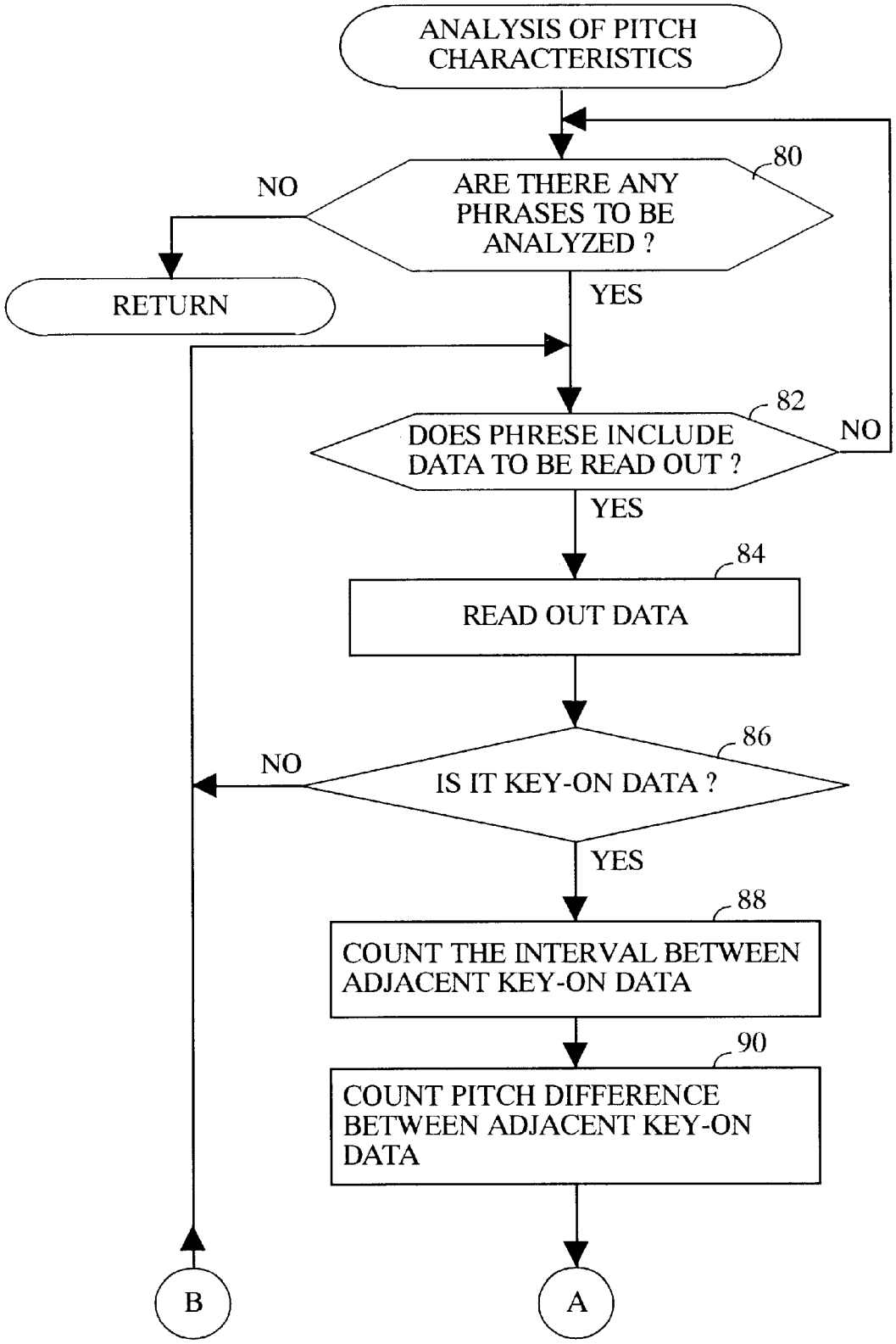
FIGS. 10 and 11 in combination depict a flowchart showing the subroutine of analyzing pitch characteristics.
Figure 11:
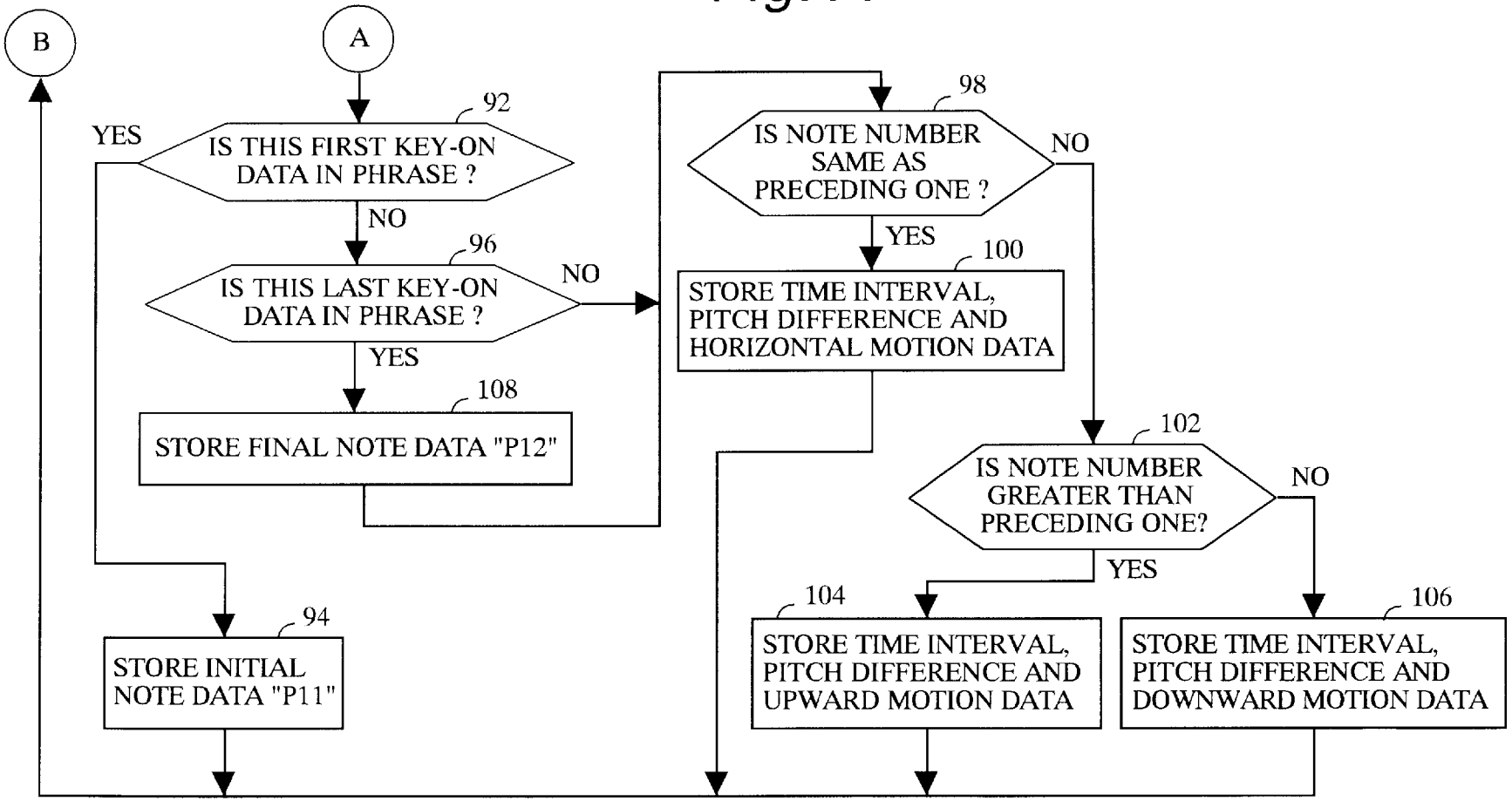

FIGS. 10 and 11 in combination show the subroutine for analyzing pitch characteristics as conducted at step 68 of FIG. 9. Step 80 judges whether there are any phrases to be analyzed in the storage area 22A. When a desired musical piece data is stored in the storage area 22A as described above, there certainly are phrases to be analyzed there, and therefore the judgment result at step 80 is affirmative (yes) and the process moves forward to step 82.

Step 82 judges whether the phrase includes data to be read out. In the first place, the judgment is made as to whether there is any data to read out with respect to the first phrase. The answer of this judgment is usually affirmative (yes), and the process moves forward to step 84. Step 84 reads out the data in the phrase from the storage area 22A. Step 86 then judges whether the read out date is a key-on data. In the case of the musical piece data shown in FIG. 3, the first data in the first phrase is a timing data TMG1, and consequently the judgment result is negative (no) so that the process goes back to step 82. In the case where the step 84 reads out the key-on data KON1, the judgment result at step 86 is affirmative (yes), and the process moves forward to step 88.

Step 88 counts the time interval between the presently read out key-on data and the preceding read out key-on data based on the timing data between the two key-on data. Next, step 90 counts the pitch difference between the presently read out key on data and the preceding read out key-on data based on the note numbers included in the two key-on data. However, when step 84 reads out the first key-on data KON1, there is no preceding read out key-on data, and therefore steps 88 and 90 simply stores the presently read out key-on data KON1.

Next step 92 (in FIG. 11) judges whether the presently read out key-on data is the first key-on data in the phrase When the first key-on data KON1 is read out as described above, the judgment at step 92 is affirmative (yes) and the process proceeds to step 94. Step 94 stores an initial note data P11 which represents the pitch and the generation timing of the initial note as shown in FIG. 4 into the storage area 22B before going back to step 82. After the timing data TMG2, the key-off data KOF1 and the timing data TMG3 are read out by the processing from step 82 through step 86 conducted three times, and when the key-on data KON2 is read out, the judgment result at step 86 becomes affirmative (yes) and the process moves forward to step 88. And now, step 88 determines the time interval between the key-on data KON1 and the key-on data KON2 as described above. And step 90 determines the pitch difference between the key-on data KON1 and the key-on data KON2 as described above.

As the read out key-on data KON2 is not the first key-on data in the phrase now, the judgment at step 92 says "negative (no)" and the process goes to step 96. Step 96 judges whether the presently read out key-on data is the last key-on data in the phrase. As the key-on data KON2 is not the last key-on data in the phrase, the judgment result at step 96 is negative (no) and the process moves to step 98. Step 98 judges whether the note number included in the presently read out key-on data is the same as the note number included in the preceding read out key-on data. Therefore, when the key-on data KON2 is read out, the judgment is made whether the note numbers are the same between the key-on data KON1 and KON2. If the judgment answer is affirmative (yes), the process proceeds to step 100.

Step 100 stores into the storage area 22B the time interval obtained at step 88, the pitch difference obtained at step 90 and a horizontal motion data meaning a horizontal movement of the melody as the time interval data P23, the pitch difference data P22 and the motion data P21 shown in FIG. 4. When the judgment result at step 98 is negative (no), the process moves to step 102 to judge whether the note number in the presently read out key-on data is greater than the note number in the preceding read out key-on data. If the judgment result is affirmative (yes), step 104 takes place to store in the storage area 22B the time interval obtained at step 88, the pitch difference obtained at step 90 and an upward motion data meaning an upward movement of the melody as the time interval data P23, the pitch difference data P22 and the motion data P21 shown in FIG. 4. If the Judgment result is negative (no), step 106 takes place to store in the storage area 22B the time interval obtained at step 88, the pitch difference obtained at step 90 and a downward motion data meaning a downward movement of the melody as the time interval data P23, the pitch difference data P22 and the motion data P21 shown in FIG. 4.

When step 100, 104 or 106 is over, the process goes back to step 82 to repeat the steps from step 82 onward as described above. As a result, the pitch data P2 as shown in FIG. 4 is stored in the storage area 22B including motion data P21, pitch difference data P22 and time interval data P23 for the respective notes one note after another. And when step 84 reads out the last key-on data in the phrase, step 96 judges affirmative (yes) and the process moves to step 108.

Step 108 stores into the storage area 22B the final note data P12 representing the pitch and the generation timing of the final note as shown in FIG. 4. And then one of the steps 100, 104 and 106 takes place according to the judgment results at steps 98 and/or 102 to store in the storage area 22B the pitch variation data containing the motion data P21, the pitch difference data P22 and the time interval data P23 with respect to the last key-on data. As a consequence, in the storage area 22B is stored the pitch characteristics data PC as shown in FIG. 4 with regard to the phrase F1 indicated in FIG. 3. When the process of step 100, 104 or 106 is over, the process moved back to step 82 to judge whether there is any data to be read out in the phrase. As there is no further data to read out after the last key-on data, the judgment result at step 82 becomes negative (no) and the process goes back to step 80.

Step 80 judges whether there are any phrase to be analyzed. As the present stage is that the process for the phrase F1 is over, the phrase F2 is now subjected to analysis. Then the judgment result at step 80 is affirmative (yes), the processing from step 82 onward will be conducted with respect to the phrase F2. As a result, the pitch characteristics data PC as shown in FIG. 4 is stored in the storage area 22B with respect to the phrase F42 indicated at FIG. 3. Similarly, the pitch characteristics data for other phrases are stored in the storage area 22B, When the processing with respect to the last phrase is over, the judgment result at step 80 becomes negative (no), and the processing returns to the routine of FIG. 9.

FIG. 12 shows the subroutine for analyzing the rhythm characteristics as conducted at step 70 of FIG. 9. Step 110 judges whether there are any phrases to be analyzed in the storage area 22A. When desired musical piece data is stored in the storage area 22A as mentioned above, there is data to be analyzed, and therefore the judgment result at step 110 is affirmative (yes) and the process moves to step 112. Step 112 reads out the phrase length data FL of the phrase F1 from the storage area 22B. And next, step 114 determines timing TM indicating the one-half point of the phrase length represented by the read out phrase length data FL. Step 116 then counts the total number of notes N1 in the first half of the phrase and the total number of notes N2 in the second half of the phrase. N1 can be obtained by counting how many number of key-on data included in the data belonging to the phrase F1 of the musical piece data stored in the storage area 22A exist before the timing TM as obtained at step 114, while N2 can be obtained by counting how many number of key-on data included in the data belonging to the phrase F1 of the musical piece data stored in the storage area 22A exist after the timing TM as obtained at step 114.

Step 118 judges whether N1−N2 with respect to N1 and N2 obtained at step 116. If the judgment result is affirmative (yes), the process moves to step 120 to store "similar (same) denseness" data into the storage area 22B as the denseness data R2 as mentioned in FIG. 4. When the judgment result is negative (no), the process moves to step 122 to judge whether N1>N2. If the judgment answer is affirmative (yes), the process moves to step 124 to store "denser-sparser" data (meaning the first half phrase exhibits a denser distribution of notes while the second half phrase exhibits a sparser distribution of notes) into the storage area 22B as the denseness data R2 of FIG. 4. If the judgment answer is negative (no), the process moves to step 126 to store "sparser:denser" data (meaning the first half phrase exhibits a sparser distribution of notes while the second half phrase exhibits a denser distribution of notes) into the storage area 22B3 as the denseness data R2 of FIG. 4.

When the process of any of the steps 120, 124 and 126 is over, the process proceeds to step 128. Step 128 searches for the existence of syncopation through the data belonging to the phrase F1 in the musical piece data stored in the storage area 22A, and stores into the storage area 22B the syncopation data R3 of FIG. 4 indicating whether the phrase is with any syncopation or without syncopation. The process then moves to step 130. Step 130 stores the value of N1+N2=N into the storage area 22B as the total-number-of-notes data R4 of FIG. 4, and also the genre data MJ read out from the head data group CHD in the storage area 22B as the genre data R1 of FIG. 4. So far, the processing for the phrase F1 is over, and the process goes back to step 110. And then, the processing for the respective phrases F2 onward is conducted similarly to above. As a result, the rhythm characteristics data RC as shown in FIG. 4 is stored in the storage area 22B for the respective phrases of FIG. 3, phrase by phrase. When the processing with respect to the last phrase is over, the judgment at step 110 says negative (no), and the processing returns to the routine of FIG. 9.

Figure 13:
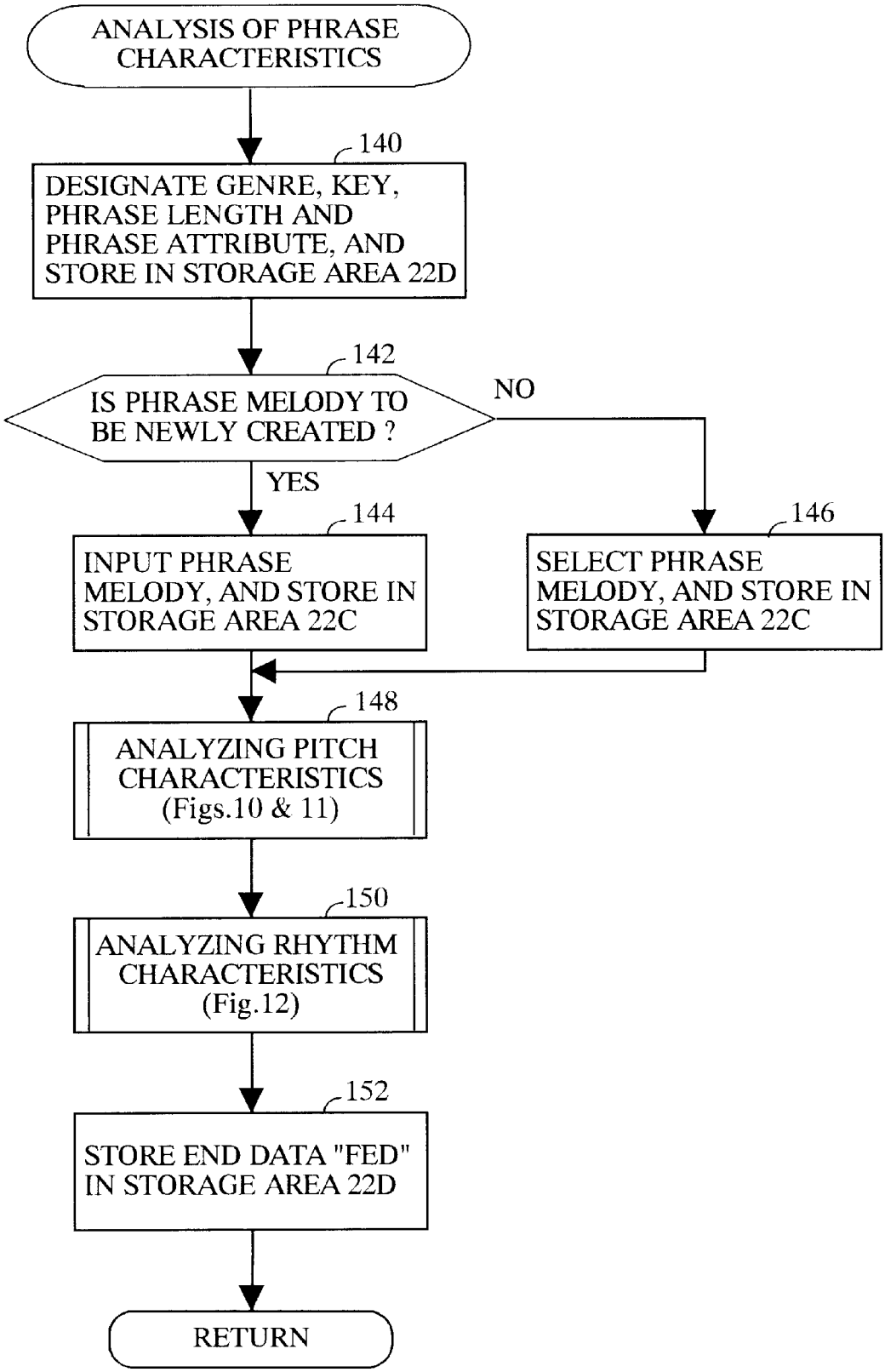
FIG. 13 is a flowchart showing the subroutine of analyzing phrase characteristics.

FIG. 13 shows the subroutine for analyzing phrase characteristics as conducted at step 48 of FIG. 8. At step 140, the user designates the genre, key, phrase length and phrase attributes (except phrase symbol) for a musical piece to compose using the keyboard 36, the mouse 38, etc. The genre data MJ, the tonality key data TD, the phrase length data FL and the phrase attribute data FS respectively representing the genre, key, phrase length and phrase attributes as designated by the user are stored in the storage area 22D with the format shown in FIG. 6. Next, phrase 142 judges whether a phrase melody is to be newly created. The user is allowed to select the inputting manner of a phrase melody (whether a phrase melody is to be newly created for an input or to be selected out from the data base 30A for an input) using the keyboard 36, the mouse 38, etc. by watching on the display 14. If the judgment result at step 142 is affirmative (yes), the process goes to step 144. At step 144, the user inputs melody data in an amount for one phrase by manipulating the keys in the musical keyboard 12A of the electronic musical instrument 12 or manipulating the numeric or character keys in the keyboard 36. The melody data inputted at this stage is the one that meets the phrase attributes (e.g. for the first (theme) phrase) as designated at step 140.

When the judgment result at step 142 is negative (no), step 146 displays the musical piece data from the data base 30A for one musical piece after another on the screen of the display 14. The user selects the melody data of the phrase having desired phrase attributes from among the displayed musical piece data using the keyboard 36, the mouse 38, etc. According to this selecting manipulation, the selected melody data of an amount for one phrase is stored in the storage area 22C.

When the process of either step 144 or 146 is over, step 148 conducts the subroutine for analyzing the pitch characteristics. Namely, the subroutine shown in FIGS. 10 and 11 is executed with respect to the phrase melody data stored in the storage area 22C in the manner described above to create the pitch characteristics data PC in an amount of one phrase, which in turn is stored in the storage area 22D with the format as shown in FIG. 6. Then the process moves to step 150.

Step 150 executes the subroutine for analyzing the rhythm characteristics. Namely, the subroutine shown in FIG. 12 is executed with respect to the phrase melody data stored in the storage area 22C in the manner described above to create the rhythm characteristics data RC in an amount of one phrase, which in turn is stored in the storage area 22D with the format as shown in FIG. 6. Then the process moves to step 152. Step 152 stores end data FED into the storage area 22D with the format as shown in FIG. 6 before returning to the main routine of FIG. 8.

Figure 14:
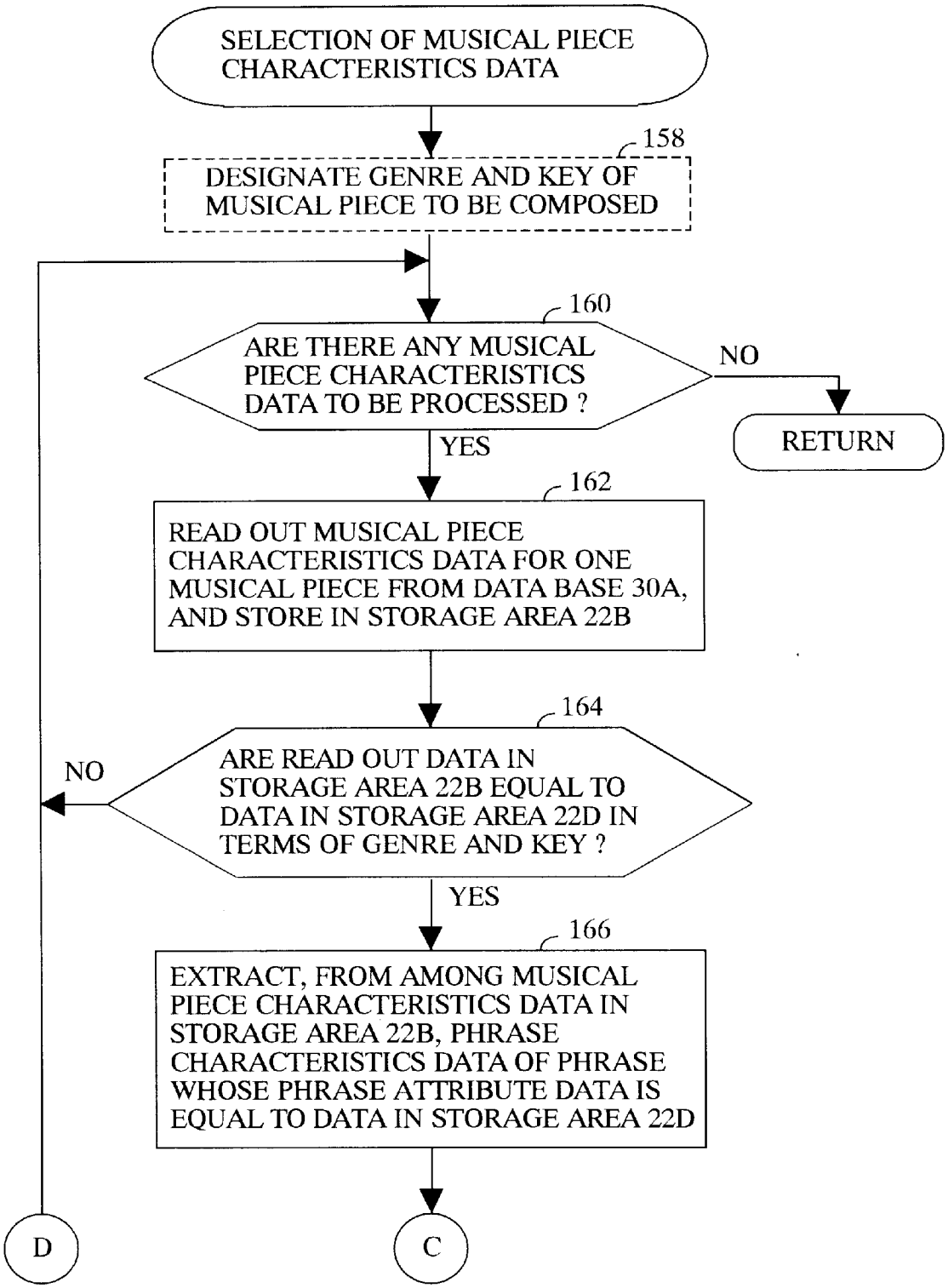
FIGS. 14 and 15 in combination depict a flowchart showing the subroutine of selecting musical piece characteristics data.
Figure 15:
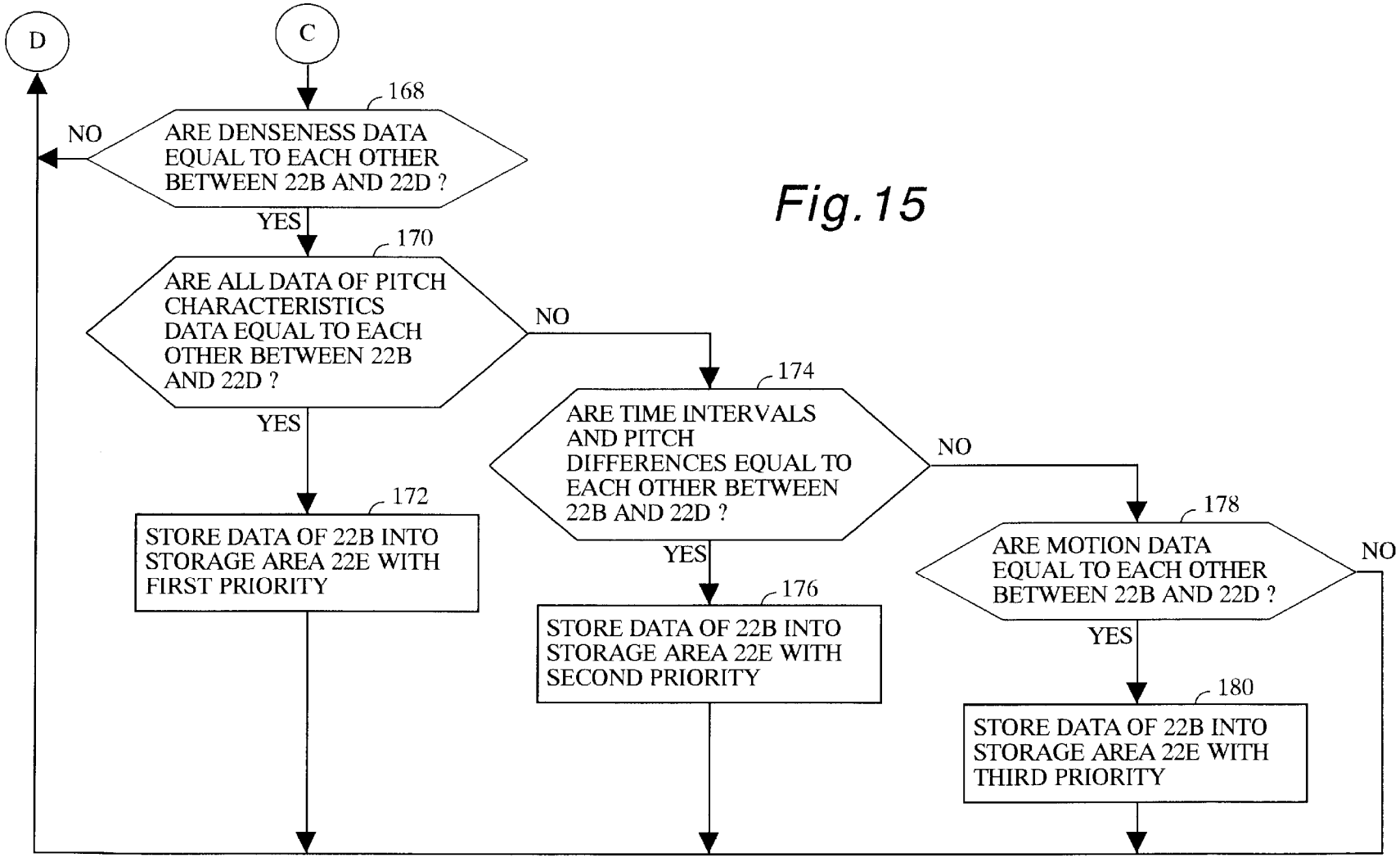

FIGS. 14 and 15 in combination show the subroutine for selecting musical piece characteristics data as performed at step 50 of FIG. 8. Step 160 judges whether there are any musical piece characteristics data to by processed in the data base 30A. In the case where musical piece characteristics data of a number of musical pieces are stored in the data base 30A beforehand, or in the case where musical characteristics data of a plurality of musical pieces are registered in the data base 30A as described above, the judgment at step 160 comes out affirmative (yes) and the process proceeds to step 162. Step 162 reads out musical characteristics data for one piece of music from the data base 30A and stores the same into the storage area 22B. And then, step 164 judges whether the read out musical piece characteristics data are equal to the phrase characteristics data in the storage area 22D in terms of genre and tonality key. For this purpose, the genre data MJ and the tonality key data TD in the musical piece characteristics data shown in FIG. 3 are compared with the genre data MJ and the tonality key data TD in the phrase characteristics data shown in FIG. 6, respectively, to judge whether they are correspondingly equal to each other or not.

However, in the case where genre data MJ and tonality key data TD are not included in the phrase characteristics data of FIG. 6, an additional step 158 may be inserted before step 160 to designate the genre and the tonality key of a musical piece to be composed by the manipulation of the keyboard 36, the mouse 38, etc., step 164 may judge whether the designated genre and key are equal to the genre and the key indicated by the genre data MJ and the tonality key data TD in the musical piece characteristics data, respectively.

When the judgment at step 164 comes out negative (no), the process goes back to step 160 And step 162 reads out the next musical piece characteristics data, and step 164 makes a judgment on genre and key as above.

When the judgment at step 164 comes out affirmative (yes), it means that there are stored in the storage area 22B the musical piece characteristics data which are equal to the phrase characteristics data in the storage area 22D in terms of genre and key, and the process proceeds to step 166. Step 166 extracts, from among the musical piece characteristics data in the storage area 22B, the phrase characteristics data of which the phrase attribute data is equal to that of the phrase characteristics data in the storage area 22D. For example, in the case where the phrase attribute (phrase number) indicated by the phrase characteristics data in the storage area 22D is the first (theme) phrase and the phrase attribute (phrase number) of the phrase F1 of FIG. 3 is the first (theme) phrase, the phrase characteristics data of the phrase F1 is extracted before going to step 168 (in FIG. 15).

Step 168 judges whether the denseness data in the extracted phrase characteristics data and the denseness data (R2 in FIG. 4) in the phrase characteristics data in the storage area 22D are identical or not. If the judgment rules negative (no), the process goes back to step 160 to repeat the steps thereafter as described above. If the judgment answer is affirmative (yes), the process proceeds to step 170. Step 170 judges whether all data in the pitch characteristics data (PC in FIG. 4) in the extracted phrase characteristics data are correspondingly equal to all data in the pitch characteristics data in the phrase characteristics data in the storage area 22D. If the judgment result is affirmative (yes), step 172 stores the musical piece characteristics data in the storage area 22B into the storage area 22E as the data having the first priority.

If the judgment at step 170 comes out negative (no), the processing proceeds to step 174. Step 174 judges whether both of the time interval data (P23 of FIG. 4) and the pitch difference data (P22 of FIG. 4) of the extracted phrase characteristics data are respectively equal to the time interval data and the pitch difference data of the phrase characteristics data in the storage area 22D. If the judgment result is affirmative (yes), step 176 stores the musical piece characteristics data in the storage area 22B into the storage area 22E as the data having the second priority.

If the judgment at step 174 rules negative (no), the processing proceeds to step 178. Step 178 judges whether the motion data (P21 of FIG. 4) in the extracted phrase characteristics data and the motion data in the phrase characteristics data in the storage area 22D are identical or not. If the judgment is affirmative (yes), step 180 stores the musical piece characteristics data in the storage area 22B into the storage area 22E as the data having the third priority.

In the case where the judgment at step 178 comes out negative (no) or in the case where any of the processes at steps 172, 176 and 180 is over, the processing goes back to step 160 to repeat the steps thereafter as described above. As a result, a plurality of sets of musical piece characteristics data having the melody characteristics which are identical or similar to the melody characteristics data (the phrase characteristics data in the storage area 22D) as inputted by the user are stored in the storage area 22E with the priorities attached. When the processing for the last musical piece characteristics data is over, step 160 rules negative (no) and the processing returns to the main routine of FIG. 8.

Figure 16:
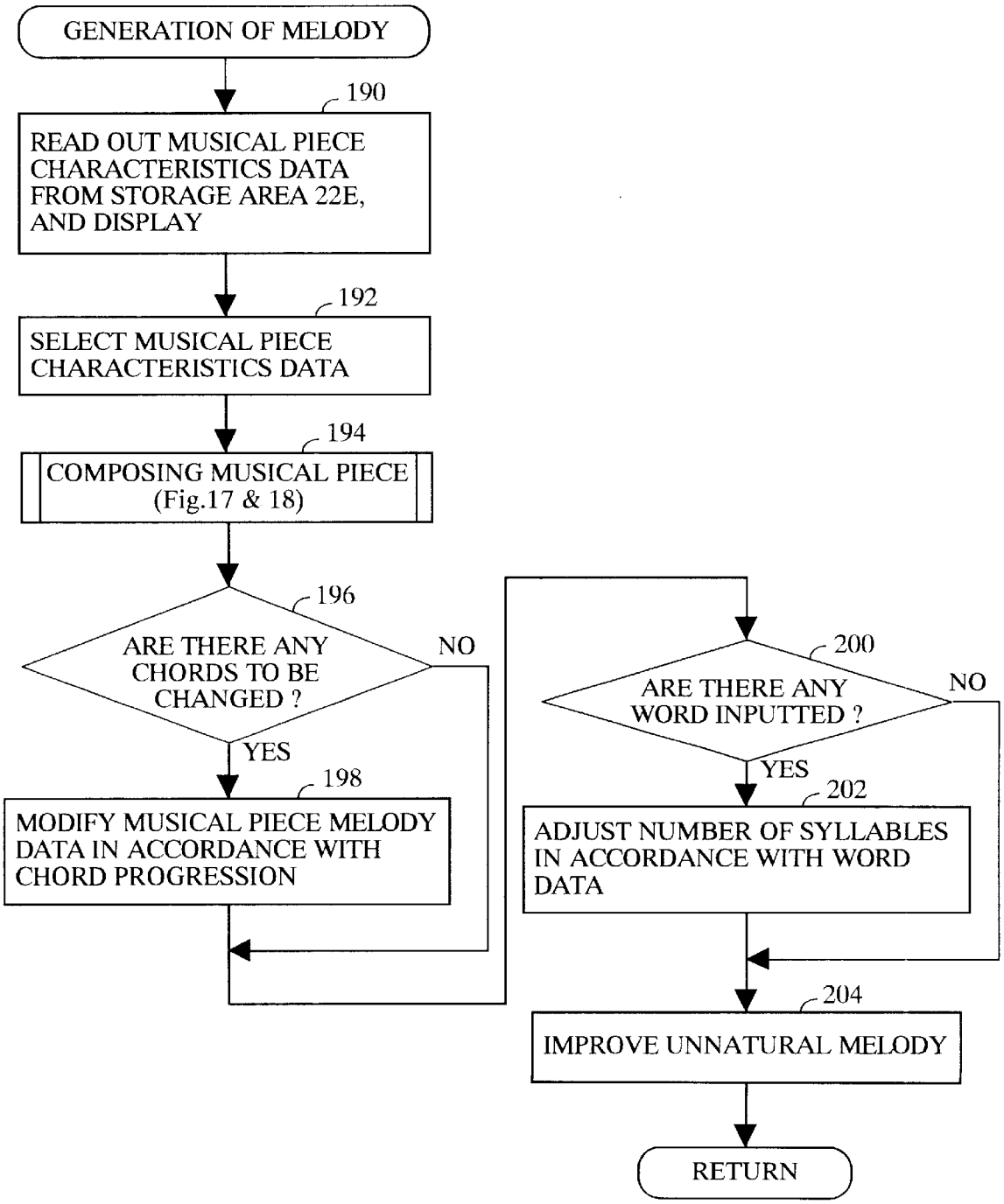
FIG. 16 is a flowchart showing the subroutine of generating a melody constituting a musical piece.

FIG. 16 shows the subroutine for generating a melody as executed at step 52 of FIG. 8. Step 190 reads out a plurality of sets of musical characteristics data from the storage area 22E according to the order of priority attached, and displays on the screen of the display 14.

Step 192 is to select a desired musical piece characteristics data from among the plurality of sets of musical piece characteristics data displayed on the screen using the keyboard 36, mouse 38, etc. before moving to step 194.

Step 194 executes the subroutine for composing a musical piece. The processing conducted at step 194 is to generate melody data of an amount for a piece of music based on the musical piece characteristics data selected at step 192 and the user-inputted phrase melody data stored in the storage area 22C and to store the generated melody data into the storage area 22F, which will be described in detail with reference to FIGS. 17 and 18 hereinafter. After step 194 comes step 196.

Step 196 judges whether there are any chords (harmony) to be changed. If the judgment answer is affirmative (yes), the processing moves to step 198 to modify the musical piece melody data in the storage area 22F in accordance with the instructed chord progression. Although not shown here in detail, a chord imparting processing is executed on the other hand, and a chord progression (sequence of chords) which is adequate to the melody of the musical piece is given to the musical piece melody data in the storage area 22F automatically. The process at steps 196 and 198 is to make a partial modification possible on the thus imparted chord progression according to the user's desire.

Where the judgment at step 196 rules negative (no) or the process of step 198 is over, the processing proceeds to step 200. Step 200 judges whether there are any words (lyrics) inputted on not If this judgment results affirmative (yes), the processing moves to step 202. Step 202 conducts adjustment of the number of syllables of the musical piece melody data in the storage area 22F according to the inputted word data.

Where the judgment at step 200 rules negative (no) or where the process of step 202 is over, the processing moves to step 204. Step 204 corrects the unnatural portions of the musical piece melody data in the storage area 22F. And then, the processing returns to the main routine of FIG. 8.

Figure 17:
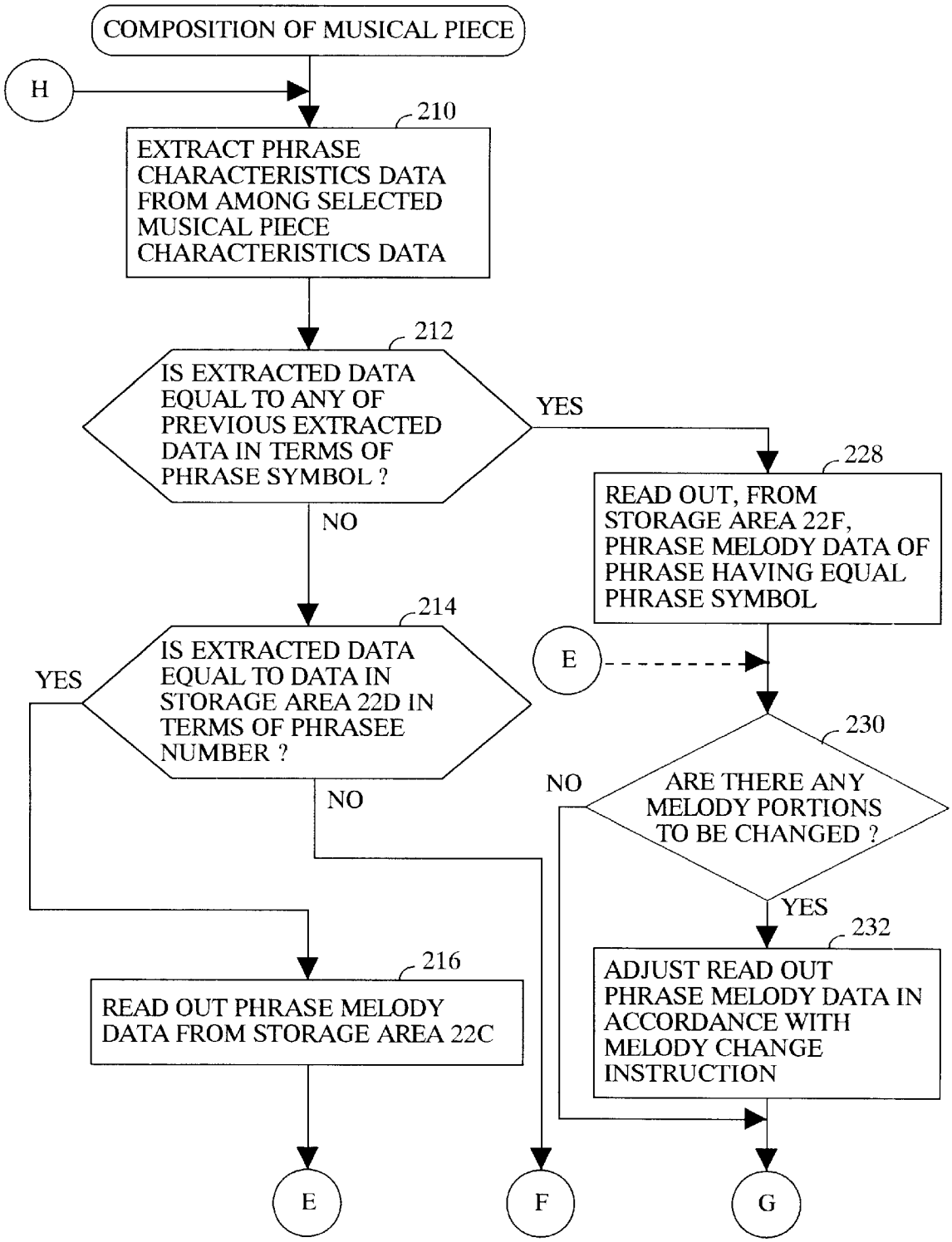
FIGS. 17 and 18 in combination depict a flowchart showing the subroutine of composing a musical piece.
Figure 18:
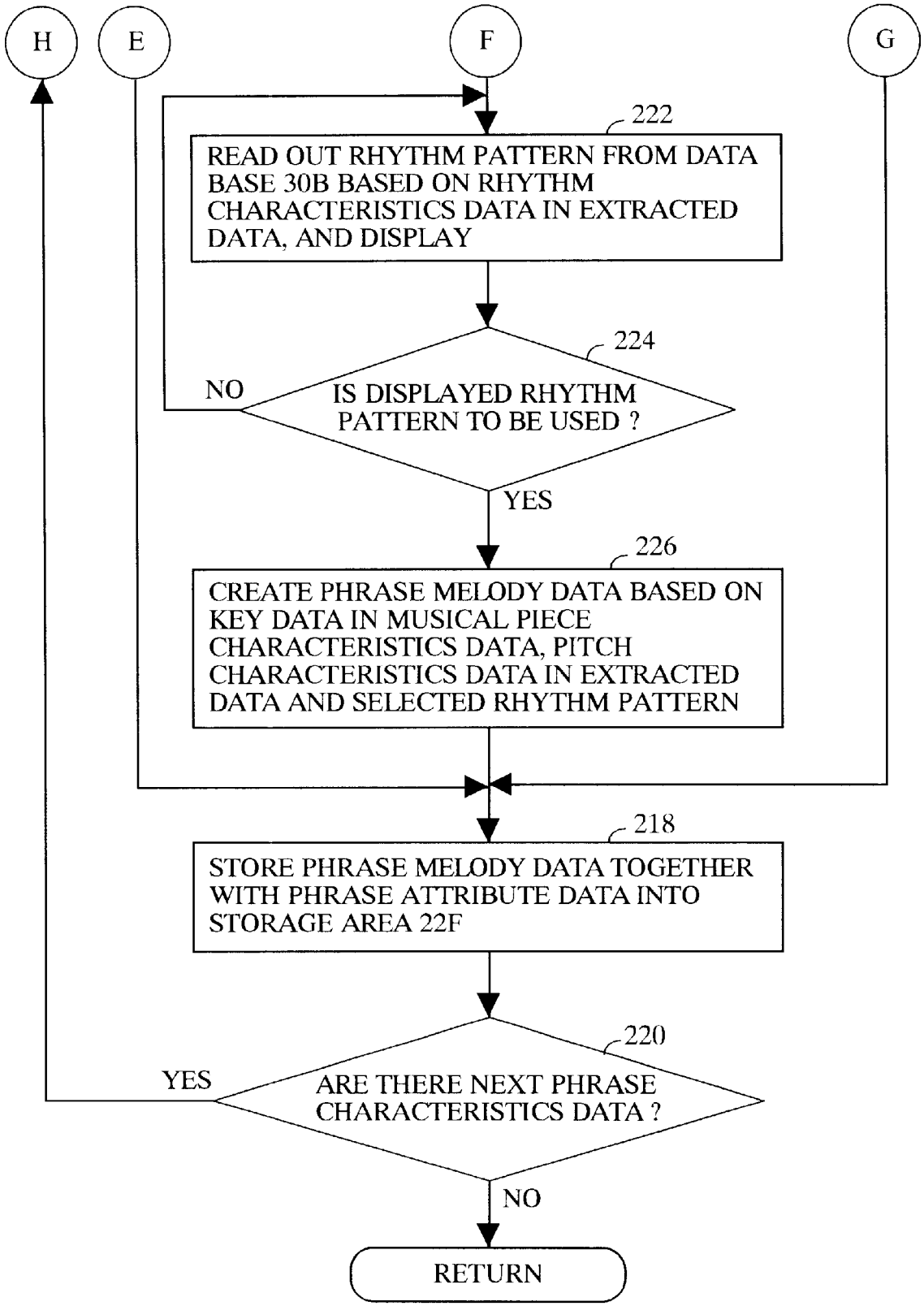

FIGS. 17 and 18 in combination show the subroutine for composing a musical piece as executed at step 194 of FIG. 16. Step 210 extracts the first phrase characteristics data from among the musical piece characteristics data selected at step 192 before moving to step 212.

Step 212 judges whether the extracted phrase characteristics data is equal to any of the previous extracted data up until then with respect to the phrase symbol in the phrase attribute. As to the first phrase characteristics data, there is no previous extracted data, and thus the judgment result at step 212 is negative (no) and the processing moves to step 214.

Step 214 judges whether the extracted phrase characteristics data is equal to the phrase characteristics data in the storage area 22D as to the phrase number in the phrase attribute. For example, in the case where the user inputs a melody data for the first (theme) phrase, the phrase characteristics data of the first (theme) phrase is stored in the storage area 22D through the processing of FIG. 13. And let us assume that the phrase attribute of the first phrase characteristics data extracted at step 210 indicates the first (theme) phrase. In such an example, the judgment result at step 214 is affirmative (yes) and the process moves to step 216.

Step 216 reads out the phrase melody data from the storage area 22C. Where the melody data is inputted for the first (theme) phrase as in the example above, step 216 reads out the phrase melody data of the first (theme) phrase stored in the storage area 22C. After step 216 comes step 218 (FIG. 18).

In step 218 stores the phrase melody data together with the phrase attribute data into the storage area 22F. The reason for storing the phrase attribute data is that by designating the phrase attribute, the phrase melody data having the designated phrase attribute can be read out. When the phrase melody data of the first (theme) phrase is read out from the storage area 22C as in the above example, the read out phrase melody data is stored in the storage area 22F together with the phrase attribute data indicating the first (theme) phrase. This operation corresponds to the case of FIG. 1 where the user-inputted phrase melody data UF11 is utilized as it is as the data of the first (theme) phrase of the musical piece. After step 218 comes step 220. Step 220 judges whether there are the next phrase characteristics data in the musical piece characteristics data selected at step 192. Usually this judgment comes out affirmative (yes), and the process goes back to step 210. Step 210 then extracts the second phrase characteristics data before moving to step 212.

Let us assume that the phrase symbol in the first phrase characteristics data is "A" and that the phrase symbol in the extracted second phrase characteristics data is "B". In such an example, the judgment at step 212 rules negative (no) and the process moves to step 214. As the phrase number of the phrase characteristics data in the storage area 22D is the first (theme) phrase and the phrase number of the extracted second phrase characteristics data is the second phrase in this example, the judgment at step 214 is negative (no) and the process moves to step 222.

Step 222 reads out the rhythm pattern data from the data base 30B based on the rhythm characteristics data (FIG. 4) in the extracted second phrase characteristics data, and display the same on the screen of the display 14. Namely, for each set of the rhythm data as shown in FIG. 5, the rhythm characteristics data therein is compared with the rhythm characteristics data in the extracted phrase characteristics data, and as the both under comparison are equal (identical), the rhythm pattern data in the rhythm data as judged equal is read out and displayed. And the processing proceeds to step 224.

Step 224 judges whether the displayed rhythm pattern is to be used. The user may express his/her intention as to use the displayed rhythm pattern data or not using the keyboard 36, the mouse 38, etc. When the judgment result at step 224 is negative (no), the process goes back to step 222 to read out another rhythm pattern data from the data base 30B and displays the same. Such a read-out and display process will be repeated until the judgment result becomes affirmative (yes).

When the judgment result of step 224 becomes affirmative (yes), it means that desired rhythm pattern data is selected. The selection of the rhythm pattern may be performed by displaying a plurality of rhythm pattern data whose rhythm characteristics are identical with the rhythm characteristics data in the extracted phrase characteristics data, and selecting one from among them. The rhythm pattern may be automatically selected.

Next, step 226 creates the phrase melody data based on the tonality key data (corresponding to TD of FIG. 3) in the musical piece characteristics data which is selected at step 192, the pitch characteristics data (corresponding to PC of FIG. 3) in the extracted phrase characteristics data and the rhythm pattern data (corresponding to RP of FIG. 3) which is selected at step 224 in the manner described with reference to FIG. 7. When the phrase characteristics data of the second phrase is extracted as in the above example, the melody data for the second phrase is created. This corresponds to the case of FIG. 1 wherein the phrase melody data F12 is created as the data for the second phrase. After step 226 comes step 218. Step 218 stores the phrase melody data created at step 226 together with the phrase attribute data into the storage area 22F.

After this step 218, the processing goes through step 220 and back to step 210 to extract the third phrase characteristics data. In the case where the phrase symbol of the third phrase characteristics data is "A" and there are any phrase symbols "A" among the phrase symbols of the phrase characteristics data heretofore extracted, then the judgment at step 212 rules affirmative (yes) and the process moves to step 228.

Step 228 reads out, from the storage area 22F, the phrase melody data of the phrase which has the equal phrase symbols as judged at step 212. Then the processing moves forward to step 230 to judge whether there any melody portions to be changed. If this judgment result is affirmative (yes), the process goes to step 232 to adjust the read out phrase melody data according to the phrase melody change instruction. Steps 230 and 232 are provided so that the user can change any desired portions in the melody. Using this processing, a part of the melody data F13 (as in FIG. 1) in the third phrase may be changed to make a modified third phrase.

When the judgment at step 230 comes out negative (no) or when the process of step 232 is over, the processing moves to step 218. At step 218, the phrase melody data read out from the storage area 22F at step 228 or the phrase melody data obtained by adjusting such read out melody data at step 232 is stored together with the phrase attribute data in the storage area 22F.

Then the processing goes through step 220 and back to step 210, to repeat the processes thereafter as described above. As a result, a melody data of an amount for one musical piece is generated by connecting the melody data for the first, second, third phrases and so forth as shown in FIG. 1.

When the processing for the last phrase characteristics data is finished, the judgment at step 220 comes out negative (no) and the processing returns to the routine of FIG. 16.

In the subroutine of FIGS. 17 and 18, the processing may be modified to move to step 230 after step 216 as indicated in broken line. With this modification, for example with the generated melody data #2 in FIG. 1, as the melody data UF12 of the second phrase is utilized, a part of the data UF12 may be changed to make a modified second phrase.

Figure 19:
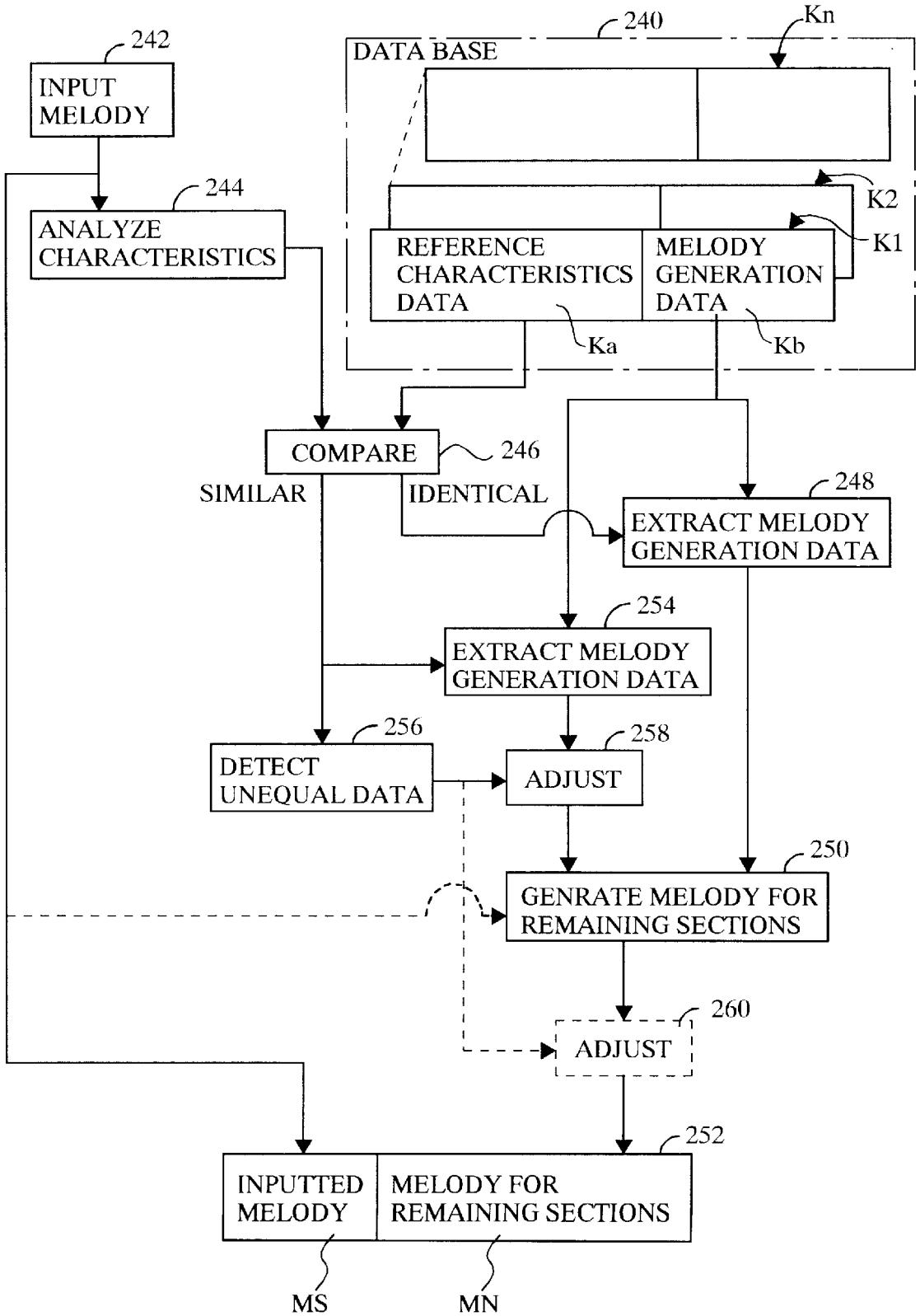
FIG. 19 is a flowchart showing the music composing processing in another embodiment of the present invention.

FIG. 19 shows a flowchart of the processing for composing a musical piece as another embodiment of the present invention. A data base 240 stores a plurality of sets of musical piece generating data K1, K2, . . . , Kn corresponding to a plurality of musical pieces, wherein each set of musical piece generating data contains, as exemplarily described with respect to K1, reference characteristics data Ka and melody generation data Kb associated with the data Ka. The reference characteristics data is the data which represents the melody characteristics of a certain section (e.g. the first phrase) for a musical piece to be composed, and may be of a data structure similar to the phrase characteristics data as illustrated and described about the phrase F1 in FIG. 3. The melody generation data are data used for generating melodies fox musical pieces to be composed and may be either melody characteristics data specifying how the melodies to be generated should be or melody data representing the melodies themselves to be generated, or both of them. The association between the reference characteristics data (e.g. Ka) and the melody generation data (Kb) in each set of the musical piece generation data (K1) is such that the reference characteristics data typifies the melody generation data and works as an index to pick up the melody generation data in the same musical piece generation data set.

At step 242, the user inputs desired melody data. The melody data inputted here refers to a certain section (e.g. the first phrase) of the musical piece to be composed. The melody inputting step 242 may include a process for the user to arbitrarily designate the section for which the user wants to input the melody data. Step 244 analyzes the characteristics of the melody represented by the inputted melody data, and creates the melody characteristics data representing the characteristics of the melody. The analysis of the melody characteristics at step 244 may be conducted in a same manner as described hereinbefore with reference to FIGS. 10–12, and the characteristics data may be of a similar structure as the phrase characteristics data described about the phrase F1 in FIG. 6.

Step 246 compares the characteristics data created at step 244 with each of the reference characteristics data in the data base 240, and detects one or plural sets of reference characteristics data which have melody characteristics equal (identical) or similar to that of the characteristics data created at step 244. When a plurality of reference characteristics data sets are detected, any one of them may be randomly selected automatically or all of them may be displayed on the display 14 so that the user can select a desired one. In the case where a plurality of sets of reference characteristics data are detected as being similar, each set may preferably be given a priority order (for example, the one which has the same number of notes as the inputted melody is given the first priority) and may be presented to the user so that the user can select a desired one. Where step 246 selects one set of reference characteristics data as detected to be identical (equal), step 248 extracts (i.e. selectively reads out) the melody generation data associated with and typified by such a selected set of reference characteristics data.

Step 250 generates melody data for the remaining sections based on the extracted melody generation data. The remaining sections here mean the sections in a musical piece to be composed other than the above mentioned certain section (the section for which the user has inputted melody data). As the processing of step 250 to generate a melody for the remaining sections, the processes to be described hereinafter with reference to FIGS. 20–22 may be employed. Step 252 then composes the melody data for a piece of music by combining the melody data of the certain section as inputted by the user at step 242 and the melody data for the remaining sections as generated at step 250.

Where step 246 selects one set of reference characteristics data as detected to be similar, step 254 extracts the melody generation data associated with and typified by such a selected set of reference characteristics data. Step 256 detects unequal conditions of the melody characteristics between the characteristics data and the reference characteristics data as compared at step 246 and delivers unequalness data. The unequalness data is data indicating, for example, that the reference characteristics data is lower than the characteristics data created at step 244 by two degrees. Step 258 adjusts the melody generation data extracted at step 254 in accordance with the unequalness data delivered from step 256. For example, where the unequalness data indicates that the pitch of the reference characteristics data is lower than the created characteristics data by two degrees, the step 258 raises the pitch of the extracted melody generation data by two degrees.

Step 250 generates melody data for the remaining sections based on the melody generation data as adjusted at step 258. And then, step 252 combines the melody data MS for the certain designated section inputted by the user at step 242 and the melody data MN for the remaining sections as generated at step 250 to compose a melody data for a piece of music. In the process of generating a melody for the remaining sections at step 250, a melody may be generated also taking the melody data inputted at step 242 into consideration other than the extracted or adjusted melody generation data. Such an alternative permits the generation of a melody which is closer to the inputted melody An example of such processing will be described hereinafter with reference to FIG. 23.

In place of adjusting (modifying) the melody generation data in accordance with the unequalness data at step 258, the melody data for the remaining sections may be adjusted (modified) according to the unequalness data at step 260. Namely, step 250 generates the melody data for the remaining sections based on the melody generation data extracted at step 254, and step 260 adjusts the thus generated melody data for the remaining sections in accordance with the unequalness data.

Through the music composing processing of FIG. 19, as the user inputs a desired melody, a melody for a piece of music can be easily composed containing a desired melody at a certain desired section such as the first phrase. As the melody is generated based on the melody generation data having melody characteristics which is equal to or similar to that of the inputted melody, and moreover the melody generation data as detected to be similar or the generated melody as being similar is adjusted in accordance with the unequalness data, the finally generated melody for a piece of music will be the one that matches the inputted melody fragment. Further, by storing the melody generation data which correspond to musical pieces having an abundant variety of musical ups and downs (e.g. existing complete musical pieces), there can be composed a melody of a piece of music which is musically artistic with abundant ups and downs.

Figure 20:
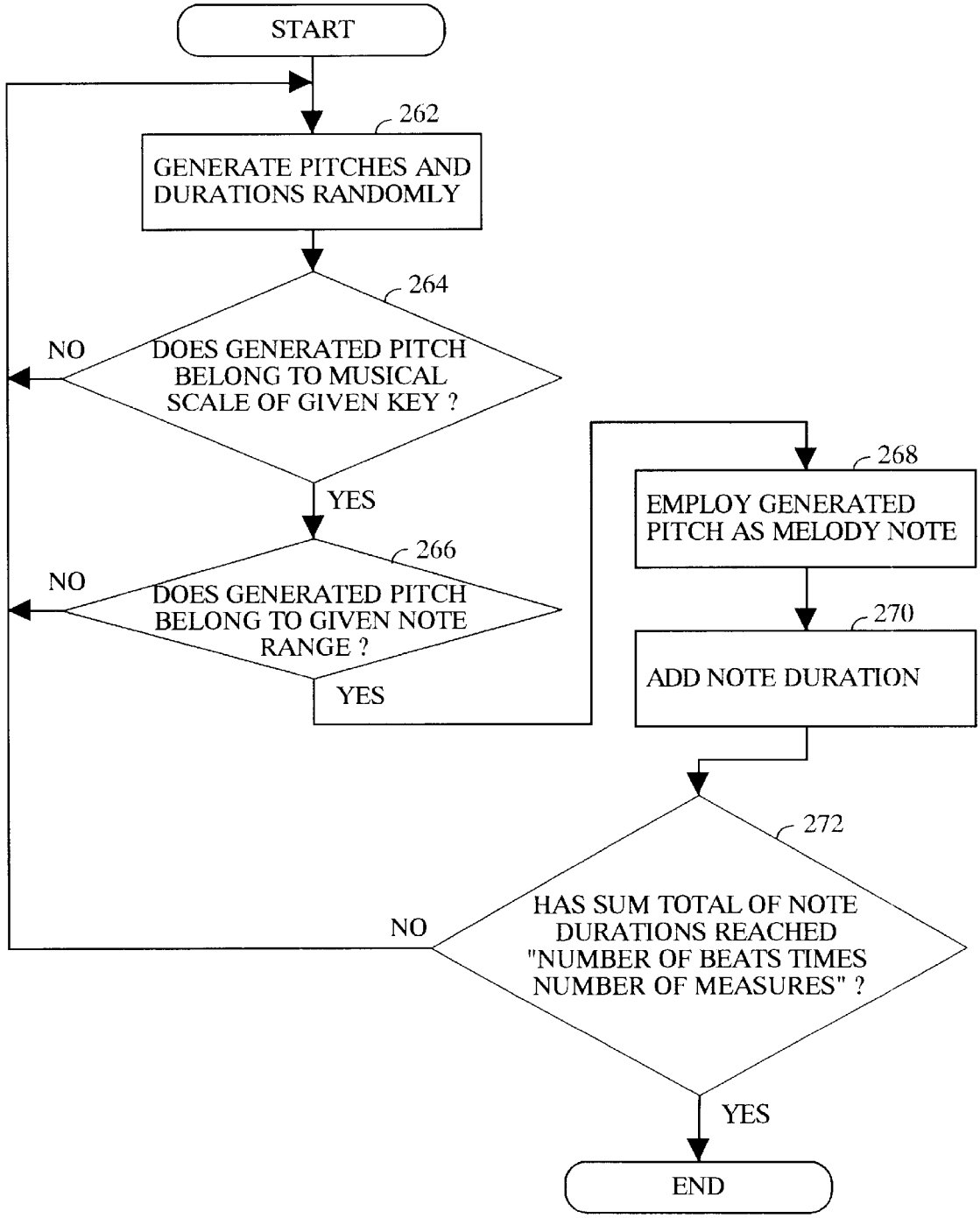
FIG. 20 is a flowchart showing the melody generating processing for the remaining sections employed in the case where the melody generation data consist of melody characteristics data.

FIG. 20 shows the processing of generating the melody for the remaining sections performed at step 250 of FIG. 19, in the case where the melody generation data consists of melody characteristics data for melody generation. FIG. 20 shows the processing for the data in amount of one musical sentence, wherein the melody characteristics data for melody generation indicates, as an example, the tonality key, the meter, the number of measures and the note range. Step 262 generates note pitches and note durations randomly. The next step 264 judges whether the generated note pitches belong to the musical scale of the given key. The given key in this context means the tonality key indicated by the melody characteristics data, and is C major, for example. If the judgment at step 264 turns out negative (no), the process goes back to step 262 to generate a note pitch again. When the judgment at step 264 rules affirmative (yes), the process moves forward to step 266. Step 266 then judges the generated note pitch belongs to the given note range. The given note range here means the note range indicated by the melody characteristics data. If the judgment at step 266 is negative (no), the process goes back to step 262 to repeat through steps 264 and 266. As the judgment at step 266 becomes affirmative (yes), the process proceeds to step 268.

Step 268 is to employ the generated note pitch as a melody note. This melody note is a note which belongs to the musical scale of the given key and falls within the given note range as passing through steps 264 and 266. The duration of the melody note is determined to be the note duration generated at step 262. Next, step 270 adds the duration of the melody note to the sum total of the durations of the previous melody notes up to the preceding note. As to the first note within a musical sentence, there is no preceding note duration there, and therefore the duration of the first melody note is simply retained for the succeeding addition. After step 270, step 272 takes place.

Step 272 judges whether the sum total of the note durations obtained at step 270 has reached "the number of beats per measure times the number of measures in a sentence". Let us assume, as an example, that the number of beats per measure is four (i.e. a quadruple meter) and the number of measures in the sentence is four, and then the calculation is $4\times4=16$. With respect to the first melody note, the judgment result at step 272 is negative and the process goes back to step 262, and the processing through steps 262 onward is executed about the second melody note in the sentence. When the sum total of note durations at step 270 reaches 16 beats after repeating such processing, the judgment at step 272 comes out affirmative (yes) and the processing comes to an end.

Thereafter, the processing as described above will be repeated for other sentences, sentence by sentence. And when the processing for the last sentence is over, melody data of an amount for one piece of music have now been obtained. In such processing, the melody characteristics data may be stored for every sentence, or may be stored in common for all of the sentences in a piece of music. Further, in order to make a generated melody musically pleasing (preferable), only such notes that meet the musical rules may be employed as the melody notes.

According to the above processing described in reference to FIG. 20, a melody reflecting the musical characteristics (features) which the melody characteristics data has can be easily generated.

Figure 21:
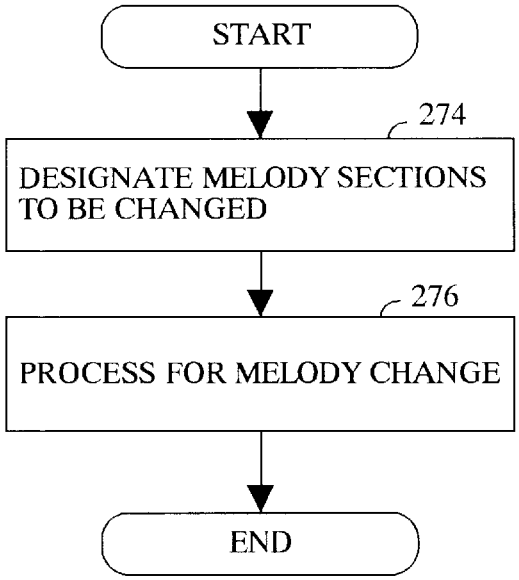
FIG. 21 is a flowchart showing the melody generating processing for the remaining sections employed in the case where the melody generation data consist of melody data.

FIG. 21 shows the melody generation processing for the remaining sections employed at step 250 of FIG. 19 in the case where the melody generation data consists of melody data for generating a melody. The melody data for generating a melody here represent melodies for a plurality of musical sentences. Step 274 is a process of designating a melody section or sections at which the melody is to be changed with respect to the melody data. For example, in FIG. 2, the display 14 presents on the screen the melody data for the user to designate the melody change section (the section at which the user wants change the melody) using the keyboard 36, the mouse 38, etc. The next step 276 conducts a process for changing the melody at the designated melody change section. The melody change process includes, (a) inversion of the melody, (b) reverse reading of the melody, (c) changes in tone generation timings, (d) compression or expansion on the time axis, (e) compression or expansion on the pitch axis, (f) replacement of some of the pitches, (g) replacement of the pitches under the condition that the tendency of pitch motion is reserved, and so forth. To show an example of melody inversion, where a melody is given by notes in succession as C-D-E-G, inversion about the pitch D (i.e. pitch D is taken as the axis of inversion) will make a melody of E-D-C-A. According to the processing of FIG. 21, a melody which reflects the musical atmosphere or sensation which the melody data has can be easily generated.

Figure 22:
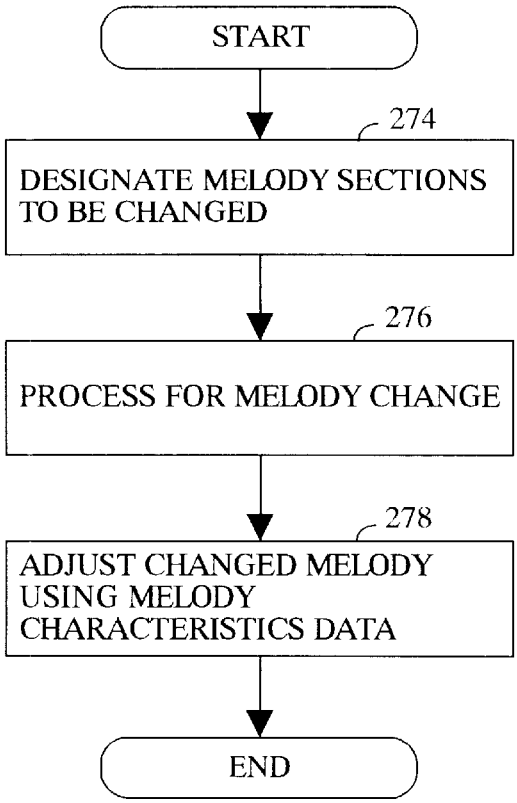
FIG. 22 is a flowchart showing the melody generating processing for the remaining sections employed in the case where the melody generation data consist of melody data and melody characteristics data.

FIG. 22 shows the melody generation processing for the remaining sections employed at step 250 of FIG. 19 in the case where the melody generation data includes melody data for generating a melody and melody characteristics data for generating a melody. The melody data for generating a melody here represent melodies for a plurality of musical sentences, while the melody characteristics data for generating a melody indicates that after the melody has change, the first note and the last note are employed as a chord constituent notes. Steps 274 and 276 in FIG. 22 are processes similar to the processes at steps 274 and 276 in FIG. 21, and therefore the description is omitted for the simplicity's sake.

Where the melody of C-D-B-G is changed to a melody of E-D-C-A by the melody inversion as exemplified above, the obtained melody of E-D-C-A gives a sensation of the A minor chord, while the original C-D-E-G gives a sensation of the C major chord, and therefore the chord feeling disadvantageously becomes abnormal. In order to obviate such disadvantage and to enhance musical artisticality, the above mentioned melody characteristics data and the process of step 278 are added here in FIG. 22. Namely, step 278 contemplates the normalization of chord sensation by adjusting the changed melody according to the melody characteristics data. As in the above mentioned example wherein the melody has been changed to E-D-C-A at step 276, the last note A is adjusted to note G which is a chord constituent note of the C major chord and is closest to note A in accordance with the indication by the melody characteristics data, thereby obtaining a melody of E-D-C-G. With this processing of FIG. 22, a melody reflecting the musical atmosphere which the melody data has and the musical characteristics which the melody characteristics data has can be easily generated.

Figure 23:
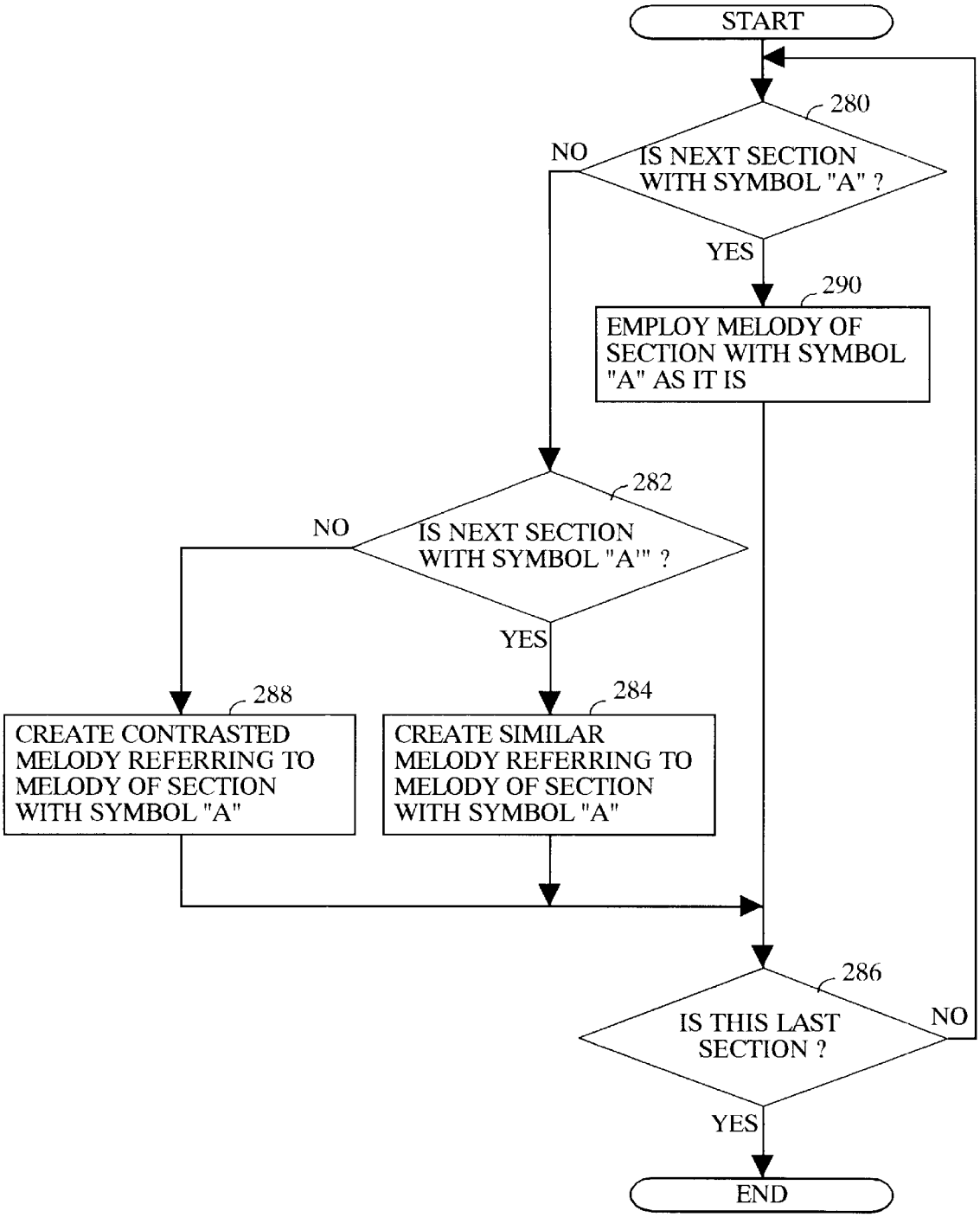
FIG. 23 is a flowchart showing the melody generating processing for the remaining sections employed in the case where the inputted data are used other than the melody generation data.

FIG. 23 shows the processing of generating a melody for the remaining sections employed at step 250 of FIG. 19 in the case where the inputted melody data is used other than the melody generation data. In this case, let us assume that the sentence structure of the musical piece to be composed is A, A', B, A and that the user inputs melody data for the first sentence A. The processing of FIG. 23 starts as the user completes inputting melody data for the first sentence A.

Step 280 judges whether the next section (for processing) is a sentence with symbol A. As the next section is the sentence with symbol A', the judgment at step 280 comes out negative (no) and the process moves to step 282. Step 282 judges whether the next section is a sentence with symbol A. This judgment comes out affirmative (yes), and the process moves to step 284. Step 284 creates, for the sentence A', melody data of a melody which is similar to the melody of the melody data of the sentence A referring to the inputted melody data of the sentence A. Methods for creating similar melody data include (a) a method wherein the melody for the first half of the sentence A' is made equal or similar to the melody of the first half of the sentence A and the melody for the second half of the sentence A' is created anew, (b) a method wherein the melody for the first half of the sentence A' is created anew and the melody for the second half of the sentence A' is made equal or similar to the melody of the second half of the sentence A, (c) a method wherein a pitch shift processing is applied to the melody of the sentence A to make a melody for the sentence A', and so forth. After step 284, the process moves to step 286. Step 286 judges whether the section under the present processing of melody generation is the last section. As the sentence A' is not the last section, the judgment at step 286 is negative (no) and the process goes back to step 280.

Step 280 judges whether the next section is a sentence with symbol A. As the next section is the sentence B, the judgment at step 280 turns out negative (no) and the process moves to step 282. Step 282 judges whether the next section is a sentence with symbol A'. This judgment turns out negative (no) and the process moves to step 288. Step 288 creates, for the sentence B, melody data of a melody which is contrasted (not similar) to the melody of the sentence A referring to the inputted melody data of the sentence A. Methods for creating contrasted melody data include (a) a method wherein a melody for the sentence B is created by applying the above mentioned melody inverting processing on the melody of the sentence A, (b) a method wherein a melody for the sentence B is created by changing the rhythm denseness about the melody of the sentence A (e.g. where the note distributions in the first half and the second half of the sentence A are denser and sparser, respectively, the denseness will be changed to "sparser ad denser"), and so forth. After step 288, the process moves to step 286. Step 286 judges whether the section under the present processing of melody generation is the last section. As the sentence B is not the last section, the judgment at step 286 is negative (no) and the process goes back to step 280.

Step 280 judges whether the next section is a sentence with symbol A. As the next section is the sentence A, the judgment at step 280 turns out affirmative (yes) and the process moves to step 290. Step 290 employs the inputted melody data of the sentence A as it is as the melody data for the last sentence with symbol A. And when step 286 judges whether the section under processing is the last section, the judgment turns out affirmative (yes) and the processing comes to an end.

In the processing of FIG. 23, when the melody for the first half or the second half of the sentence A' may be created anew by using the melody generation data (either the melody characteristics data for melody generation or the melody data for melody generation), or by using the method of utilizing the inputted melody as described in connection with step 288. Further at step 288, the melody for the sentence B may be created by using the melody generation data in place of the inputted melody. In any case, the melody generation data is to be used at least at either of step 284 and step 288.

In the processing FIG. 23, a melody for a sentence having a symbol with two or more primes like A" may be created. In such a case, a melody is to be created according to another similarity rule which is different from the rule for the single prime symbol. Further, a melody for a sentence C or D or else may be created. In such a case, a melody is to be created according to another contrasting rule which is different from the rule for the sentence B.

With the above processing described with reference to FIG. 23, a melody of an amount for a piece of music having a sentence structure like A, A', B, A can be composed by using the melody data inputted by the user for the sentence A and using the melody generation data. The composed melody of a piece of music includes the inputted melody for the sentence A and also reflects the musical characteristics or the musical atmosphere which the melody generation data has.

Figure 24:
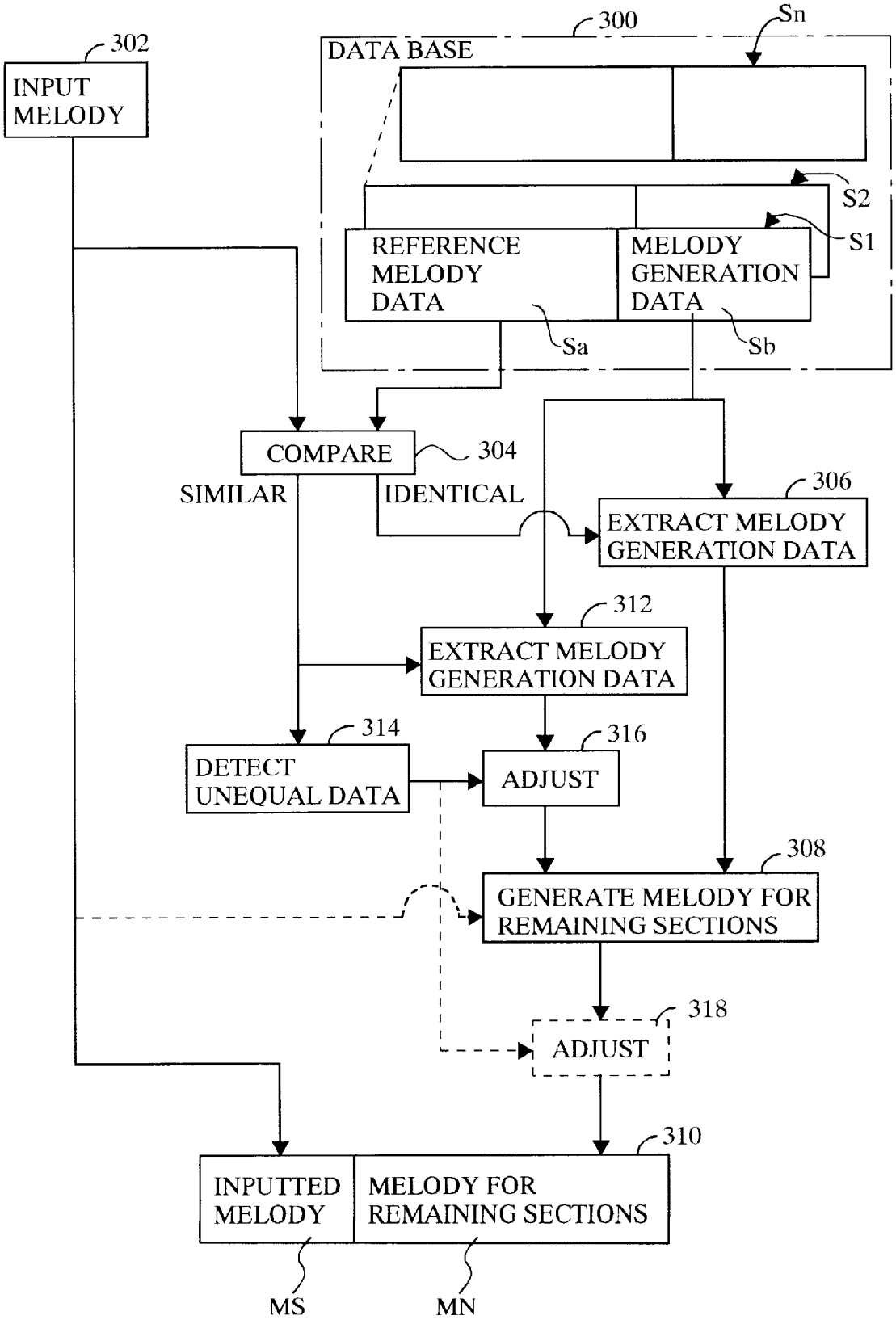
FIG. 24 is a flowchart showing the music composing processing in a further embodiment of the present invention.

FIG. 24 shows a flowchart of the processing for composing a musical piece as a further embodiment of the present invention. A data base 300 stores a plurality of sets of musical piece generating data S1, S2, . . . , Sn corresponding to a plurality of musical pieces, wherein each set of musical piece generating data contains, as exemplarily described with respect to S1, reference melody data Sa and melody generation data Sb associated with the data Sa. The reference melody data is the data which represents the melody of a certain section (e.g. the first phrase) for a musical piece to be composed, and may be constituted by the data representing the note pitch and the note duration for every note. The melody generation data are data used for generating melodies for musical pieces to be composed and may be either melody characteristics data specifying how the melodies to be generated should be or melody data representing the melodies themselves to be generated, or both of them, as described hereinbefore with reference to FIGS. 20–22. The association between the reference melody data (e.g. Sa) and the melody generation data (Sb) in each set of the musical piece generation data (S1) is such that the reference melody data typifies the melody generation data and works as an index to pick up the melody generation data in the same musical piece generation data set.

At step 302, the user inputs desired melody data. The melody data inputted here refers to a certain section (e.g. the first phrase) of the musical piece to be composed The melody inputting step 302 may include a process for the user to arbitrarily designate the section for which the user wants to input the melody data.

Step 304 compares the inputted melody with each of the reference melody data in the data base 300, and detects one or plural sets of reference melody data which have a melody equal (identical) or similar to that of the inputted melody data. When a plurality of reference melody data sets are detected, any one of them may be randomly selected automatically or all of them may be displayed on the display 14 so that the user can select a desired one. In the case where a plurality of sets of reference melody are data detected as being similar, each set may preferably be given a priority order (for example, the one which has the same number of notes as the inputted melody is given the first priority) and may be presented to the user so that the user can select a desired one. Where step 304 selects one set of reference melody data as detected to be identical (equal), step 304 extracts (i.e. selectively reads out) the melody generation data associated with and typified by such a selected set of reference melody data.

Step 308 generates melody data for the remaining sections based on the extracted melody generation data. The remaining sections here mean the sections in a musical piece to be composed other than the above mentioned certain section (the section for which the user has inputted melody data). As the processing of step 308 to generate a melody for the remaining sections, the processes described hereinbefore with reference to FIGS. 20–22 maybe employed. Step 310 then composes the melody data for a piece of music by combining the melody data of the certain section as inputted by the user at step 302 and the melody data for the remaining sections as generated at step 308.

Where step 304 selects one set of reference melody data as detected to be similar, step 312 extracts the melody generation data associated with and typified by such a selected set of reference melody data. Step 314 detects unequal conditions of the melodies between the inputted melody data and the reference melody data as compared at step 304 and delivers unequalness data. The unequalness data is data indicating, for example, that the reference melody data is lower than the inputted melody data by two degrees. Step 316 adjusts the melody generation data extracted at step 312 in accordance with the unequalness data delivered from step 314. For example, where the unequalness data indicates that the pitch of the reference melody data is lower than the inputted melody data by two degrees, the step 316 raises the pitch of the extracted melody generation data by two degrees.

Step 308 generates melody data for the remaining sections based on the melody generation data as adjusted at step 316. And then, step 310 combines the melody data MS for the certain designated section inputted by the user at step 302 and the melody data MN for the remaining sections as generated at step 308 to compose a melody data for a piece of music. In the process of generating a melody for the remaining sections at step 308, a melody may be generated also taking the melody data inputted at step 302 into consideration other than the extracted or adjusted melody generation data. Such an alternative permits the generation of a melody which is closer to the inputted melody. An example of such processing is described hereinbefore with reference to FIG. 23.

In place of adjusting (modifying) the melody generation data in accordance with the unequalness data at step 316, the melody data for the remaining sections may be adjusted (modified) according to the unequalness data at step 318. Namely, step 308 generates the melody data for the remaining sections based on the melody generation data extracted at step 312, and step 318 adjusts the thus generated melody data for the remaining sections in accordance with the unequalness data.

Through the music composing processing of FIG. 24, as the user inputs a desired melody, a melody for a piece of music can be easily composed containing a desired melody at a certain desired section such as the first phrase. As the melody is generated based on the melody generation data having a melody which is equal to or similar to the inputted melody, and moreover the melody generation data as detected to be similar or the generated melody as being similar is adjusted in accordance with the unequalness data, the finally generated melody for a piece of music will be the one that matches the inputted melody fragment. Further, by storing the melody generation data which correspond to musical pieces having an abundant variety of musical ups and downs (e.g existing complete musical pieces), there can be composed a melody of a piece of music which is musically artistic with abundant ups and downs. Still further, as step 304 compares the inputted melody data and the reference melody data directly, the composed melody will be closer to the inputted melody fragment than in the case of comparing melody characteristics data.

Figure 26:
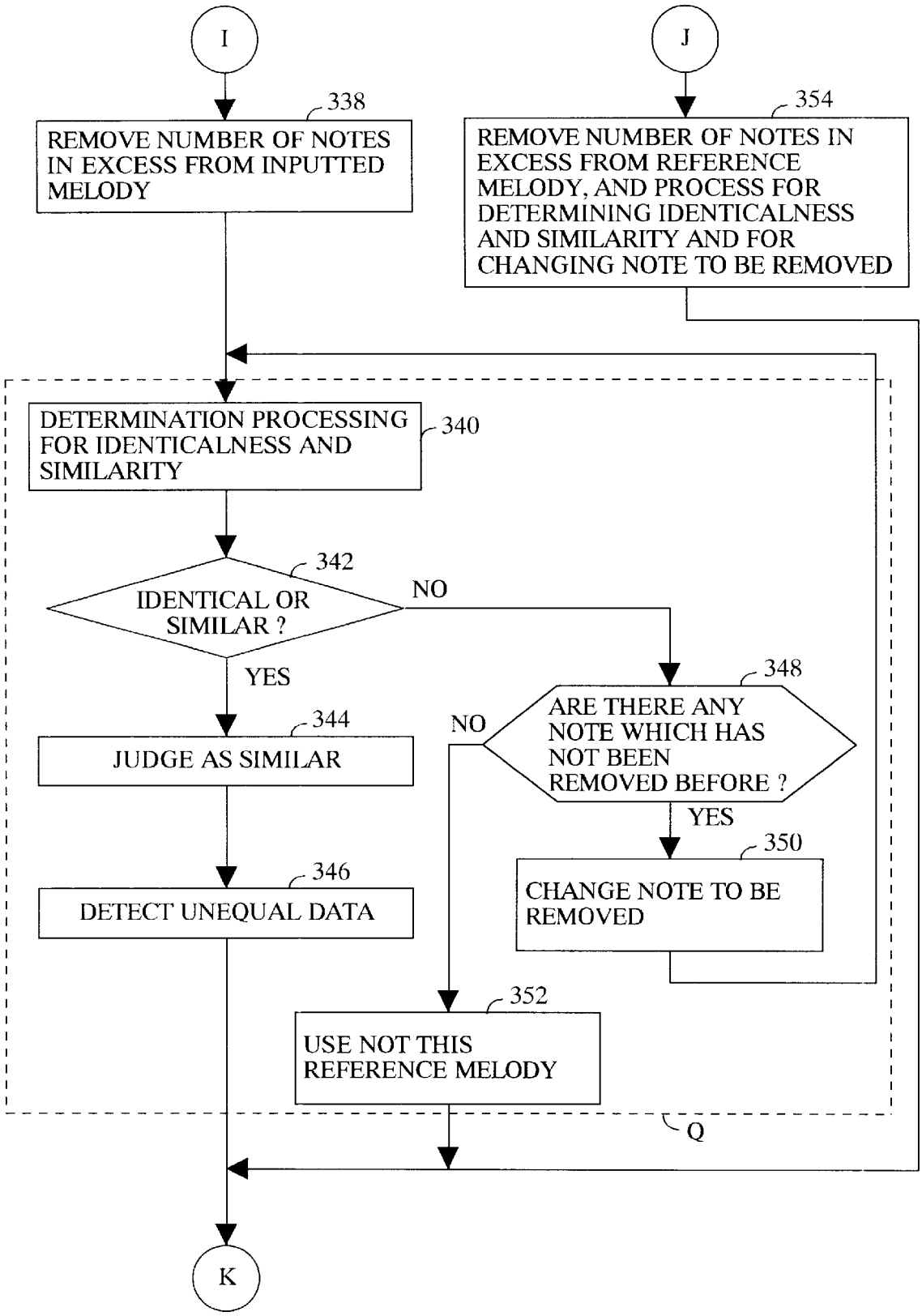

FIGS. 25 and 26 illustrate in combination a flowchart showing an example of the processing for comparing melody data and detecting unequal conditions for delivering unequalness data to be used in the music composing processing shown in FIG. 24 above.

In the Figure, step 320 is to load the inputted melody data (inputted directly by the user or supplied from any equivalent signal source) and the first reference melody data into a register for comparison (not shown). Then the processing moves forward to step 322 to compare the inputted melody data and the reference melody data from the viewpoint of the number of notes and judges whether the inputted melody and the reference melody have the same number of notes or the inputted melody has more, number of notes or the reference melody has more number of notes.

When step 322 judges that the inputted melody and the reference melody have the same number of notes, the process moves to step 324 Step 324 determines:

(1) a pitch difference "e" between each corresponding pair of notes of the inputted melody and of the reference melody;

(2) a pitch change "f" from each note to the next note of the inputted melody;

(3) a pitch change "g" from each note to the next note of the reference melody; and (4) a timing difference "h" between each corresponding pair of notes of the inputted melody and of the reference melody;

based on the inputted melody data and the reference melody data.

Now let us assume that the inputted melody constitutes a sequence of note pitches "a", the reference melody constitutes a sequence of note pitches "b", the inputted melody defines a sequence of timings "c", and the reference melody defines a sequence of timings "d", as follows:

sequence a: a1, a2, . . . , a(n−1), an sequence b: b1, b2, . . . , b(n−1), bn sequence c: c1, c2, . . . , c(n−1), cn sequence d: d1, d2, . . . , d(n−1), dn.

Then the pitch differences "e", the pitch changes "f" and "g", and the timing differences "h" are respectively obtained by the following equations in Table 1.

TABLE 1

| term | equation |
|---|---|
| e | e1 = b1 − a1, e2 = b2 − a2, . . ., en = bn − an |
| f | f1 = a2 − a1, f2 = a3 − a2, . . ., f(n − 1) = an − a(n − 1) |
| g | g1 = b2 − b1, g2 = b3 − b2, . . ., g(n − 1) = bn − b(n − 1) |
| h | h1 = d1 − c1, h2 = d2 − c2, . . ., hn = dn − cn. |

Thereafter, step 326 determines whether the inputted melody and the reference melody are identical (equal) or similar or not similar to each other based on the above obtained sequences e, f, g, and h. And step 328 judges whether the determination at step 326 is "identical or similar" or not so. When the judgment at step 328 says affirmative (yes), the process moves to step 330. Only in the case where the determination at step 326 is "similar", then step 330 detects unequal conditions between the inputted melody and the reference melody to deliver unequalness data indicating how they are similar (i.e. not identical). When the judgment at step 328 comes out negative (no), the process moves to step 332 to decide not to use the reference melody under comparison.

When the processing of step 330 or 332 is over, the process moves to step 334 to judge whether all the reference melody data have been examined. If this judgment comes out negative (no), step 336 loads the next reference melody data and the process goes back to step 332.

When the judgment at step 332 rules that the inputted melody has more notes than the reference melody, the process goes to step 338 (FIG. 26). Step 338 removes (cancels) from the inputted melody the number of notes which is in excess of the notes in the reference melody to equalize the number of notes in the inputted melody and the reference melody And the process moves to step 340. Step 340 executes the processing of determi g the identicalness and the similarity. This processing is conducted in a similar manner to the processing P (FIG. 25) including steps 324 and 326 as described hereinbefore. And then step 342 judges whether the determination at step 340 is "identical or similar" or not so.

When the judgment at step 342 rules affirmative (yes), the process moves to step 344 to decide that the present comparison turns out to be "similar". As the number of notes in the inputted melody has been decreased before comparison, even if the judgment at step 340 says "identical", the decision at step 334 should be "similar". Thereafter, step 346 detects unequal conditions of the melodies between the inputted melody data and the reference melody data to deliver unequalness data indicating how they are different.

When the judgment at step 342 rules negative (no), the process moves to step 348. Step 348 judges whether there are any notes which have not been removed before in the inputted melody. For example, in the case where the input melody consists of six notes m1–m6, when step 338 removes the note m6 and the process comes to step 348 for the first time thereafter, there are five notes m1–m5 which have not been removed yet before. After step 348, the process moves to step 350. Step 350 changes notes to be removed. In the above exemplified case where there are five notes m1–m5 existing there, this step removes the note m5, for example. And the process goes back to step 340 to repeat the processing through step 340 onward as described above. If the processing comes to step 348 again and there are still notes which have not been subjected to removal, then step 350 changes notes to be removed. In the case where the note m5 is removed, step 350 removes, for example, the note m4 before going back to step 340. In the above example, if the processing passes through these steps 348 and 350 three times, the notes m3–m1 will be removed in turn. If the processing comes to step 348 thereafter, there is no more note left unremoved in the inputted melody, and step 348 rules negative (no) and the process goes to step 352. Step 532 decides not to use this reference melody data under comparison.

When the processing at step 346 or 352 is over, the process proceeds to step 334 (FIG. 25) to judge whether all of the reference melody data have been examined. If this judgment turns out negative (no), step 336 loads the next reference melody data before going back to step 322.

When the judgment at step 332 rules that the reference melody has more notes than the inputted melody, the process goes to step 354 (FIG. 26). Step 354 removes (cancels) from the reference melody the number of notes which is in excess of the notes in the inputted melody to equalize the number of notes in the inputted melody and the reference melody, and executes the processing of determining the identicalness and the similarity. This processing is conducted in a similar manner to the processing Q (FIG. 26) including steps 340 through 352 as described above.

When the processing at step 354 is over, the process proceeds to step 334 (FIG. 25) to judge whether all of the reference melody data have been examined. If this judgment turns out negative (no), step 336 loads the next reference melody data before going back to step 322.

When all of the reference melody data in the data base 300 have been examined by executing the above described processing for a number of times, the judgment at step 334 becomes affirmative (yes) and the processing comes to an end.

Figure 27:
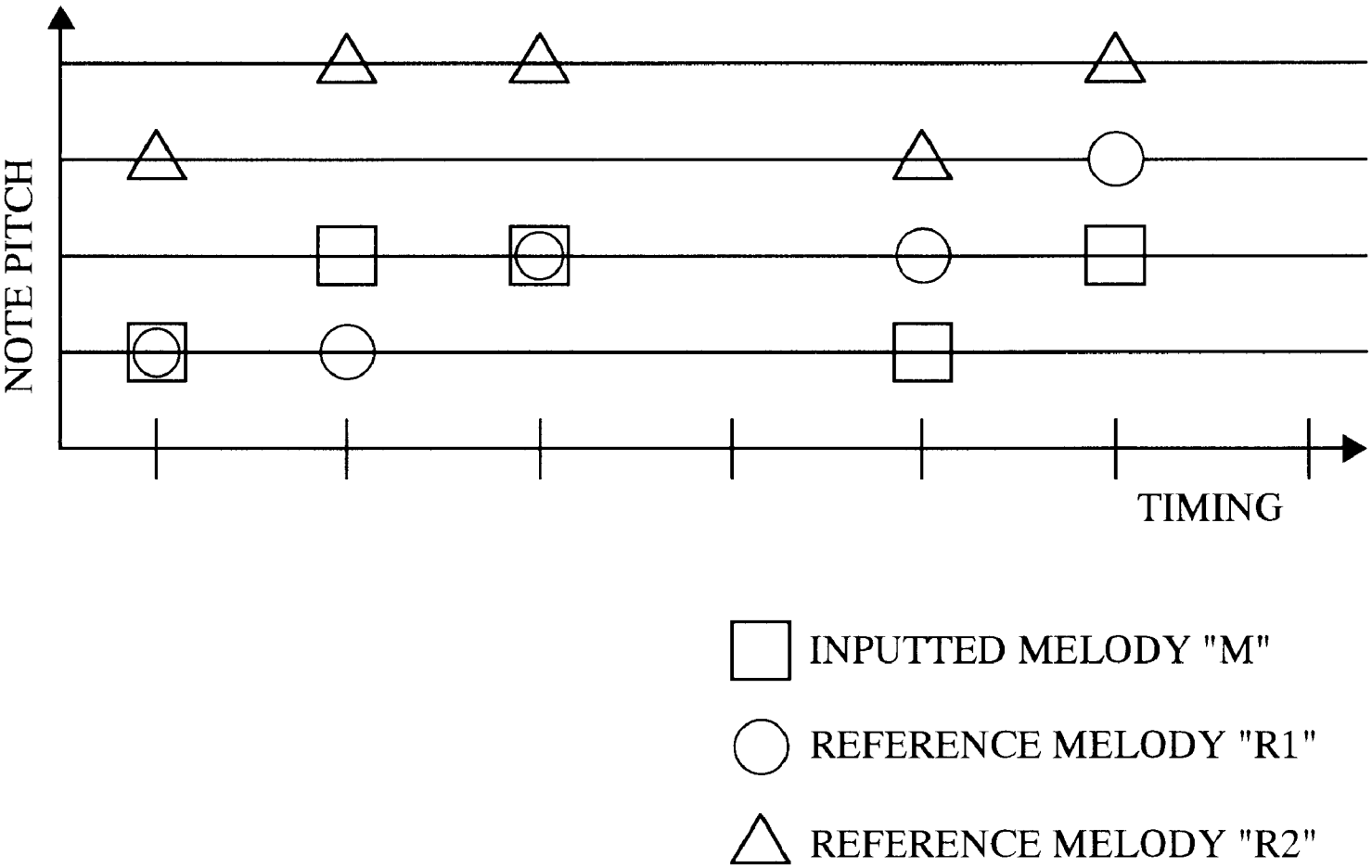
FIG. 27 is a graph chart showing the inputted melody and the reference melody to be compared in the processing of FIGS. 25 and 26.

FIG. 27 is a graph chart showing the inputted melody and the reference melody as compared in the processing of FIGS. 25 and 26, in which the abscissa represents the lining and the ordinate represents the note pitch. In FIG. 27, empty squares indicate the constituent notes of the inputted melody M, empty circles the constituent notes of the reference melody R1 and empty triangles the reference melody R2. The inputted melody M is compared with the reference melody R1 or R2, and a sequence "e" of the pitch differences, sequences "f" and "g" of the pitch changes and a sequence "h" of the timing differences are obtained according to the equations shown in Table 1, and judgment process is conducted to determine identicalness or similarity with respect to the timings and the pitches based on the respective calculated values in the sequences of e, f, g and h.

In the timing judgment, when all of the timing differences in h are zero, the two melodies are judged to be identical in timing. When only a few (a part) of the timing differences in h are not zero, the two melodies are judged to be similar. When all or almost all of the timing differences in h are not zero, the two melodies are judged to be neither identical (equal) nor similar. In the example of FIG. 27, all of the timing differences in h (i.e. h1–h5) between the inputted melody M and the reference melody R1 or R2 are all zero, and both of the reference melodies are judged to be identical with the inputted melody.

In the judgment with respect to the note pitches, when all, of the pitch differences in e are zero, the two melodies are judged to be identical in pitch. As an example, if the pitch differences in e are obtained between the inputted melody M and the reference melody R1, they are:

$$e1=0,\ e2=-1,\ e3=0,\ e4=+1 \text{ and } e5=+1.$$

If the pitch differences in e are obtained between the inputted melody M and the reference melody R2, they are:

$$e1=+2,\ e2=+2,\ e3=+2,\ e4=+2,\ e5=+2.$$

Thus neither of the reference melodies R1 and R2 are judged identical with the inputted melody.

In deciding the similarity of the melodies, when the pitch change tendencies f and g are identical, the two melodies are judged to be similar. Further, even though the amounts of pitch changes axe different, if all of the signs (+ or –) are the same, the two melodies are judged to be similar. For example, the pitch changes f of the reference melody R1 are:

$$f1=0,\ f2=+1,\ f3=0 \text{ and } f4=+1,$$

while the pitch changes f of the reference melody R2 are:

$$f1=+1,\ f2=0,\ f3=-1 \text{ and } f4=+1.$$

On the other hand, the pitch changes f of the inputted melody M are:

$$g1=+1,\ g2=0,\ g3=-1 \text{ and } g4=+1.$$

Consequently, the inputted melody M and the reference melody R2 are identical in every pitch change, i.e. between every f and the corresponding g, and therefore are judged to be similar. In this case, the unequal conditions are determined by the pitch differences e, and the unequallness data indicates that "the reference melody is higher than the inputted melody in pitch by two degrees". Thi kind of unequalness data indicating such unequal conditions between the melodies is detected and delivered at step 330 in FIG. 25. And at step 316 (or 318) in FIG. 24, the melody generation data (or the generated melody data) is lowered by two degrees in response to the delivered unequalness data. As to the reference melody data R1, the pitch changes in f and g are not equal and further all of the signs are not identical, and so the two melodies are judged to be not similar.

In the case where the pitch changes (motion tendency) f and g are compared between the inputted melody and the reference melody, the two melodies are judged to be similar as long as all of the signs are the same, even if the amounts of changes are different, as explained hereinbefore. This is because two melodies may well be considered similar in pitch change tendency if all the signs of pitch change values are the same. In such a case, however, the note range (span from the lowest note to the highest note) of the inputted melody and that of the reference melody may often be different, and therefore the difference in the note range width may be detected and delivered as the unequalness data, and the note range of the melody generation data (or the generated melody data) may be adjusted according to such unequalness data.

This invention may not be limited to the embodiments described hereinabove, but may be practiced with various modifications, without departing from the spirit of the invention. Examples of practicable modifications will be as follows:

(1) For supplying desired melody data by the user, electronic or electric musical instruments of a keyboard type, a stringed type (e.g. a guitar type) and a wind type may be available for inputting melody data by the real time performance thereon, and further particular switches for pitch designation and for duration designation may be available for inputting the melody data note by note. The melody inputting procedure may also be possible by first inputting a rhythm pattern of the intended melody by tapping on a predetermined switch (assigned for rhythm input), displaying the beat points of the rhythm pattern along the time axis on the two dimensional graph screen having a time abscissa (horizontal axis) and a pitch ordinate (vertical aids), and dragging each beat point on the screen in the direction of pitch axis to the intended pitch level using a mouse to input the pitch of each beat point. Further, in place of inputting from the external storage device 30, melody data stored in the ROM 20 may be selectively taken out as input to the CPU 18. Still further, melody data created by another automatic music composing apparatus of the present invention or by another type of automatic music composing apparatus such as one which creates a motive melody based on a given motive (theme) characteristics parameters and thereafter generates a melody for a piece of music reflecting the motive melody may be inputted to the system of the present invention. Further, in the automatic music composing apparatus of a motive generation type, there usually exist characteristics parameters which have been used for the generation of the motive melodies, and therefore these characteristics parameters may be utilized for the comparison with the reference characteristics data in the system of the present invention.

(2) In the case of inputting the melody data by a real time performance on the instrument, performance of the melody to the metronome sounds or the like will minimize the fluctuation in tempo so that the duration of each note can be inputted correctly. By playing a melody in a slower tempo than the nominated tempo, even a difficult melody can be performed easily, and the melody data can be easily inputted to the system. Further, with respect to the inputted melody data, the duration data (timing data) may be subjected to a quantization process to adjust to just timing data such as of eighth note length multiples, or erroneous input can be corrected note by note.

(3) The algorithms for the melody data generation and the automatic music composition may not be limited to those described hereinabove, but various other algorithms may be useful for the present invention.

(4) For the storage medium to store the program, not only the ROM 20, but also those storage media (such as aforementioned HD, FD, CD, DVD and MO) equipped in the external storage device 30 may be used. In such an instance, the programs stored in the storage medium are to be transferred from the external storage device 30 to the RAM 22. And the CPU 18 will be operated according to the programs stored in the RAM 22. This manner will facilitate addition or up-grading of the programs.

(5) The programs and the various data necessary for practicing the present invention may be downloaded from an outside server computer or the like into the RAM 22 or the external storage device 30 via a communication network (e.g. LAN, internet, telephone lines) and an interface therefor in response to a download request.

(6) A small size computer corresponding to the personal computer 11 may be installed (built-in) in the electronic musical instrument 12 or may integrated with the electronic musical instrument 12.

(7) The format of the melody data may not be limited to the "event+relative time" form wherein the occurrence time of an event is expressed in a relative time (lapse time) from the preceding event, but may be of any arbitrary form such as the "event+absolute time" form wherein the occurrence time of an event is expressed in an absolute time from the start of a musical piece or the start of a measure, the "note (rest)+duration" form wherein the melody is expressed by the note pitches plus the note durations and the rests plus the rest durations, and the "memory address map" form wherein a memory area is secured with respective addresses allotted to minimum time units of events and every occurrence of event is stored at the corresponding address which is allotted for the time of such every occurrence.

(8) The electronic musical instrument may be structured by properly connecting separate keyboard unit, tone generator unit, automatic performance unit, etc. together to constitute an electronic musical instrument system.

(9) The melody characteristics data may be prepared or edited by the user.

As will be apparent from the foregoing detailed description, the present invention has various advantageous merits as mentioned below.

As the reference characteristics data (or the reference melody data) which is equal to or similar to the melody characteristics data (or the melody data) of the melody inputted by the user is first detected, and then the melody generation data set prepared in association with and typified by the reference characteristics data (or the reference melody data) is used for generating a melody data set as a composition output, a melody for a composed musical piece which matches the theme melody inputted by the user and is musically artistic having an abundant variety of ups and downs can be easily generated.

Further, with respect to the reference characteristics data (or the reference melody data) which is not identical with the inputted melody data in terms of melody characteristics (or melody), the melody generation data set prepared in association with and typified by the reference characteristics data (or the reference melody data) is first adjusted in accordance with the unequalness data, and the adjusted melody generation data set is then used for generating a melody data set as a composition output, or alternatively a melody data set is temporarily generated based on the melody generation data set prepared in association with and typified by the reference characteristics data (or the reference melody data), and then the temporarily generated melody data set is adjusted in accordance with the unequalness data, and consequently the composed melody will be close to the inputted theme melody.

Further in an alternative embodiment, the user designates a particular musical section for a composed musical piece and inputs a melody fragment for the designated section, and the apparatus utilizes the inputted melody fragment as is for that section and creates a melody for the other musical sections than the designated one based on the musical piece characteristics data set (or the musical piece data set) which is equal or similar to the melody characteristics (or the melody) of the inputted melody fragment to compose an amount of melody data for a musical piece containing both the utilized melody fragment and the generated melody, and consequently the present invention can provide a musical composition having a desired melody fragment at the desired musical section and having a melody as a whole which matches the desired melody fragment inputted by the user.

This invention may not be limited to a stand-alone apparatus for automatically composing musical pieces, but can also be realized with a computer system configured according to the program containing instructions to perform the steps of above-described processings for composing melodies of musical pieces. Further, such a system may be installed in an electronic musical instrument as an additional feature thereto to enhance the faculty of the instrument. The essence of the present invention can be condensed on a computer readable medium in the form of a computer program for executing the processing steps as described herein. Also various manners of technology prevailing in the computer field may also be available.

While several forms of the invention have been shown and described, other forms will be apparent to those skilled in the art without departing from the spirit of the invention. Therefore, it should be understood that the embodiments shown in the drawings and described above are merely for illustrative purposes, and are not intended to limit the scope of the invention, which is defined by the appended claims.

What is claimed is:

1. An automatic music composing apparatus comprising:

a storage device which stores a plurality of musical piece generation data sets, each set including a reference characteristics data set which represents melody characteristics specifying a reference melody fragment and a melody generation data set which contains melody specifying data of an amount for a piece of music so as to be used for generating a melody to constitute a musical piece, said reference characteristics data set included in each said musical piece generation data set typifying said melody generation data set included in said same musical piece generation data set;

a supply device for supplying melody data which defines a desired melody fragment;

an analyzer which analyzes said supplied melody data to determine melody characteristics of said desired melody fragment and creates characteristics data representing melody characteristics of said desired melody fragment;

a detector which compares the characteristics data created by said analyzer with the reference characteristics data sets stored in said storage device and detects a reference characteristics data set which is equal or similar to said created characteristics data in terms of melody characteristics;

a read out device which reads out from said storage device a melody generation data set included in the musical piece generation data set of which the reference characteristics data set is detected by said detector; and a melody generator which generates melody data representing a musical piece based on the melody generation data set as read out from said storage device.

2. An automatic music composing apparatus according to claim 1, wherein said melody generation data set includes either of or both of: a melody characteristics data set defining melody characteristics which specifies an amount of melody for generating a melody to constitute a musical piece, and a melody data set specifying an amount of melody for generating a melody to constitute a musical piece.

3. An automatic music composing apparatus according to claim 1, wherein said melody generator generates melody data also based on the melody data supplied from said supply device.

4. An automatic music composing apparatus according to claim 1, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

5. An automatic music composing apparatus comprising:

a storage device which stores a plurality of musical piece generation data sets, each set including a reference melody data set which specifies a reference melody fragment and a melody generation data set which contains a melody specifying data of an amount for a piece of music so as to be used for generating a melody to constitute a musical piece, said reference melody data set included in each said musical piece generation data set typifying said melody generation data set included in said same musical piece generation data set;

a supply device for supplying melody data which defines a desired melody fragment;

a detector which compares the melody data supplied by said supply device with the reference melody data sets stored in said storage device and detects reference melody data which is equal or similar to said supplied melody data;

a read out device which reads out from said storage device a melody generation data set included in the musical piece generation data set of which the reference melody data set is detected by said detector; and a melody generator which generates melody data representing a musical piece based on the melody generation data set as read out from said storage device.

6. An automatic music composing apparatus according to claim 5, wherein said melody generation data set includes either of or both of: a melody characteristics data set defining melody characteristics which specifies an amount of melody for generating a melody to constitute a musical piece, and a melody data set specifying an amount of melody for generating a melody to constitute a musical piece.

7. An automatic music composing apparatus according to claim 5, wherein said melody generator generates melody data also based on the melody data supplied from said supply device.

8. An automatic music composing apparatus according to claim 5, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

9. An automatic music composing apparatus comprising:

a storage device which stores reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a supply device for supplying melody data which defines a desired melody fragment;

an analyzer which analyzes said supplied melody data to determine melody characteristics of said desired melody fragment and creates characteristics data representing melody characteristics of said desired melody fragment;

a detector which compares the characteristics data created by said analyzer with the reference characteristics data set stored in said storage device and detects unequal conditions between said created characteristics data and said stored reference characteristics data set to deliver unequalness data indicating said unequal conditions;

an adjuster which reads out said melody generation data set stored in said storage device, and adjusts said read out melody generation data set in accordance with said unequalness data from said detector; and a melody generator which generates melody data representing a musical piece based on the melody generation data set as adjusted by said adjuster.

10. An automatic music composing apparatus according to claim 9, wherein said melody generator generates melody data also based on the melody data supplied from said supply device.

11. An automatic music composing apparatus according to claim 9, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

12. An automatic music composing apparatus comprising:

a storage device which stores reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a supply device for supplying melody data which defines a desired melody fragment;

an analyzer which analyzes said supplied melody data to determine melody characteristics of said desired melody fragment and creates characteristics data representing melody characteristics of said desired melody fragment;

a detector which compares the characteristics data created by said analyzer with the reference characteristics data set stored in said storage device and detects unequal conditions between said created characteristics data and said stored reference characteristics data set to deliver unequalness data indicating said unequal conditions;

a read out device which reads out said melody generation data set stored in said storage device;

a melody generator which generates melody data representing a musical piece based on the melody generation data set as read out from said storage device; and an adjuster which adjusts said melody data generated by said melody generator in accordance with said unequalness data from said detector.

13. An automatic music composing apparatus according to claim 12, wherein said melody generator generates melody data also based on the melody data supplied from said supply device.

14. An automatic music composing apparatus according to claim 12, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

15. An automatic music composing apparatus comprising:

a storage device which stores reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a supply device for supplying melody data which defines a desired melody fragment;

a detector which compares said supplied melody data supplied by said supply device with the reference melody data set stored in said storage device and detects unequal conditions between said supplied melody data and said stored reference melody data set to deliver unequalness data indicating said unequal conditions;

an adjuster which reads out said melody generation data set stored in said storage device, and adjusts said read out melody generation data set in accordance with said unequalness data from said detector; and a melody generator which generates melody data representing a musical piece based on the melody generation data set as adjusted by said adjuster.

16. An automatic music composing apparatus according to claim 15, wherein said melody generator generates melody data also based on the melody data supplied from said supply device.

17. An automatic music composing apparatus according to claim 15, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

18. An automatic music composing apparatus comprising:

a storage device which stores reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a supply device for supplying melody data which defines a desired melody fragment;

a detector which compares said supplied melody data supplied by said supply device with the reference melody data set stored in said storage device and detects unequal conditions between said supplied melody data and said stored reference characteristics data set to deliver unequalness data indicating said unequal conditions;

a read out device which reads out said melody generation data set stored in said storage device;

a melody generator which generates melody data representing a musical piece based on the melody generation data set as read out from said storage device; and an adjuster which adjusts said melody data generated by said melody generator in accordance with said unequalness data from said detector.

19. An automatic music composing apparatus according to claim 18, wherein said melody generator generates melody data also based on the melody data supplied from said supply device.

20. An automatic music composing apparatus according to claim 18, wherein said supply device is to supply first melody data representing a melody fragment for a partial section of a musical piece to be composed, and said melody generator generates second melody data for the remaining sections of said musical piece to be composed and combines said first melody data and said second melody data to generate a melody data set representing an amount of melody to constitute a musical piece.

21. An automatic music composing apparatus comprising:

a storage device which stores a plurality of musical piece characteristics data sets, each set consisting of a plurality of section characteristics data subsets respectively representing melody characteristics of a plurality of musical sections constituting a piece of music;

a section designating device for designating a selected one of said plurality of musical sections;

a supply device for supplying melody data for the musical section designated by said section designating device;

an analyzer which analyzes said supplied melody data to determine melody characteristics of said designated musical section and creates characteristics data representing melody characteristics of said designated musical section;

a read out device which selects from said storage device a musical piece characteristics data set including a section characteristics data subset representing melody characteristics at said designated musical section which melody characteristics are equal or similar to the melody characteristics represented by said created characteristics data, and reads out said selected musical piece characteristics data set; and a melody generator which utilizes at least a part of the melody represented by said supplied melody data as first melody data for the designated musical section, creates second melody data for the remaining sections other than said designated musical section based on the musical piece characteristics data set read out from said storage device, and combines said first melody data and said second melody data to generate a melody data set representing an amount of melody to constitute a musical piece.

22. An automatic music composing apparatus comprising:

a storage device which stores a plurality of musical piece data sets, each set consisting of a plurality of section melody data subsets respectively representing melodies of a plurality of musical sections constituting a piece of music;

a section designating device for designating a selected one of said plurality of musical sections;

a supply device for supplying melody data for the musical section designated by said section designating device;

a read out device which selects from said storage device a musical piece data set including a section melody data subset representing a melody at said designated musical section which melody is equal or similar to the melody represented by said supplied melody data, and reads out said selected musical piece data set; and a melody generator which utilizes at least a part of the melody represented by said supplied melody data as first melody data for the designated musical section, creates second melody data for the remaining sections other than said designated musical section based on the musical piece data set read out from said storage device, and combines said first melody data and said second melody data to generate a melody data set representing an amount of melody to constitute a musical piece.

23. A computer readable medium for use in an automatic music composing apparatus of a data processing type comprising a computer; a storage device which stores a plurality of musical piece generation data sets, each set including a reference characteristics data set which represents melody characteristics specifying a reference melody fragment and a melody generation data set which contains melody specifying data of an amount for a piece of music so as to be used for generating a melody to constitute a musical piece, said reference characteristics data set included in each said musical piece generation data set typifying said melody generation data set included in said same musical piece generation data set; and a supply device for supplying melody data which defines a desired melody fragment, said medium containing program instructions executable by said computer for executing:

a process of analyzing said supplied melody data to determine melody characteristics of said desired melody fragment and creating characteristics data representing melody characteristics of said desired melody fragment;

a process of comparing the characteristics data created by said analyzing and creating process with the reference characteristics data sets stored in said storage device, and detecting a reference characteristics data set which is equal or similar to said created characteristics data in terms of melody characteristics;

a process of reading out from said storage device a melody generation data set included in the musical piece generation data set of which the reference characteristics data set is detected by said comparing and detecting process; and a process of generating melody data representing a musical piece based on the melody generation data set as read out from said storage device.

24. A computer readable medium for use in an automatic music composing apparatus of a data processing type comprising a computer; a storage device which stores a plurality of musical piece generation data sets, each set including a reference melody data set which specifies a reference melody fragment and a melody generation data set which contains a melody specifying data of an amount for a piece of music so as to be used for generating a melody to constitute a musical piece, said reference melody data set included in each said musical piece generation data set typifying said melody generation data set included in said same musical piece generation data set; and a supply device for supplying melody data which defines a desired melody fragment, said medium containing program instructions executable by said computer for executing:

a process of comparing the melody data supplied by said supply device with the reference melody data sets stored in said storage device and detecting reference melody data which is equal or similar to said supplied melody data;

a process of reading out from said storage device a melody generation data set included in the musical piece generation data set of which the reference melody data set is detected by said comparing and detecting process; and a process of generating melody data representing a musical piece based on the melody generation data set as read out from said storage device.

25. A computer readable medium for use in an automatic music composing apparatus of a data processing type comprising a computer; a storage device which stores reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; and a supply device for supplying melody data which defines a desired melody fragment, said medium containing program instructions executable by said computer for executing:

a process of analyzing said supplied melody data to determine melody characteristics of said desired melody fragment and creating characteristics data representing melody characteristics of said desired melody fragment;

a process of comparing the characteristics data created by said analyzing and creating process with the reference characteristics data set stored in said storage device and detecting unequal conditions between said created characteristics data and said stored reference characteristics data set to deliver unequalness data indicating said unequal conditions;

a process of reading out said melody generation data set stored in said storage device, and adjusting said read out melody generation data set in accordance with said unequalness data delivered by said comparing and detecting process; and a process of generating melody data representing a musical piece based on the melody generation data set as adjusted by said reading out and adjusting process.

26. A computer readable medium for use in an automatic music composing apparatus of a data processing type comprising a computer; a storage device which stores reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; and a supply device for supplying melody data which defines a desired melody fragment, said medium containing program instructions executable by said computer for executing:

a process of analyzing said supplied melody data to determine melody characteristics of said desired melody fragment and creating characteristics data representing melody characteristics of said desired melody fragment;

a process of comparing the characteristics data created by said analyzing and creating process with the reference characteristics data set stored in said storage device and detecting unequal conditions between said created characteristics data and said stored reference characteristics data set to deliver unequalness data indicating said unequal conditions;

a process of reading out said melody generation data set stored in said storage device;

a process of generating melody data representing a musical piece based on the melody generation data set as read out from said storage device; and a process of adjusting said melody data generated by said melody generating process in accordance with said unequalness data delivered by said comparing and detecting process.

27. A computer readable medium for use in an automatic music composing apparatus of a data processing type comprising a computer; a storage device which stores reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; and a supply device for supplying melody data which defines a desired melody fragment, said medium containing program instructions executable by said computer for executing:

a process of comparing said supplied melody data supplied by said supply device with the reference melody data set stored in said storage device and detecting unequal conditions between said supplied melody data and said stored reference melody data set to deliver unequalness data indicating said unequal conditions;

a process of reading out said melody generation data set stored in said storage device, and adjusting said read out melody generation data set in accordance with said unequalness data delivered by said comparing and detecting process; and a process of generating melody data representing a musical piece based on the melody generation data set as adjusted by said reading out and adjusting process.

28. A computer readable medium for use in an automatic music composing apparatus of a data processing type comprising a computer; a storage device which stores reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set; and a supply device for supplying melody data which defines a desired melody fragment, said medium containing program instructions executable by said computer for executing:

a process of comparing said supplied melody data supplied by said supply device with the reference melody data set stored in said storage device and detecting unequal conditions between said supplied melody data and said stored reference melody data set to deliver unequalness data indicating said unequal conditions;

a process of reading out said melody generation data set stored in said storage device;

a process of generating melody data representing a musical piece based on the melody generation data set as read out from said storage device; and a process of adjusting said melody data generated by said melody data generating process in accordance with said unequalness data delivered by said comparing and detecting process.

29. A computer readable medium for use in an automatic music composing apparatus of a data processing type comprising a computer; a storage device which stores a plurality of musical piece characteristics data sets, each set consisting of a plurality of section characteristics data subsets respectively representing melody characteristics of a plurality of musical sections constituting a piece of music; a section designating device for designating a selected one of said plurality of musical sections; and a supply device for supplying melody data for the musical section designated by said section designating device; said medium containing program instructions executable by said computer for executing:

a process of analyzing said supplied melody data to determine melody characteristics of said designated musical section, and creating characteristics data representing melody characteristics of said designated musical section;

a process of selecting from said storage device a musical piece characteristics data set including a section characteristics data subset representing melody characteristics at said designated musical section which melody characteristics are equal or similar to the melody characteristics represented by said created characteristics data, and reading out said selected musical piece characteristics data set; and a process of utilizing at least a part of the melody represented by said supplied melody data as first melody data for the designated musical section, creating second melody data for the remaining sections other than said designated musical section based on the musical piece characteristics data set read out from said storage device, and combining said first melody data and said second melody data to generate a melody data set representing an amount of melody to constitute a musical piece.

30. A computer readable medium for use in an automatic music composing apparatus of a data processing type comprising a computer; a storage device which stores a plurality of musical piece data sets, each set consisting of a plurality of section melody data subsets respectively representing melodies of a plurality of musical sections constituting a piece of music; a section designating device for designating a selected one of said plurality of musical sections; and a supply device for supplying melody data for the musical section designated by said section designating device; said medium containing program instructions executable by said computer for executing:

a process of selecting from said storage device a musical piece data set including a section melody data subset representing a melody at said designated musical section which melody is equal or similar to the melody represented by said supplied melody data, and reading out said selected musical piece data set; and a process of utilizing at least a part of the melody represented by said supplied melody data as first melody data for the designated musical section, creating second melody data for the remaining sections other than said designated musical section based on the musical piece data set read out from said storage device, and combining said first melody data and said second melody data to generate a melody data set representing an amount of melody to constitute a musical piece.

31. A method for composing a melody of a musical piece comprising:

a step of storing in a storage device a plurality of musical piece generation data sets, each set including a reference characteristics data set which represents melody characteristics specifying a reference melody fragment and a melody generation data set which contains melody specifying data of an amount for a piece of music so as to be used for generating a melody to constitute a musical piece, said reference characteristics data set included in each said musical piece generation data set typifying said melody generation data set included in said same musical piece generation data set;

a step of supplying melody data which defines a desired melody fragment;

a step of analyzing said supplied melody data to determine melody characteristics of said desired melody fragment and creating characteristics data representing melody characteristics of said desired melody fragment;

a step of comparing the characteristics data created by said analyzing and creating step with the reference characteristics data sets stored in said storage device, and detecting a reference characteristics data set which is equal or similar to said created characteristics data in terms of melody characteristics;

a step of reading out from said storage device a melody generation data set included in the musical piece generation data set of which the reference characteristics data set is detected by said comparing and detecting step; and a step of generating melody data representing a musical piece based on the melody generation data set as read out from said storage device.

32. A method for composing a melody of a musical piece comprising:

a step of storing in a storage device a plurality of musical piece generation data sets, each set including a reference melody data set which specifies a reference melody fragment and a melody generation data set which contains a melody specifying data of an amount for a piece of music so as to be used for generating a melody to constitute a musical piece, said reference melody data set included in each said musical piece generation data set typifying said melody generation data set included in said same musical piece generation data set;

a step of supplying melody data which defines a desired melody fragment;

a step of comparing the melody data supplied by said supply device with the reference melody data sets stored in said storage device and detecting reference melody data which is equal or similar to said supplied melody data;

a step of reading out from said storage device a melody generation data set included in the musical piece generation data set of which the reference melody data set is detected by said comparing and detecting step; and a step of generating melody data representing a musical piece based on the melody generation data set as read out from said storage device.

33. A method for composing a melody of a musical piece comprising:

a step of storing in a storage device reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a step of supplying melody data which defines a desired melody fragment;

a step of analyzing said supplied melody data to determine melody characteristics of said desired melody fragment and creating characteristics data representing melody characteristics of said desired melody fragment;

a step of comparing the characteristics data created by said analyzing and creating step with the reference characteristics data set stored in said storage device and detecting unequal conditions between said created characteristics data and said stored reference characteristics data set to deliver unequalness data indicating said unequal conditions;

a step of reading out said melody generation data set stored in said storage device, and adjusting said read out melody generation data set in accordance with said unequal data delivered by said comparing and detecting step; and a step of generating melody data representing a musical piece based on the melody generation data set as adjusted by said reading out and adjusting step.

34. A method for composing a melody of a musical piece comprising:

a step of storing in a storage device reference characteristics data sets each of which represents melody characteristics specifying a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a step of supplying melody data which defines a desired melody fragment;

a step of analyzing said supplied melody data to determine melody characteristics of said desired melody fragment and creating characteristics data representing melody characteristics of said desired melody fragment;

a step of comparing the characteristics data created by said analyzing and creating step with the reference characteristics data set stored in said storage device and detecting unequal conditions between said created characteristics data and said stored reference characteristics data set to deliver unequalness data indicating said unequal conditions;

a step of reading out said melody generation data set stored in said storage device;

a step of generating melody data representing a musical piece based on the melody generation data set as read out from said storage device; and a step of adjusting said melody data generated by said melody generating step in accordance with said unequalness data delivered by said comparing and detecting step.

35. A method for composing a melody of a musical piece comprising:

a step of storing in a storage device reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a step of supplying melody data which defines a desired melody fragment;

a step of comparing said supplied melody data supplied by said supply device with the reference melody data set stored in said storage device and detecting unequal conditions between said supplied melody data and said stored reference melody data set to deliver unequalness data indicating said unequal conditions;

a step of reading out said melody generation data set stored in said storage device, and adjusting said read out melody generation data set in accordance with said unequalness data delivered by said comparing and detecting step; and a step of generating melody data representing a musical piece based on the melody generation data set as adjusted by said reading out and adjusting step.

36. A method for composing a melody of a musical piece comprising:

a step of storing in a storage device reference melody data sets each of which represents a reference melody fragment and melody generation data sets each of which contains melody specifying data of an amount for a piece of music so as to be used for generating a melody to constitute a musical piece, each said reference melody fragment being a melody fragment which correspondingly typifies each said melody generation data set;

a step of supplying melody data which defines a desired melody fragment;

a step of comparing said supplied melody data supplied by said supply device with the reference melody data set stored in said storage device and detecting unequal conditions between said supplied melody data and said stored reference melody data set to deliver unequalness data indicating said unequal conditions;

a step of reading out said melody generation data set stored in said storage device;

a step of generating melody data representing a musical piece based on the melody generation data set as read out from said storage device; and a step of adjusting said melody data generated by said melody data generating step in accordance with said unequalness data delivered by said comparing and detecting step.

37. A method for composing a melody of a musical piece comprising:

a step of storing in a storage device a plurality of musical piece characteristics data sets, each set consisting of a plurality of section characteristics data subsets respectively representing melody characteristics of a plurality of musical sections constituting a piece of music;

a step of designating a selected one of said plurality of musical sections;

a step of supplying melody data for the musical section designated by said section designating device;

a step of analyzing said supplied melody data to determine melody characteristics of said designated musical section, and creating characteristics data representing melody characteristics of said designated musical section;

a step of selecting from said storage device a musical piece characteristics data set including a section characteristics data subset representing melody characteristics at said designated musical section which melody characteristics are equal or similar to the melody characteristics represented by said created characteristics data, and reading out said selected musical piece characteristics data set; and a step of utilizing at least a part of the melody represented by said supplied melody data as first melody data for the designated musical section, creating second melody data for the remaining sections other than said designated musical section based on the musical piece characteristics data set read out from said storage device, and combining said first melody data and said second melody data to generate a melody data set representing an amount of melody to constitute a musical piece.

38. A method for composing a melody of a musical piece comprising:

a step of storing in a storage device a plurality of musical piece data sets, each set consisting of a plurality of section melody data subsets respectively representing melodies of a plurality of musical sections constituting a piece of music;

a step of designating a selected one of said plurality of musical sections;

a step of supplying melody data for the musical section designated by said section designating device; said medium containing program instructions executable by said computer for executing:

a step of selecting from said storage device a musical piece data set including a section melody data subset representing a melody at said designated musical section which melody is equal or similar to the melody represented by said supplied melody data, and reading out said selected musical piece data set; and a step of utilizing at least a part of the melody represented by said supplied melody data as first melody data for the designated musical section, creating second melody data for the remaining sections other than said designated musical section based on the musical piece data set read out from said storage device, and combining said first melody data and said second melody data to generate a melody data set representing an amount of melody to constitute a musical piece.

* * * * *